US010429074B2

(12) United States Patent
Deng

(10) Patent No.: US 10,429,074 B2
(45) Date of Patent: Oct. 1, 2019

(54) DUAL FUEL HEATING ASSEMBLY WITH SELECTOR SWITCH

(71) Applicant: David Deng, Diamond Bar, CA (US)

(72) Inventor: David Deng, Diamond Bar, CA (US)

( * ) Notice: Subject to any disclaimer, the term of this patent is extended or adjusted under 35 U.S.C. 154(b) by 573 days.

(21) Appl. No.: 15/175,915

(22) Filed: Jun. 7, 2016

(65) Prior Publication Data

US 2016/0290656 A1 Oct. 6, 2016

Related U.S. Application Data

(63) Continuation-in-part of application No. 14/713,947, filed on May 15, 2015, now Pat. No. 10,240,789.

(60) Provisional application No. 61/994,786, filed on May 16, 2014, provisional application No. 61/994,790, filed on May 16, 2014, provisional application No.
(Continued)

(51) Int. Cl.

| | |
|---|---|
| ***F24C 1/02*** | (2006.01) |
| ***F24H 9/18*** | (2006.01) |
| ***F24H 3/00*** | (2006.01) |
| ***F23N 1/00*** | (2006.01) |
| *F24H 9/20* | (2006.01) |
| *F24H 9/00* | (2006.01) |

(52) U.S. Cl.

CPC ..... *F24C 1/02* (2013.01); *F23N 1/007* (2013.01); *F24H 3/006* (2013.01); *F24H 9/1881* (2013.01); *F23D 2204/00* (2013.01); *F24D 2200/04* (2013.01); *F24H 9/0094* (2013.01); *F24H 9/2085* (2013.01)

(58) Field of Classification Search

CPC ..... F24C 1/02; Y10T 137/2693; F24H 9/1881

USPC ..... 137/119.01, 119.03, 119.08, 599.09; 431/280

See application file for complete search history.

(56) References Cited

U.S. PATENT DOCUMENTS

| | | | |
|---|---|---|---|
| 188,740 | A | 3/1877 | Murphy |
| 743,714 | A | 11/1903 | Guese |

(Continued)

FOREIGN PATENT DOCUMENTS

| | | |
|---|---|---|
| CN | 2421550 | 2/2001 |
| CN | 2430629 Y | 5/2001 |

(Continued)

OTHER PUBLICATIONS

Office Action dated Jul. 10, 2018 from U.S. Appl. No. 14/713,948.

(Continued)

*Primary Examiner* — Avinash A Savani
*Assistant Examiner* — Aaron H Heyamoto
(74) *Attorney, Agent, or Firm* — Innovation Capital Law Group, LLP; Vic Lin

(57) ABSTRACT

A heating assembly can include a switching valve which can include certain pressure sensitive features. These features can be configured to change from a first position to a second position based on a pressure of a fuel. The valve can be used with either a first fuel or a second fuel different from the first. The valve can become locked or be held in either the first or the second position. For example, a set fuel pressure can cause the valve to move to a closed position and the valve can become locked or held in that position. If the pressure decreases, the valve can remain in the locked position. Actuation of a reset switch can allow the valve to move to a new position, such as an open position.

19 Claims, 42 Drawing Sheets

Related U.S. Application Data

61/994,796, filed on May 16, 2014, provisional application No. 62/022,605, filed on Jul. 9, 2014, provisional application No. 62/034,063, filed on Aug. 6, 2014, provisional application No. 62/322,177, filed on Apr. 13, 2016.

(56) References Cited

U.S. PATENT DOCUMENTS

| | | | |
|---|---|---|---|
| 1,051,072 | A | 1/1913 | Bradley |
| 1,589,386 | A | 6/1926 | Harper |
| 1,639,115 | A | 8/1927 | Smith |
| 1,697,865 | A | 1/1929 | Hahn et al. |
| 1,729,819 | A | 10/1929 | Campbell |
| 1,755,639 | A | 4/1930 | Fawcett |
| 1,867,110 | A | 7/1932 | Signore |
| 2,088,685 | A | 8/1937 | Birch |
| 2,160,264 | A | 5/1939 | Furlong |
| 2,161,523 | A | 6/1939 | Moecker, Jr. et al. |
| 2,319,676 | A | 5/1943 | Guelson |
| 2,354,286 | A | 7/1944 | Whaley, Jr. |
| 2,380,956 | A | 8/1945 | Everts |
| 2,397,670 | A | 4/1946 | Krugler |
| 2,422,368 | A | 6/1947 | Ray |
| 2,464,697 | A | 3/1949 | Logan et al. |
| 2,518,894 | A | 8/1950 | Humbarger et al. |
| 2,556,337 | A | 6/1951 | Paille |
| 2,560,245 | A | 7/1951 | Ramsaur et al. |
| 2,578,042 | A | 12/1951 | Chandler |
| 2,588,485 | A | 3/1952 | Clarke et al. |
| 2,630,821 | A | 3/1953 | Arey et al. |
| 2,641,273 | A | 6/1953 | Siebens |
| 2,661,157 | A | 12/1953 | Reichelderfer |
| 2,687,140 | A | 8/1954 | St. Clair et al. |
| 2,693,812 | A | 11/1954 | Jones et al. |
| 2,905,361 | A | 9/1959 | Noall |
| 2,966,920 | A | 1/1961 | Oglesby et al. |
| 2,969,924 | A | 1/1961 | William |
| 3,001,541 | A | 9/1961 | St. Clair et al. |
| 3,032,096 | A | 5/1962 | Stoui |
| 3,054,529 | A | 9/1962 | Billington |
| 3,083,721 | A | 4/1963 | Matthews et al. |
| 3,331,392 | A | 7/1967 | Davidson et al. |
| 3,386,656 | A | 6/1968 | Bergquist |
| 3,417,779 | A | 12/1968 | Golay |
| 3,430,655 | A | 3/1969 | Forney |
| 3,550,613 | A | 12/1970 | Barber |
| 3,552,430 | A | 1/1971 | Love |
| 3,578,015 | A | 5/1971 | Andersen |
| 3,578,243 | A | 5/1971 | Love |
| 3,633,606 | A | 1/1972 | Hay |
| 3,747,629 | A | 7/1973 | Bauman |
| 3,800,830 | A | 4/1974 | Etter |
| 3,802,454 | A | 4/1974 | Kleuters |
| 3,814,570 | A | 6/1974 | Guigues et al. |
| 3,814,573 | A | 6/1974 | Karlovetz |
| 3,829,279 | A | 8/1974 | Qualley et al. |
| 3,843,310 | A | 10/1974 | Massi |
| 3,884,413 | A | 5/1975 | Berquist |
| 3,939,871 | A | 2/1976 | Dickson |
| 4,021,190 | A | 5/1977 | Dickson |
| 4,081,235 | A | 3/1978 | Van der Veer |
| 4,101,257 | A | 7/1978 | Straitz, III |
| 4,157,238 | A | 6/1979 | Van Berkum |
| 4,171,712 | A | 10/1979 | DeForrest |
| 4,181,154 | A | 1/1980 | Oley et al. |
| 4,290,450 | A | 9/1981 | Swanson |
| 4,301,825 | A | 11/1981 | Simko |
| 4,355,659 | A | 10/1982 | Kelchner |
| 4,359,284 | A | 11/1982 | Kude et al. |
| 4,465,456 | A | 8/1984 | Hynek et al. |
| 4,474,166 | A | 10/1984 | Shaftner et al. |
| 4,515,554 | A | 5/1985 | Sirand |
| 4,660,595 | A | 4/1987 | Kuster et al. |
| 4,718,448 | A | 1/1988 | Love et al. |
| 4,718,846 | A | 1/1988 | Oguri et al. |
| 4,768,543 | A | 9/1988 | Wienke et al. |
| 4,768,947 | A | 9/1988 | Adachi |
| 4,796,652 | A | 1/1989 | Hafla |
| 4,848,133 | A | 7/1989 | Paulis et al. |
| 4,874,006 | A | 10/1989 | Iqbal |
| 4,930,538 | A | 6/1990 | Browne |
| 4,944,324 | A | 7/1990 | Kajino et al. |
| 4,958,771 | A | 9/1990 | Klomp |
| 4,965,707 | A | 10/1990 | Butterfield |
| 5,025,990 | A | 6/1991 | Ridenour |
| 5,027,854 | A | 7/1991 | Genbauffe |
| 5,172,728 | A | 12/1992 | Tsukazaki |
| 5,251,823 | A | 10/1993 | Joshi et al. |
| 5,278,936 | A | 1/1994 | Shao |
| 5,379,794 | A | 1/1995 | Brown |
| 5,413,141 | A | 5/1995 | Dietiker |
| 5,452,709 | A | 9/1995 | Mealer |
| 5,458,294 | A | 10/1995 | Zachary et al. |
| 5,470,018 | A | 11/1995 | Smith |
| 5,513,798 | A | 5/1996 | Tavor |
| 5,520,206 | A | 5/1996 | Deville |
| 5,542,609 | A | 8/1996 | Myers et al. |
| 5,567,141 | A | 10/1996 | Joshi et al. |
| 5,584,680 | A | 12/1996 | Kim |
| 5,591,024 | A | 1/1997 | Eavenson et al. |
| 5,603,211 | A | 2/1997 | Graves |
| 5,642,580 | A | 7/1997 | Hess et al. |
| 5,674,065 | A | 10/1997 | Grando et al. |
| 5,706,859 | A | 1/1998 | Backlund |
| 5,782,626 | A | 7/1998 | Joos et al. |
| 5,787,874 | A | 8/1998 | Krohn et al. |
| 5,787,928 | A | 8/1998 | Allen et al. |
| 5,795,145 | A | 8/1998 | Manning et al. |
| 5,807,098 | A | 9/1998 | Deng |
| 5,814,121 | A | 9/1998 | Travis |
| 5,838,243 | A | 11/1998 | Gallo |
| 5,906,197 | A | 5/1999 | French et al. |
| 5,915,952 | A | 6/1999 | Manning et al. |
| 5,941,699 | A | 8/1999 | Abele |
| 5,944,257 | A | 8/1999 | Dietiker et al. |
| 5,966,937 | A | 10/1999 | Graves |
| 5,971,746 | A | 10/1999 | Givens et al. |
| 5,975,112 | A | 11/1999 | Ohmi et al. |
| 5,987,889 | A | 11/1999 | Graves et al. |
| 5,988,204 | A | 11/1999 | Reinhardt et al. |
| 6,035,893 | A | 3/2000 | Ohmi et al. |
| 6,045,058 | A | 4/2000 | Dobbeling et al. |
| 6,076,517 | A | 6/2000 | Kahlke et al. |
| 6,135,063 | A | 10/2000 | Welden |
| 6,162,048 | A | 12/2000 | Griffioen et al. |
| 6,244,223 | B1 | 6/2001 | Welk |
| 6,244,524 | B1 | 6/2001 | Tackels et al. |
| 6,257,270 | B1 | 7/2001 | Ohmi et al. |
| 6,354,072 | B1 | 3/2002 | Hura |
| 6,354,078 | B1 | 3/2002 | Karlsson et al. |
| 6,402,052 | B1 | 6/2002 | Murawa |
| 6,543,235 | B1 | 4/2003 | Crocker et al. |
| 6,607,854 | B1 | 8/2003 | Rehg et al. |
| 6,705,342 | B2 | 3/2004 | Santinanavat et al. |
| 6,786,194 | B2 | 9/2004 | Koegler et al. |
| 6,832,625 | B2 | 12/2004 | Ford |
| 6,845,966 | B1 | 1/2005 | Albizuri |
| 6,884,065 | B2 | 4/2005 | Vandrak et al. |
| 6,901,962 | B2 | 6/2005 | Kroupa et al. |
| 6,904,873 | B1 | 6/2005 | Ashton |
| 6,910,496 | B2 | 6/2005 | Strom |
| 6,938,634 | B2 | 9/2005 | Dewey, Jr. |
| 6,941,962 | B2 | 9/2005 | Haddad |
| 7,013,886 | B2 | 3/2006 | Deng |
| 7,044,729 | B2 | 5/2006 | Ayastuy et al. |
| 7,048,538 | B2 | 5/2006 | Albizuri |
| 7,143,783 | B2 | 12/2006 | Emke et al. |
| 7,146,997 | B2 | 12/2006 | Francis et al. |
| 7,156,370 | B2 | 1/2007 | Albizuri |
| 7,174,913 | B2 | 2/2007 | Albizuri |
| 7,201,186 | B2 | 4/2007 | Ayastuy |
| 7,225,830 | B1 | 6/2007 | Kershaw |
| 7,251,940 | B2 | 8/2007 | Graves et al. |

(56) References Cited

U.S. PATENT DOCUMENTS 7,299,799 B2 11/2007 Albizuri
7,341,074 B2 * 3/2008 Pechtold ..... G05D 16/0672 137/505.42
7,367,352 B2 5/2008 Hagen et al.
7,434,447 B2 10/2008 Deng
7,458,386 B2 12/2008 Zhang
7,487,888 B1 2/2009 Pierre, Jr.
7,490,869 B2 2/2009 Iturralde et al.
7,523,762 B2 4/2009 Buezies et al.
7,528,608 B2 5/2009 Elexpuru et al.
7,533,656 B2 5/2009 Dingle
7,591,257 B2 9/2009 Bayer et al.
7,600,529 B2 10/2009 Querejeta
7,607,325 B2 10/2009 Elexpuru et al.
7,607,426 B2 10/2009 Deng
7,617,841 B2 11/2009 Zimpfer et al.
7,634,993 B2 12/2009 Bellomo
7,637,476 B2 12/2009 Mugica et al.
7,641,470 B2 1/2010 Albizuri
7,651,330 B2 1/2010 Albizuri
7,654,820 B2 2/2010 Deng
7,677,236 B2 3/2010 Deng
7,730,765 B2 6/2010 Deng
7,758,323 B2 7/2010 Orue
7,766,006 B1 8/2010 Manning
7,861,706 B2 1/2011 Bellomo
7,942,164 B2 5/2011 Hsiao
7,967,005 B2 6/2011 Parrish
7,967,006 B2 6/2011 Deng
7,967,007 B2 6/2011 Deng
8,011,920 B2 9/2011 Deng
8,057,219 B1 11/2011 Manning et al.
8,123,150 B2 2/2012 Khan et al.
8,152,515 B2 4/2012 Deng
8,162,002 B2 * 4/2012 Pavin ..... F23N 1/005 137/613
8,235,708 B2 8/2012 Deng
8,241,034 B2 8/2012 Deng
8,317,511 B2 11/2012 Deng
8,418,661 B2 * 4/2013 Kanda ..... F23D 14/04 122/31.1
8,465,277 B2 6/2013 Deng
8,517,718 B2 8/2013 Deng
8,545,216 B2 10/2013 Deng
8,568,136 B2 10/2013 Deng
8,613,276 B2 12/2013 Parrish
8,752,541 B2 6/2014 Deng
8,757,139 B2 6/2014 Deng
8,757,202 B2 6/2014 Deng
8,851,065 B2 10/2014 Deng
8,915,239 B2 12/2014 Deng
8,985,094 B2 3/2015 Deng
9,021,859 B2 5/2015 Deng
9,091,431 B2 7/2015 Deng
9,097,422 B2 8/2015 Deng
9,140,457 B2 9/2015 Deng
9,170,016 B2 10/2015 Deng
9,175,848 B2 11/2015 Deng
9,200,801 B2 12/2015 Deng
9,200,802 B2 12/2015 Deng
9,222,670 B2 12/2015 Deng
9,416,977 B2 8/2016 Deng
9,423,123 B2 8/2016 Deng et al.
9,441,833 B2 9/2016 Deng
9,441,840 B2 9/2016 Deng et al.
9,518,732 B2 12/2016 Deng
9,523,497 B2 12/2016 Deng et al.
9,581,329 B2 2/2017 Deng
9,587,830 B2 3/2017 Deng
9,752,779 B2 9/2017 Deng
9,752,782 B2 9/2017 Deng
10,066,838 B2 9/2018 Deng
2002/0058266 A1 5/2002 Clough et al.
2002/0160325 A1 10/2002 Deng
2002/0160326 A1 10/2002 Deng
2003/0010952 A1 1/2003 Morete
2003/0217555 A1 11/2003 Gerhold
2004/0226600 A1 11/2004 Starer et al.
2004/0238030 A1 12/2004 Dewey, Jr.
2005/0167530 A1 8/2005 Ward et al.
2005/0202361 A1 9/2005 Albizuri
2005/0208443 A1 9/2005 Bachinski et al.
2006/0096644 A1 5/2006 Goldfarb et al.
2006/0201496 A1 9/2006 Shingler
2006/0236986 A1 10/2006 Fujisawa
2007/0044856 A1 3/2007 Bonior
2007/0154856 A1 7/2007 Hallit et al.
2007/0210069 A1 9/2007 Albizuri
2007/0215223 A1 9/2007 Morris
2007/0277803 A1 12/2007 Deng
2007/0277813 A1 12/2007 Deng
2008/0121116 A1 5/2008 Albizuri
2008/0168980 A1 7/2008 Lyons et al.
2008/0236688 A1 10/2008 Albizuri
2008/0236689 A1 10/2008 Albizuri
2008/0314090 A1 12/2008 Orue Orue et al.
2009/0039072 A1 2/2009 Liana
2009/0140193 A1 6/2009 Albizuri Landa
2009/0159068 A1 6/2009 Querejeta et al.
2009/0280448 A1 11/2009 Antxia Uribetxbarria et al.
2010/0035195 A1 2/2010 Querejeta Andueza et al.
2010/0035196 A1 2/2010 Deng
2010/0086884 A1 4/2010 Querejeta Andueza et al.
2010/0086885 A1 4/2010 Querejeta Andueza et al.
2010/0089385 A1 4/2010 Albizuri
2010/0089386 A1 4/2010 Albizuri
2010/0095945 A1 4/2010 Manning
2010/0154777 A1 6/2010 Carvalho et al.
2010/0255433 A1 10/2010 Querejeta Andueza et al.
2010/0275953 A1 11/2010 Orue Orue et al.
2010/0310997 A1 12/2010 Mugica Odriozola et al.
2010/0319789 A1 12/2010 Erdmann et al.
2010/0326430 A1 12/2010 Deng
2010/0330513 A1 12/2010 Deng
2010/0330518 A1 12/2010 Deng
2010/0330519 A1 12/2010 Deng
2011/0226355 A1 9/2011 Benvenuto et al.
2011/0284791 A1 11/2011 Vasquez et al.
2012/0006091 A1 1/2012 Deng
2012/0006426 A1 1/2012 Gorelic
2012/0012097 A1 1/2012 Deng
2012/0012099 A1 1/2012 Deng
2012/0012103 A1 1/2012 Deng
2012/0080024 A1 4/2012 Deng
2013/0037014 A1 2/2013 Deng
2013/0101945 A1 * 4/2013 Mulberry ..... F24H 3/00 431/280
2013/0299022 A1 11/2013 Deng
2014/0072921 A1 3/2014 Deng
2014/0150767 A1 6/2014 Deng
2014/0299123 A1 10/2014 Deng
2016/0146471 A1 5/2016 Deng
2016/0161146 A1 6/2016 Deng
2016/0290656 A1 10/2016 Deng
2017/0138604 A1 5/2017 Deng

FOREIGN PATENT DOCUMENTS

CN 1873268 12/2006
CN 1873268 A 12/2006
DE 113 680 C 11/1899
DE 720 854 C 5/1942
DE 1650303 9/1970
DE 1959677 5/1971
DE 3700233 A1 7/1988
DE 19543018 5/1997
EP 0509626 10/1992
EP 1326050 7/2003
GB 19845 2/1913
GB 1136468 12/1968
GB 2241180 8/1991
GB 2298039 8/1996
JP 58 219320 A 12/1983
JP 59009425 1/1984

(56) References Cited

FOREIGN PATENT DOCUMENTS

| | | | |
|---|---|---|---|
| JP | 03 230015 | A | 10/1991 |
| JP | 05-256422 | | 5/1993 |
| JP | 10141656 | | 5/1998 |
| JP | 11192166 | | 7/1999 |
| JP | 11-344216 | | 12/1999 |
| JP | 2000234738 | | 8/2000 |
| JP | 2003 056845 | A | 2/2003 |
| JP | 2003 074837 | A | 3/2003 |
| JP | 2003 074838 | A | 3/2003 |
| JP | 2010071477 | | 4/2010 |
| WO | WO 2008/071970 | | 6/2008 |

OTHER PUBLICATIONS

Country Flame Technologies Inglenook Fireplace Gas Log Set Model INGLS 24-N or INGLS 24-P Natural Gas or Propane Conversion Kit, Installation, Operation, and Maintenance Manual, 2004.
Desa Heating Products, Technical Service Training Manual, 2004.
Flagro F-400T Dual Fuel Construction Heater, Operating Instructions Manual.
Heat Wagon S1505 Construction Heater, Installation and Maintenance Manual, Jul. 29, 2002.
Jotul GF 3 BVAllagash B-Vent Gas Heater, Installation and Operating Instructions, Dec. 2000.
Vanguard Unvented (Vent-Free) Propane/LP Gas Log Heater Manual, Feb. 2004.
White Mountain Hearth, The Vail Vent-Free Gas Fireplace, Installation Instructions and Owner's Manual, Mar. 2006.
Installation Instructions and Owner's Manuals for Empire Unvented Gas Fireplace Model VFHS-36, Mar. 2001.
Installation Instructions and Owner's Manuals for Empire Unvented Gas Fireplace Model VFHS-33, Apr. 2001.
Installation Instructions and Owner's Manuals for Empire Unvented Gas Fireplace Models VFHD-32 and VFHS-36, Apr. 2003.
Installation Instructions and Owner's Manuals for Empire Unvented Gas Fireplace Models VFHD-32 and VFHS-36, Sep. 2003.
Installation Instructions and Owner's Manuals for Empire Unvented Gas Fireplace Models VFHD-32 and VFHS-36, Feb. 2004.
Installation Instructions and Owner's Manuals for Empire Unvented Gas Fireplace Models VFHD-32 and VFHS-36, Sep. 2004.
Installation Instructions and Owner's Manuals for Empire Unvented Gas Fireplace Models VFHD-32 and VFHS-36, Jun. 2005.
Installation Instructions and Owner's Manuals for Empire Unvented Gas Fireplace Models VFP32FP and VFP36FP, Mar. 2006.
Installation Instructions and Owner's Manuals for Empire Unvented Gas Fireplace Models VFP32FP and VFP36FP, May 2006.
Installation Instructions and Owner's Manuals for Empire Unvented Gas Fireplace Model VFHS-20, Jun. 2002.
Installation Instructions and Owner's Manuals for Empire Unvented Gas Fireplace Model VFHS-20, Sep. 2003.
Installation Instructions and Owner's Manuals for Empire Unvented Gas Fireplace Model VFHS-20, Nov. 2003.
Installation Instructions and Owner's Manuals for Empire Unvented Gas Fireplace Model VFHS-20, Sep. 2004.
Installation Instructions and Owner's Manuals for Empire Unvented Gas Fireplace Model VFHS-20, Jun. 2005.
Installation Instructions and Owner's Manuals for Empire Unvented Gas Fireplace Model VFHS-32, Aug. 2002.
*Procom Heating, Inc.* v. *GHP Group, Inc.* (W.D. KY, Case No. 1:13-cv-00163-GNS-HBB): GHP's Answer to the First Amended Complaint, Aug. 27, 2014.
*Procom Heating, Inc.* v. *GHP Group, Inc.* (W.D. KY, Case No. 1:13-cv-00163-GNS-HBB): Procom Heating's First Amended Complaint, Aug. 13, 2014.
*Procom Heating, Inc.* v. *GHP Group, Inc.* (W.D. KY, Case No. 1:13-cv-00163-GNS-HBB): Claims Construction Memorandum Opinion and Order, Jul. 8, 2015.
*Procom Heating, Inc.* v. *GHP Group, Inc.* (W.D. KY, Case No. 1:13-cv-00163-GNS-HBB): GHP's Initial Invalidity Contentions, Mar. 31, 2014.
*Procom Heating, Inc.* v. *GHP Group, Inc.* (W.D. KY, Case No. 1:13-cv-00163-GNS-HBB): GHP's 2nd Amended Initial Invalidity Contentions, Sep. 4, 2015.
*Procom Heating, Inc.* v. *GHP Group, Inc.* (W.D. KY, Case No. 1:13-cv-00163-GNS-HBB): GHP's 2nd Amended Initial Invalidity Contentions, Claims Chart—Exhibit A, Sep. 4, 2015.
*Procom Heating, Inc.* v. *GHP Group, Inc.* (W.D. KY, Case No. 1:13-cv-00163-GNS-HBB): GHP's 2nd Amended Initial Invalidity Contentions, Claims Chart—Exhibit B, Sep. 4, 2015.
*Procom Heating, Inc.* v. *GHP Group, Inc.* (W.D. KY, Case No. 1:13-cv-00163-GNS-HBB): GHP's 2nd Amended Initial Invalidity Contentions, Claims Chart—Exhibit C, Sep. 4, 2015.
*Procom Heating, Inc.* v. *GHP Group, Inc.* (W.D. KY, Case No. 1:13-cv-00163-GNS-HBB): GHP's 2nd Amended Initial Invalidity Contentions, Claims Chart—Exhibit D, Sep. 4, 2015.
*Procom Heating, Inc.* v. *GHP Group, Inc.* (W.D. KY, Case No. 1:13-cv-00163-GNS-HBB): GHP's 2nd Amended Initial Invalidity Contentions, Claims Chart—Exhibit E, Sep. 4, 2015.
*Procom Heating, Inc.* v. *GHP Group, Inc.* (W.D. KY, Case No. 1:13-cv-00163-GNS-HBB): GHP's 2nd Amended Initial Invalidity Contentions, Claims Chart—Exhibit F, Sep. 4, 2015.
*Procom Heating, Inc.* v. *GHP Group, Inc.* (W.D. KY, Case No. 1:13-cv-00163-GNS-HBB): GHP's 2nd Amended Initial Invalidity Contentions, Claims Chart—Exhibit G, Sep. 4, 2015.
Consumer Guide to Vent-Free Gas Supplemental Heating Products, est. 2007.
Heat and Glo, Escape Series Gas Fireplaces, Mar. 2005.
Heat and Glo, Escape-42DV Owner's Manual, Rev. i, Dec. 2006.
Napoleon, Park Avenue Installation and Operation Instructions, Jul. 20, 2006.
Napoleon, The Madison Installation and Operation Instructions, May 24, 2005.

* cited by examiner

NG SWITCH PATH

LPG SWITCH PATH

NG SWITCH PATH

LPG SWITCH PATH

DUAL FUEL HEATING ASSEMBLY WITH SELECTOR SWITCH

CROSS-REFERENCE TO RELATED APPLICATIONS

This application is a continuation-in-part of U.S. application Ser. No. 14/713,947, filed May 15, 2015 which claims priority to U.S. Provisional Appl. Nos. 61/994,786, filed May 16, 2014; 61/994,790, filed May 16, 2014; 61/994,796, filed May 16, 2014; 62/022,605, filed Jul. 9, 2014; and 62/034,063, filed Aug. 6, 2014. This application also claims priority to U.S. Provisional Appl. No. 62/322,177, filed Apr. 13, 2016. The entire contents of the above applications are hereby incorporated by reference and made a part of this specification. Any and all priority claims identified in the Application Data Sheet, or any correction thereto, are hereby incorporated by reference under 37 CFR 1.57. U.S. patent application Ser. No. 13/155,328, filed Jun. 7, 2011, now U.S. Pat. No. 8,752,541 is also incorporated by reference in its entirety and for all purposes.

BACKGROUND OF THE INVENTION

Field of the Invention

Certain embodiments disclosed herein relate generally to a heating assembly for use in a gas appliance. Certain embodiments can include a selector valve for a heating assembly to determine a flow path based on fuel type and/or pressure. Aspects of certain embodiments may be particularly adapted for single fuel, dual fuel or multi-fuel use. The gas appliance can include, but is not limited to: heaters, boilers, dryers, washing machines, ovens, fireplaces, stoves, etc.

Description of the Related Art

Many varieties of devices, such as heaters, boilers, dryers, washing machines, ovens, fireplaces, stoves, and other heat-producing devices utilize pressurized, combustible fuels for heating. However, such devices and certain components thereof have various limitations and disadvantages.

SUMMARY OF THE INVENTION

According to some embodiments a heating assembly can include any number of different components such as a selector valve, a reset switch, a pressure regulator, a control valve, a burner nozzle, a burner, a pilot, and/or an oxygen depletion sensor. In addition, a heating assembly can be a single fuel, dual fuel or multi-fuel heating system. For example, the heating assembly can be configured to be used with one or more of natural gas, liquid propane, well gas, city gas, and methane. The heating assembly can be used on any number of different devices, including heaters, boilers, dryers, washing machines, ovens, fireplaces, stoves, and grills.

A dual fuel heating assembly can be configured for use with either a first fuel or a second fuel different from the first. The heating assembly can comprise an inlet housing, a first orifice; a second orifice; and a selector switch (SS). The inlet housing can include first and second pressure regulators configured to regulate a flow of fuel within respective first and second predetermined pressure ranges. The inlet housing has a first housing outlet downstream of the first and second pressure regulators. Each of the first and second orifices are configured for the combustion of regulated fuel received from the first housing outlet. The inlet housing may also include a second housing outlet downstream of the first and second pressure regulators. A selector switch (SS) can comprise an SS inlet configured to receive a flow of regulated fuel; a first SS outlet fluidly coupled to the first orifice; a second SS outlet fluidly coupled to the second orifice; an SS valve member and a corresponding SS valve seat; and a diaphragm. The second housing outlet can be fluidly coupled to the diaphragm such that a portion of regulated fuel flow acts on a backside of the diaphragm and wherein a pressure of the regulated fuel acting on the backside of the diaphragm determines whether the SS valve member is engaged with or disengaged from the SS valve seat, thereby determining whether regulated fuel entering the SS inlet is directed to one or both of the first orifice and the second orifice.

According to some embodiments, the heating assembly may further comprise a burner and a pilot light comprising a first pilot orifice, a second pilot orifice, and a thermocouple; the burner and pilot light being in fluid communication with the first housing outlet. The SS can be configured to direct a flow of regulated fuel to one or both of the burner and the pilot. The first orifice and the second orifice can be part of a burner nozzle or a pilot light. Where the SS directs flow to the burner, the system may further comprise a pilot selector switch having first and second pilot selector valves mechanically coupled to the SS valve member, and configured such that the position of the first and second pilot selector valves determine whether regulated fuel flows to one or both of the first pilot orifice and the second pilot orifice. The SS can also direct flow to the pilot and a burner selector switch can be coupled to the SS.

According to some embodiments, the heating assembly may further comprise a gas valve configured to receive regulated fuel flow from either the first or the second pressure regulator through the first housing outlet and to controllably direct regulated fuel flow downstream to the SS inlet.

The heating assembly can further comprise a reset switch and the selector switch can be a locking valve configured such that if the pressure of the regulated fuel acting on the backside of the diaphragm exceeds a set threshold pressure, the SS valve member will engage with the SS valve seat and a second SS valve member will disengage from a second SS valve seat, and the locking valve will secure the first and second SS valve members in this position until the reset switch is actuated.

In some embodiments, the heating assembly can further comprise a fuel selector switch, the fuel selector switch positioned within the inlet housing and between an inlet of the inlet housing and the first pressure regulator, the fuel selector switch comprising a normally closed valve configured to open at a set pressure, the set pressure being above a pressure setting of the second pressure regulator. A manual override switch can also be included, wherein the manual override switch is positioned in a flow path between the inlet and the first housing outlet and configured to prevent fuel from flowing from the inlet to the first pressure regulator and then out of the first housing outlet.

A dual fuel heating assembly according to some embodiments can be for used with either a first fuel or a second fuel different from the first. The heating assembly can include an inlet housing, a gas valve, a pilot light, and a pilot selector switch (PSS). The inlet housing can comprise a first pressure regulator configured to regulate a flow of fuel within a first predetermined pressure range; a second pressure regulator configured to regulate a flow of fluid within a second predetermined pressure range different from the first predetermined pressure range; a first housing outlet downstream of the first and second pressure regulators; and a second housing outlet downstream of the first and second pressure regulators. The gas valve can be configured to receive regulated fuel flow from either the first or the second pressure regulator through the first housing outlet and to controllably direct regulated fuel flow downstream. The pilot light can comprise a first pilot orifice, a second pilot orifice, and at least one thermocouple. Each of the first and second pilot orifices can direct a flame at the at least one thermocouple through combustion of regulated fuel. The pilot selector switch (PSS) can include a PSS inlet configured to receive a flow of regulated fuel, a first PSS outlet fluidly coupled to the first pilot orifice, a second PSS outlet fluidly coupled to the second pilot orifice, first and second PSS valve members and corresponding first and second PSS valve seats, and a diaphragm. One of the first and second PSS valve members or the first and second PSS valve seats being connected to thereby move together so that when the first PSS valve member is engaged with the first PSS valve seat, the second PSS valve member is disengaged from the second PSS valve seat, the first PSS valve member positioned within a first flow path between the PSS inlet and the first PSS outlet and the second PSS valve seat positioned between the PSS inlet and the second PSS outlet. The second housing outlet can be fluidly coupled to the diaphragm such that a portion of regulated fuel flow acts on a backside of the diaphragm and wherein a pressure of the regulated fuel acting on the backside of the diaphragm determines whether the first PSS valve member is engaged with or disengaged from the first PSS valve seat.

A heating assembly can include a locking valve with a reset switch which can include certain pressure sensitive features. These features can be configured to change from a first position to a second position based on a pressure of a fuel flowing into the valve. The valve can be used with either a first fuel or a second fuel different from the first. The valve can become locked or be held in either the first or the second position. For example, a set fuel pressure can cause the valve to move to a closed position and the valve can become locked or held in that position. If the pressure decreases, the valve can remain in the locked position. Actuation of the reset switch can allow the valve to move to a new position, such as an open position.

BRIEF DESCRIPTION OF THE DRAWINGS

Various embodiments are depicted in the accompanying drawings for illustrative purposes, and should in no way be interpreted as limiting the scope of the inventions, in which like reference characters denote corresponding features consistently throughout similar embodiments.

FIG. 3A illustrates a dual fuel heating assembly.

FIG. 3B shows another dual fuel heating assembly. FIG. 3C illustrates an unregulated heating assembly.

DETAILED DESCRIPTION OF THE PREFERRED EMBODIMENT

Many varieties of heaters, boilers, dryers, washing machines, ovens, fireplaces, stoves, and other heat-producing devices utilize employ combustible fluid fuels, such as liquid propane and natural gas. The term "fluid," as used herein, is a broad term used in its ordinary sense, and includes materials or substances capable of fluid flow, such as, for example, one or more gases, one or more liquids, or any combination thereof. Fluid-fueled units, such as those listed above, generally are designed to operate with a single fluid fuel type at a specific pressure or within a range of pressures. For example, some fluid-fueled heaters that are configured to be installed on a wall or a floor operate with natural gas at a pressure in a range from about 3 inches of water column to about 6 inches of water column, while others are configured to operate with liquid propane at a pressure in a range from about 8 inches of water column to about 12 inches of water column. Similarly, some gas fireplaces and gas logs are configured to operate with natural gas at a first pressure, while others are configured to operate with liquid propane at a second pressure that is different from the first pressure. As used herein, the terms "first" and "second" are used for convenience, and do not connote a hierarchical relationship among the items so identified, unless otherwise indicated.

Certain advantageous embodiments disclosed herein reduce or eliminate various problems associated with devices having heating sources that operate with only a single type of fuel source. Furthermore, although certain of the embodiments described hereafter are presented in a particular context, the apparatus and devices disclosed and enabled herein can benefit a wide variety of other applications and appliances.

Figure 1:
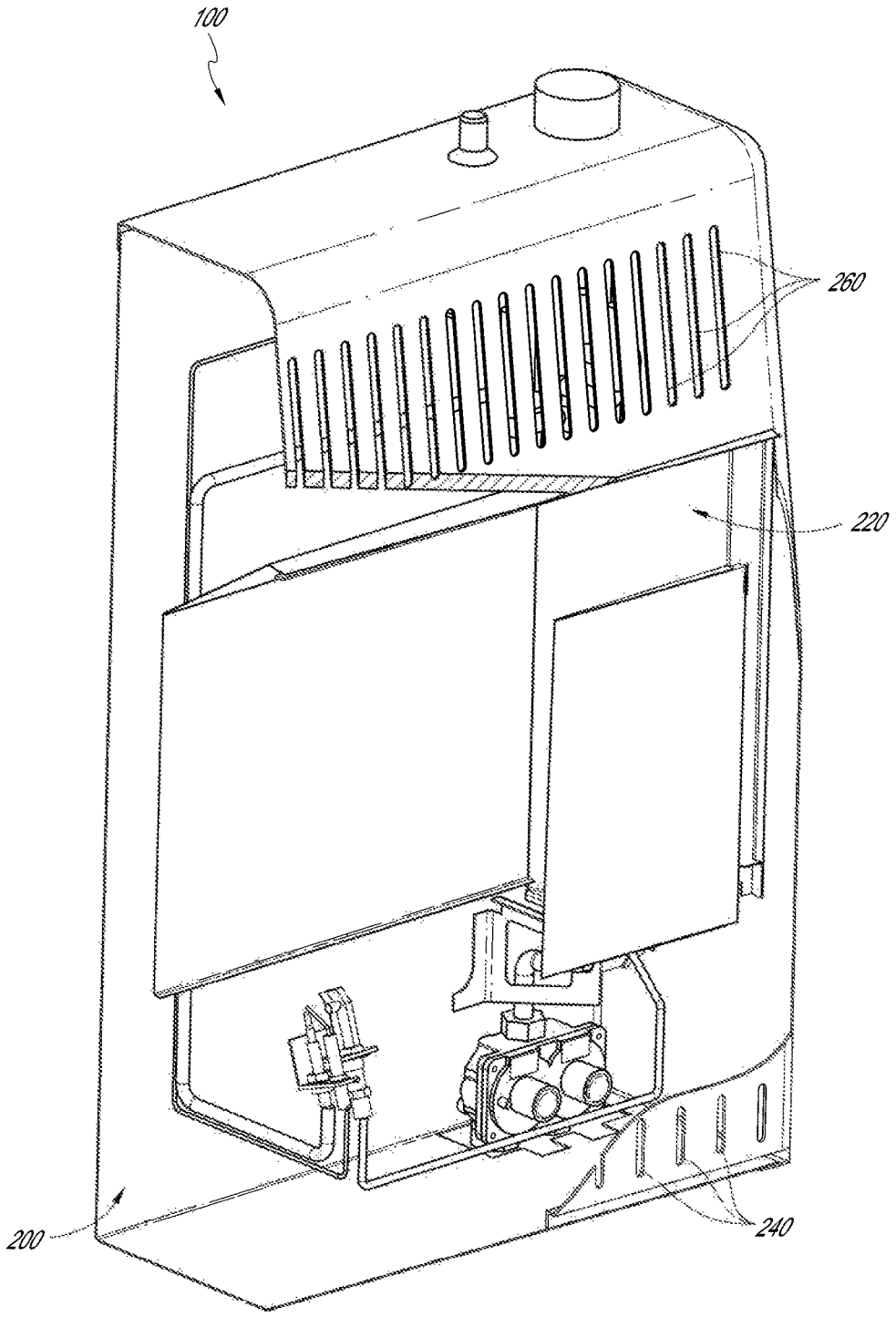
FIG. 1 is a perspective cutaway view of a portion of one embodiment of a heater configured to operate using either a first fuel source or a second fuel source.

FIG. 1 illustrates one embodiment of a heater 100. The heater 100 can be a vent-free infrared heater, a vent-free blue flame heater, or some other variety of heater, such as a direct vent heater. Some embodiments include boilers, stoves, dryers, fireplaces, gas logs, etc. Other configurations are also possible for the heater 100. In many embodiments, the heater 100 is configured to be mounted to a wall or a floor or to otherwise rest in a substantially static position. In other embodiments, the heater 100 is configured to move within a limited range. In still other embodiments, the heater 100 is portable.

The heater 100 can comprise a housing 200. The housing 200 can include metal or some other suitable material for providing structure to the heater 100 without melting or otherwise deforming in a heated environment. In the illustrated embodiment, the housing 200 comprises a window 220, one or more intake vents 240 and one or more outlet vents 260. Heated air and/or radiant energy can pass through the window 220. Air can flow into the heater 100 through the one or more intake vents 240 and heated air can flow out of the heater 100 through the outlet vents 260.

Within the housing 200, the heater 100, or other gas appliance, can include a heating assembly 10. A heating assembly 10 can include at least one or more of the components described herein.

Figure 2:
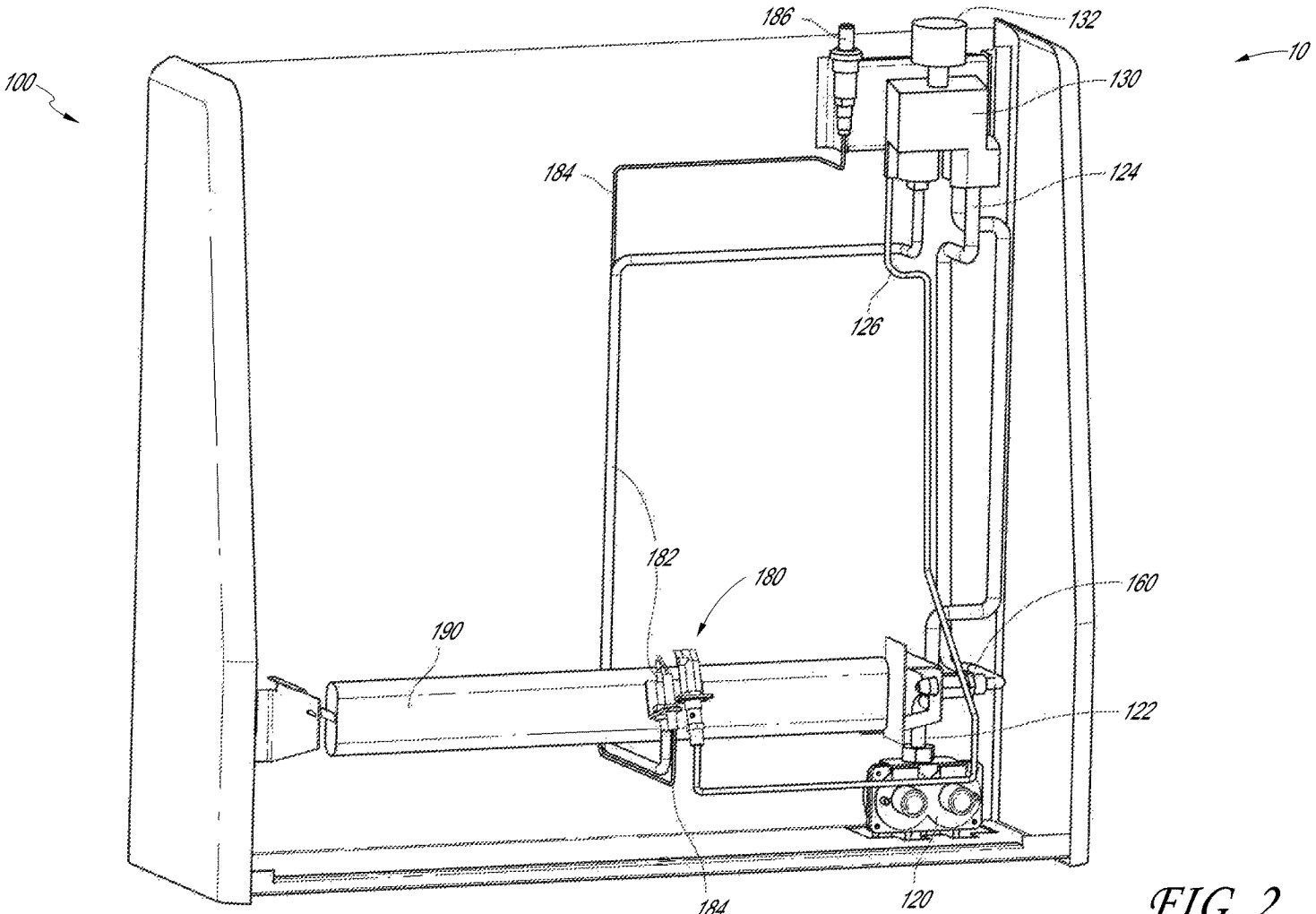
FIG. 2 is a perspective cutaway view of the heater of FIG. 1.

With reference to FIG. 2, in certain embodiments, the heater 100 includes a regulator 120. The regulator 120 can be coupled with an output line or intake line, conduit, or pipe 122. The intake pipe 122 can be coupled with a control valve 130, which, in some embodiments, includes a knob 132. As illustrated, the control valve 130 is coupled to a fuel supply pipe 124 and an oxygen depletion sensor (ODS) pipe 126. The fuel supply pipe 124 can be coupled with a nozzle 160. The ODS pipe 126 can be coupled with an oxygen depletion sensor (ODS) or pilot 180. In some embodiments, the ODS comprises a thermocouple 182, which can be coupled with the control valve 130, and an igniter line 184, which can be coupled with an igniter switch 186. Each of the pipes 122, 124, and 126 can define a fluid passageway or flow channel through which a fluid can move or flow.

In some embodiments, including the illustrated embodiment, the heater 100 comprises a burner 190. The ODS 180 can be mounted to the burner 190, as shown. The nozzle 160 can be positioned to discharge a fluid, which may be a gas, liquid, or combination thereof into the burner 190. For purposes of brevity, recitation of the term "gas or liquid" hereafter shall also include the possibility of a combination of a gas and a liquid.

Where the heater 100 is a dual fuel heater, either a first or a second fluid is introduced into the heater 100 through the regulator 120. Still referring to FIG. 2, the first or the second fluid proceeds from the regulator 120 through the intake pipe 122 to the control valve 130. The control valve 130 can permit a portion of the first or the second fluid to flow into the fuel supply pipe 124 and permit another portion of the first or the second fluid to flow into the ODS pipe 126. From the control valve 130, the first or the second fluid can proceed through the fuel supply pipe 124, through the nozzle 160 and is delivered to the burner 190. In addition, a portion of the first or the second fluid can proceed through the ODS pipe 126 to the ODS 180. Other configurations are also possible.

Figure 3A:
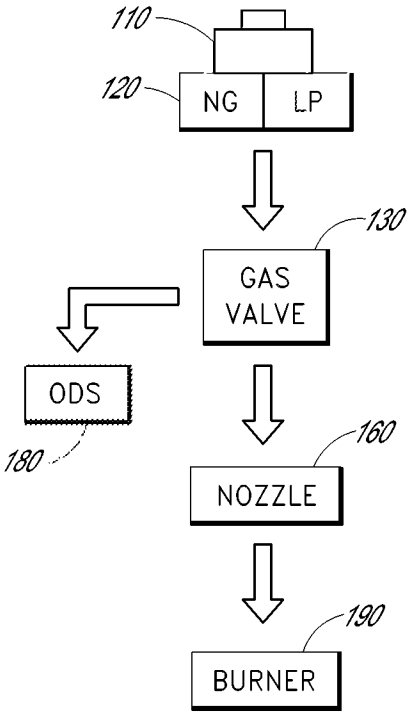
FIGS. 3A-C show some of the various possible combinations of components of a heating assembly 10.
Figure 3B:
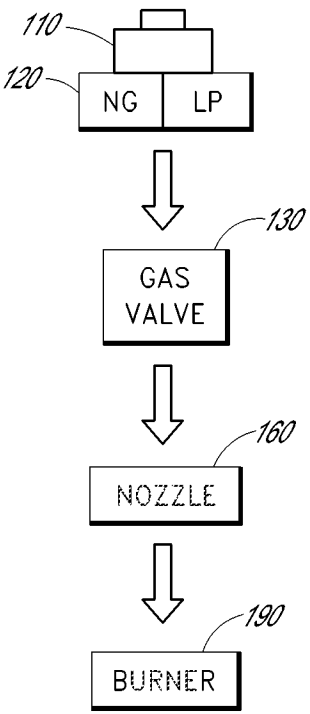
Figure 3C:
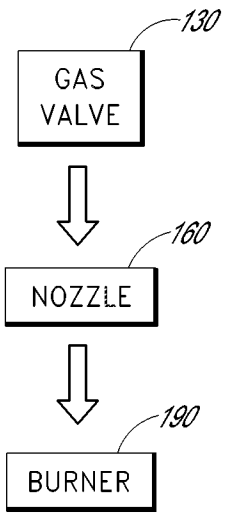

FIGS. 3A-C show some of the various possible combinations of components of a heating assembly 10. Such heating assemblies can be made to be used with single fuel, dual fuel or multi-fuel gas appliances. For example, the heating assembly 10 can be made so that the installer of the gas appliance can connect the assembly to one of two fuels, such as either a supply of natural gas (NG) or a supply of propane (LP). The assembly will desirably operate in a standard mode (with respect to efficiency and flame size and color) for either gas.

FIG. 3A illustrates a dual fuel system, such as a vent free heater. In some embodiments, a dual fuel heating assembly can include a fuel selector valve 110, a regulator 120, a control valve or gas valve 130, a nozzle 160, a burner 190 and an ODS 180. The arrows indicate the flow of fuel through the assembly. As can be seen in FIG. 3B, a dual fuel heating assembly, such as a regulated stove or grill, can have similar components to the heating assembly shown in FIG. 3A, but without the ODS. Still further heating assemblies, such as shown in FIG. 3C, may not have a fuel selector valve 110 or a regulator 120. This gas system may be unregulated and can be an unregulated stove or grill, among other appliances. The unregulated system can be single fuel, dual fuel or multi-fuel. In some embodiments, and as described in more detail below, one or more of the fuel selector valve, ODS and nozzle, in these and in other embodiments, can function in a pressure sensitive manner.

Figure 4A:
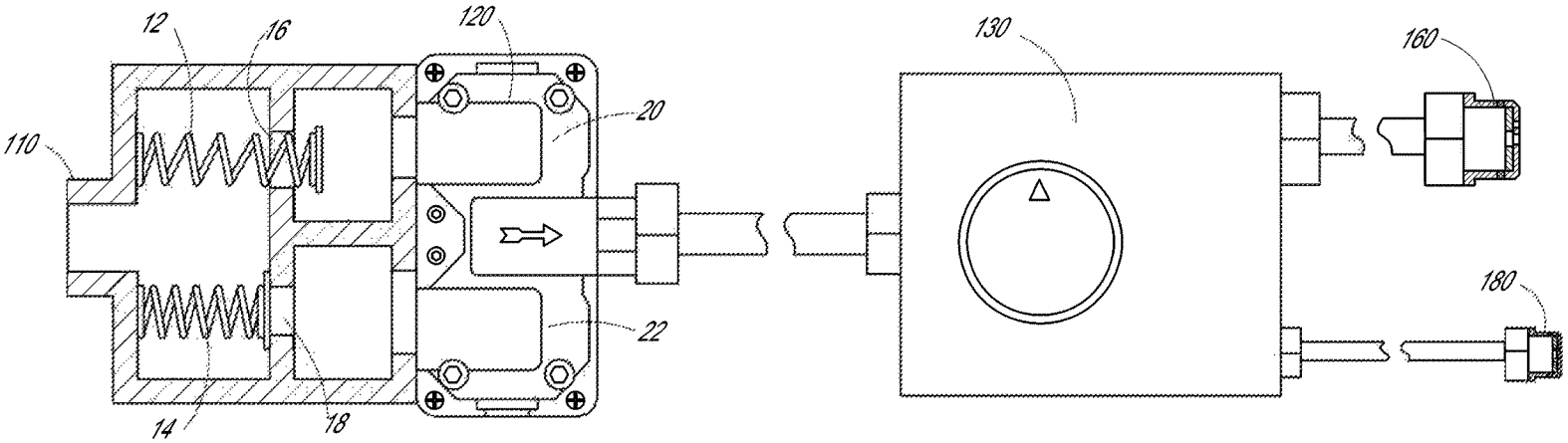
FIGS. 4A-B illustrate an embodiment of a heating assembly in schematic, showing a first configuration for liquid propane and a second configuration for natural gas.
Figure 4B:
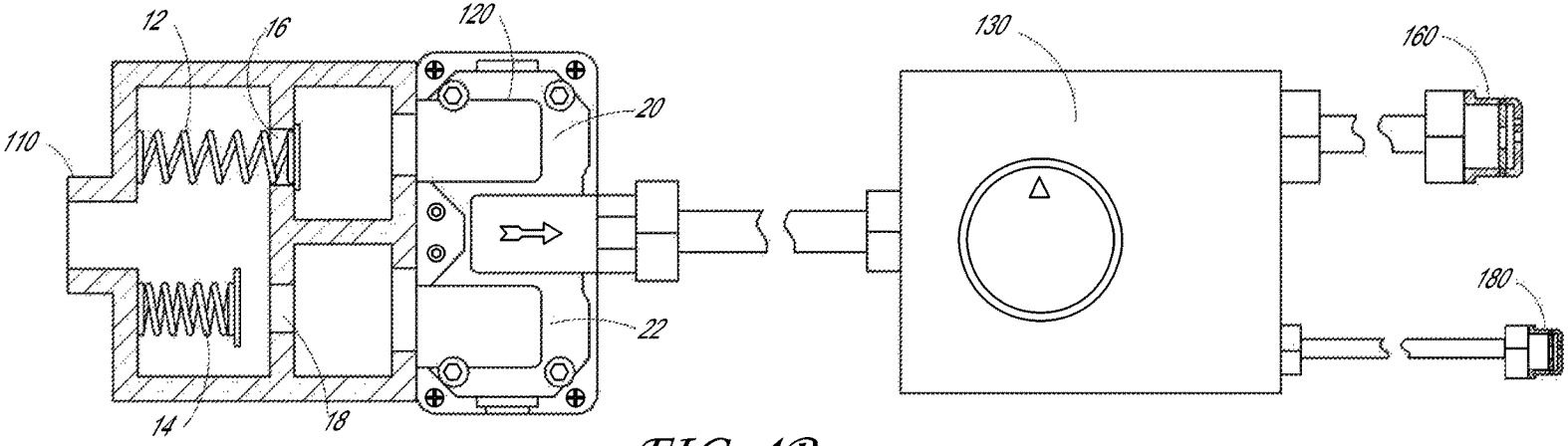

For example, turning to FIGS. 4A-B, a schematic representation of a heating assembly is shown in a first state for liquid propane (FIG. 4A) and in a second state for natural gas (FIG. 4B). Looking at the fuel selector valve 110, it can be seen that the pressure of the fluid flow through the valve 110 can cause the gate, valve or door 12, 14 to open or close, thus establishing or denying access to a channel 16, 18 and thereby to a pressure regulator 20, 22. The gate, valve or door 12, 14 can be biased to a particular position, such as being spring loaded to bias the gate 12 to the closed position and the gate 14 to the open position. In FIG. 4A, the gate 12 has been forced to open channel 16 and gate 14 has closed channel 18. This can provide access to a pressure regulator 20 configured to regulate liquid propane, for example. FIG. 4B shows the fuel selector valve 110 at a rest state where the pressure of the flow is not enough to change to state of the gates 12, 14 and channel 18 is open to provide access to pressure regulator 22, which can be configured to regulate natural gas, for example. As will be described hereinafter, the nozzle 160 and the ODS 180 can be configured to function in similar ways so that the pressure of the fluid flow can determine a path through each component. For example, the natural gas state (FIG. 4B) can allow more fluid flow than the liquid propane state (FIG. 4A).

Figure 5:
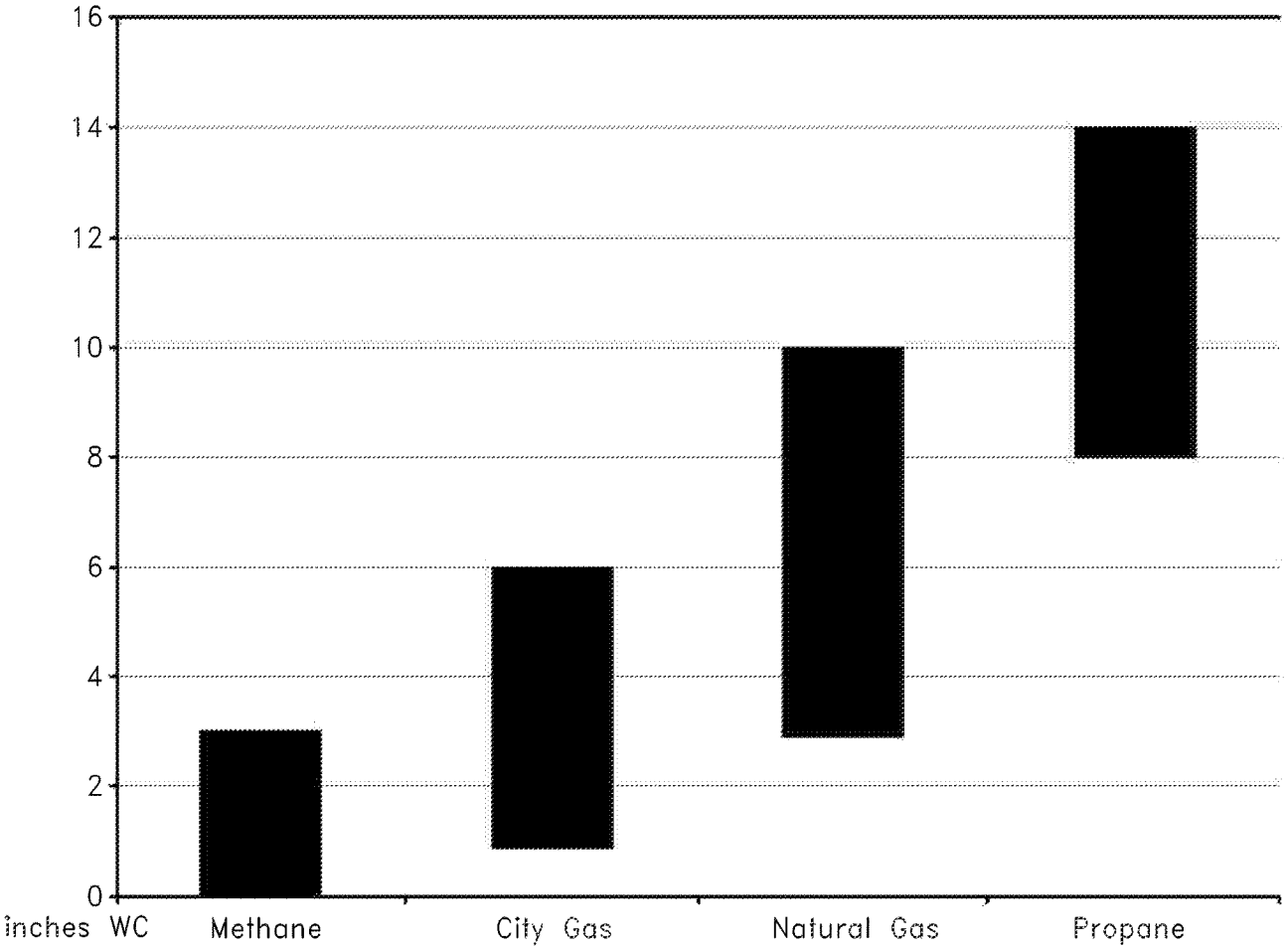
FIG. 5 is a chart showing typical gas pressures of different fuels.

Different fuels are generally run at different pressures. FIG. 5 shows four different fuels: methane, city gas, natural gas and liquid propane; and the typical pressure range of each fuel. The typical pressure range can mean the typical pressure range of the fuel as provided by a container, a gas main, a gas pipe, etc. and for consumer use, such as the gas provided to an appliance. Thus, natural gas may be provided to a home gas oven within the range of 3 to 10 inches of water column. The natural gas can be provided to the oven through piping connected to a gas main. As another example, propane may be provided to a barbeque grill from a propane tank with the range of 8 to 14 inches of water column. The delivery pressure of any fuel may be further regulated to provide a more certain pressure range or may be unregulated. For example, the barbeque grill may have a pressure regulator so that the fuel is delivered to the burner within the range of 10 to 12 inches of water column rather than within the range of 8 to 14 inches of water column.

As shown in the chart, city gas can be a combination of one or more different gases. As an example, city gas can be the gas typically provided to houses and apartments in China, and certain other countries. At times, and from certain sources, the combination of gases in city gas can be different at any one given instant as compared to the next.

Because each fuel has a typical range of pressures that it is delivered at, these ranges can advantageously be used in a heating assembly to make certain selections in a pressure sensitive manner. Further, certain embodiments may include one or more pressure regulators and the pressure of the fluid flow downstream of the pressure regulator can be generally known so as to also be able to make certain selections or additional selections in a pressure sensitive manner.

Figure 6:
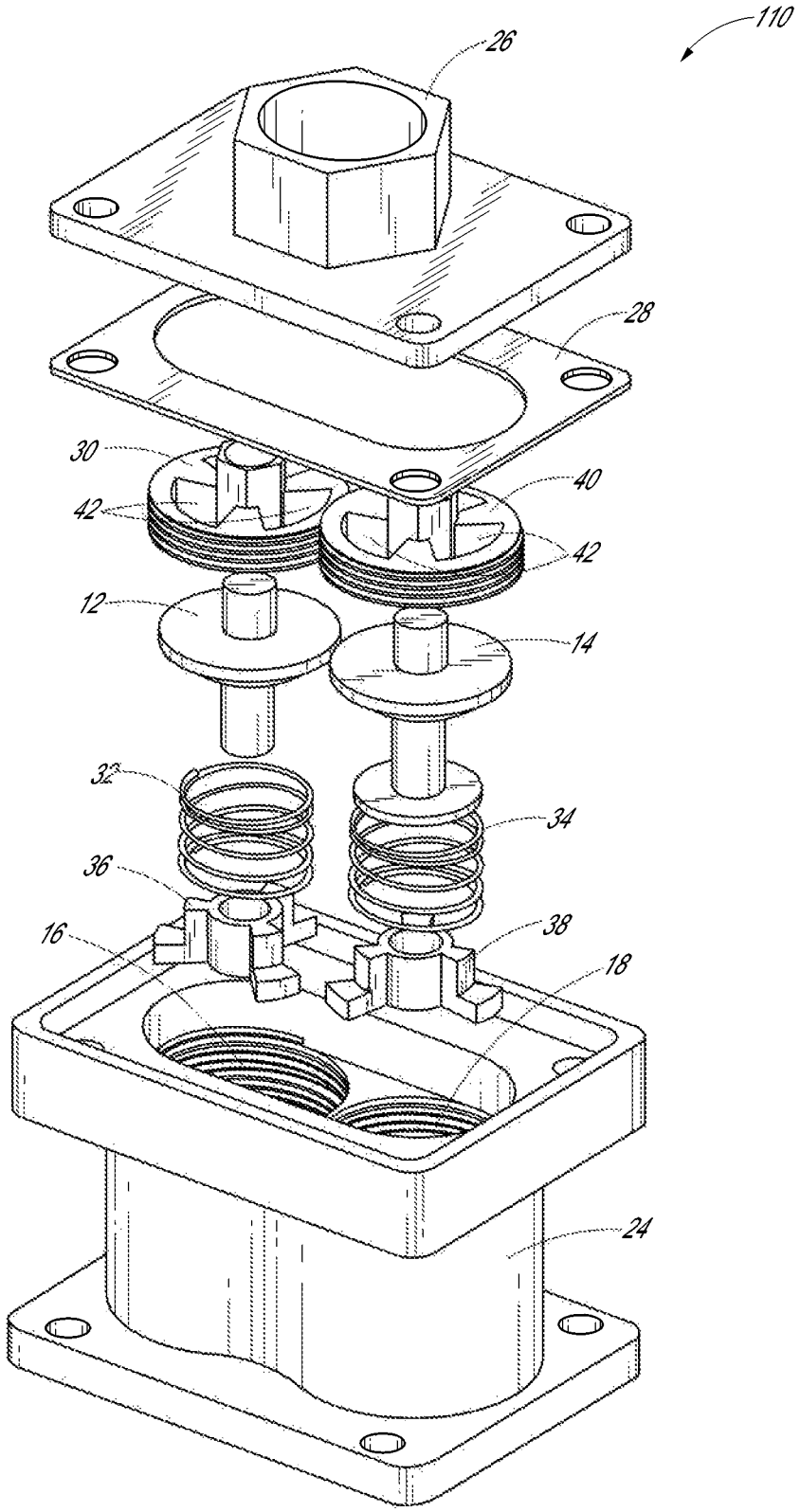
FIG. 6 is an exploded view of an embodiment of a fuel selector valve.

FIG. 6 illustrates components of an embodiment of a fuel selector valve 110. The fuel selector valve 110 can be for selecting between two different fuels. The fuel selector valve 110 can have a first mode configured to direct a flow of a first fuel (such as natural gas or NG) in a first path through the fuel selector valve and a second mode configured to direct a flow of a second fuel (such as liquid propane or LP) in a second path through the fuel selector valve. This can be done in many different ways such as the opening and/or closing of one or more valves, gates, or doors 12, 14 to establish various flow paths through the fuel selector valve 110. The opening and/or closing of one or more valves, gates, or doors can be performed in a pressure sensitive manner, as explained below.

As illustrated, the fuel selector valve 110 of FIGS. 6-8B includes a main housing 24, a fuel source connection 26, a gasket 28 and valves 12, 14. In some embodiments, the fuel selector valve 110 can interface with a fuel source as part of a heating assembly 10. A heating assembly 10 can connect to a fuel source at the fuel source connection 26. The fuel source connection 26 can be threaded or otherwise configured to securely connect to a fuel source. The main housing 24 can define channels 16, 18 and the valves 12, 14 can reside within the channels 16, 18 in the main housing 24. The housing 24 can be a single piece or a multi-piece housing.

Figure 8A:
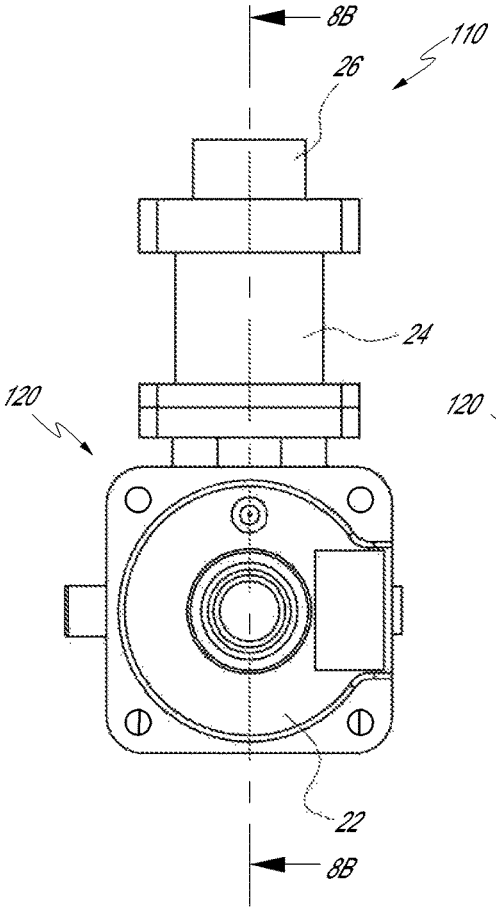
FIG. 8A is a side view of an embodiment of a fuel selector valve and pressure regulator.
Figure 8B:
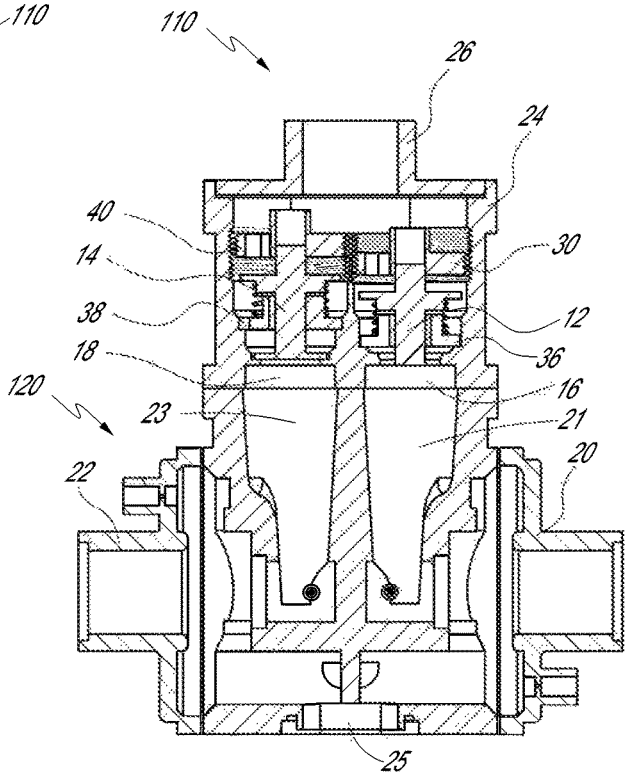
FIG. 8B is a cross-section of the fuel selector valve and pressure regulator of FIG. 8A.

In the various embodiments, there can be one or more valves, gates, or doors 12, 14 that can function in different ways, as well as one or more channels 16, 18 within the housing 24. The gates, doors or valves 12, 14 can work in many different ways to open or close and to thereby establish or deny access to a channel 16, 18. The channels 16, 18 can direct fluid flow to an appropriate flow passage, such as to the appropriate pressure regulator 20, 22, if pressure regulators are included in the heating assembly (FIGS. 8A-B). For example, channel 16 can direct flow to a first inlet 23 on a regulator 120 that connects to pressure regulator 22 and channel 18 can direct flow to a second inlet 21 that connects to pressure regulator 20. Both pressure regulators 20, 22 can direct flow to the outlet 25. Though a regulator 120 is shown that combines the two pressure regulators 20, 22 into one housing other configurations are also possible.

The shown fuel selector valve 110 of FIGS. 6-8B further includes, biasing members 32, 34, front portions 30, 40 and rear portions 36, 38. Biasing members 32, 34 can be metal springs, elastic, foam or other features used to bias the valves 12, 14 to a particular position, such as being spring loaded to bias both valves 12, 14 to the closed position. Further, the fuel selector valve 110 can be set such that each valve 12, 14 will open and/or close at different pressures acting on the valve. In this way, the fuel selector valve 110 can use fluid pressure to select a flow pathway through the valve. In some embodiments, this can be a function of the spring force of each individual spring, as well as the interaction of the spring with the valve. In some embodiments, the position of the spring and the valve can be adjusted to further calibrate the pressure required to open the valve 12, 14.

For example, the front portions 30, 40 can be threadedly received into the channels 16, 18. This can allow a user to adjust the position of the front portions 30, 40 within the channels and thereby adjust the compression on the spring, as can best be seen in FIG. 7A. In this illustrated embodiment, the springs 32, 34 are located between the valve 12, 14 and the respective rear portion 36, 38. The spring biases the valve to the closed position where it contacts the front portion 30, 40. Each front portion 30, 40 has holes 42 passing therethrough that are blocked by the valve when the valve is in contact with the front portion. Thus, the adjustment of the position of the front portion with respect to the valve can affect the amount of pressure required to move the valve away from the front portion to open the valve. In some embodiments, the front portions 30, 40 can be adjustable from outside the housing 24. This can allow for the valve 110 to be calibrated without having to disassemble the housing 24. In other embodiments, such as that shown, the front portions 30, 40 can be preset, such as at a factory, and are not accessible from outside the housing 24. This can prevent undesired modification or tampering with the valve 110. Other methods and systems of calibration can also be used.

Figure 7A:
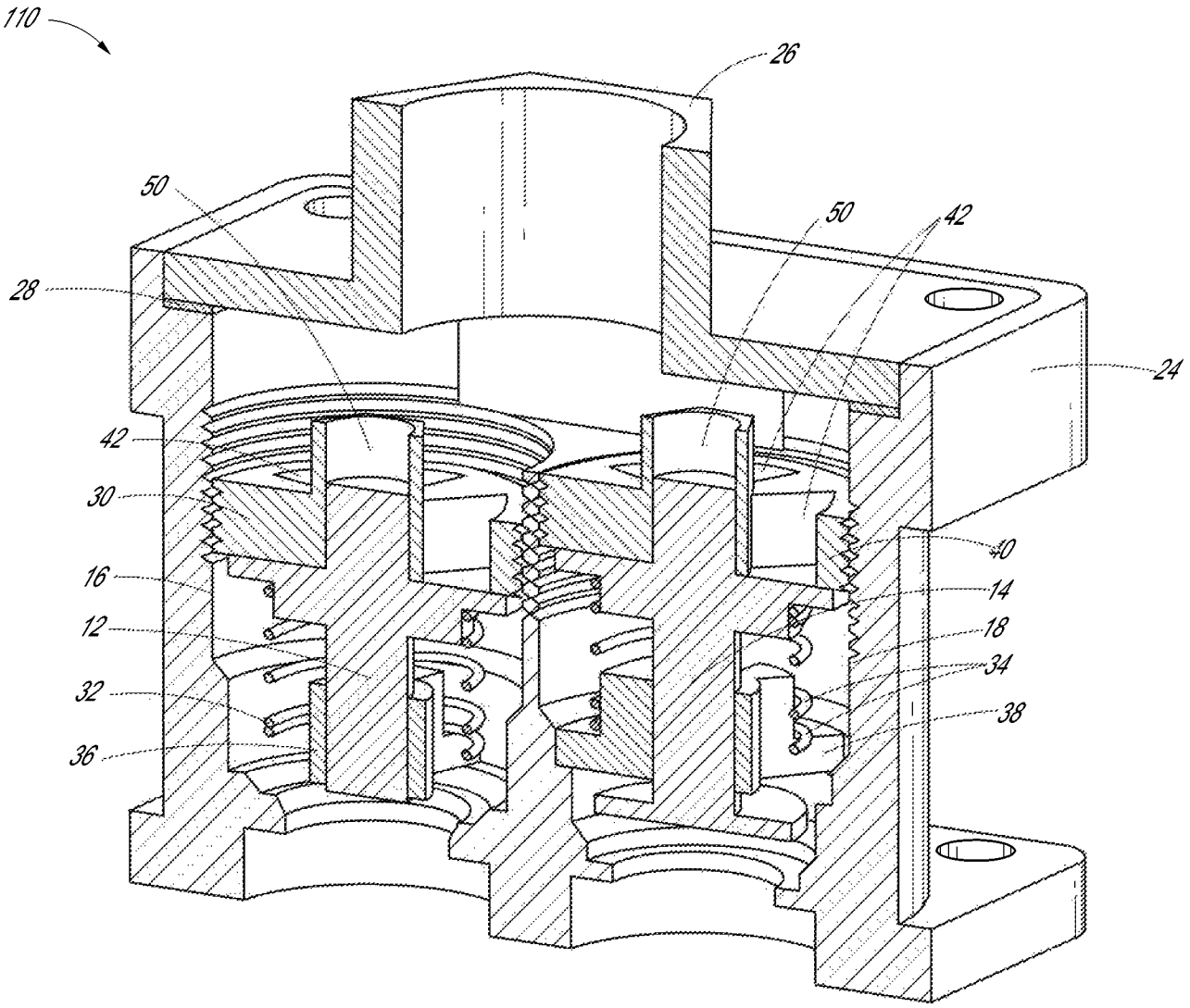
FIGS. 7A-C are cross-sectional views of the fuel selector valve of FIG. 6 in first, second and third positions, respectively.
Figure 7B:
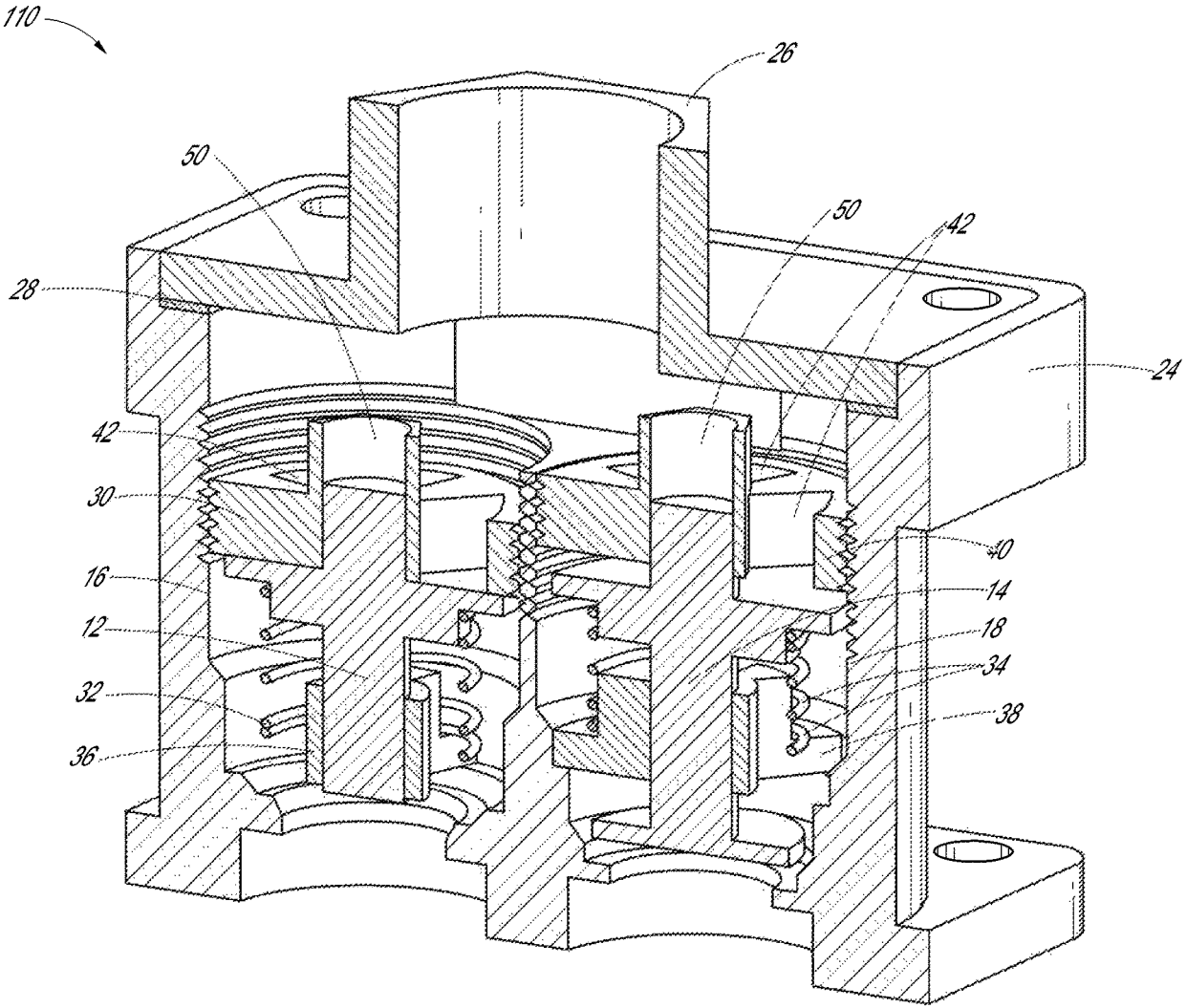
Figure 7C:
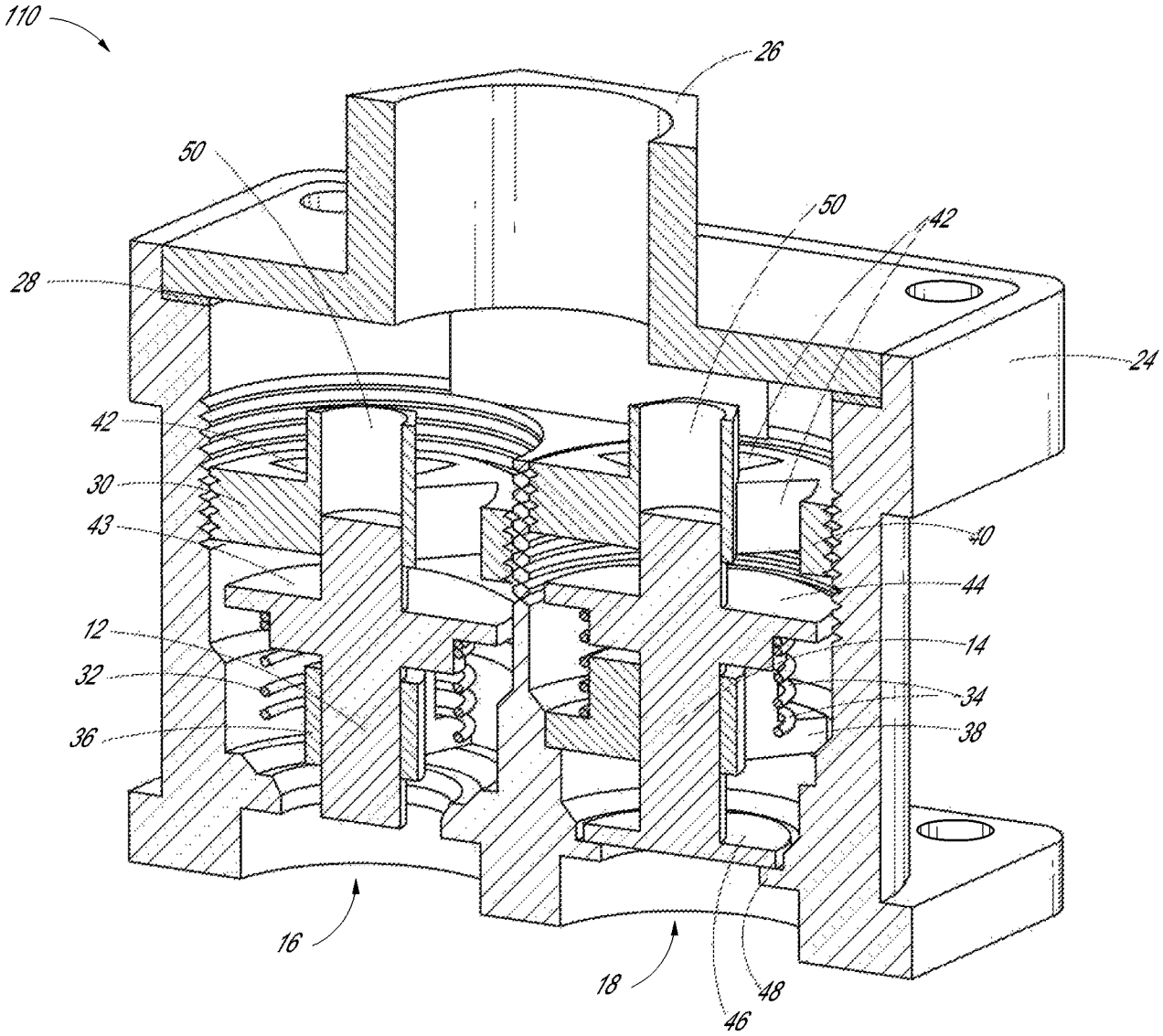

Fluid pressure acting on the valve 12, 14, such as through the holes 42 can force the valve to open. FIG. 7B shows a first open position where a threshold amount of pressure has been achieved to cause the valve 14 to open, while valve 12 still remains closed. FIG. 7C illustrates a second open position where a second threshold pressure has been reached to close valve 14 at the rear end of the valve, and a third threshold pressure has been achieved to open valve 12. In some embodiments, the second and third threshold pressures can be the same. In some embodiments, the third threshold pressure can be greater than the second and the first threshold pressures. Of course, this may change for different configurations, such as where the springs interact and bias the valves in different ways and to different positions.

In some embodiments, the fuel selector valve 110 can be used in a dual fuel appliance, such as an appliance configured to use with NG or LP. In this situation, the first threshold pressure to open valve 14 may be set to be between about 3 to 8 inches of water column, including all values and sub-ranges therebetween. In some embodiments, the first threshold pressure is about: 3, 4, 5, 6, 7 or 8 inches of water column. The second threshold pressure to close valve 14 may be set to be between about 5 to 10 inches of water column, including all values and sub-ranges therebetween. The third threshold pressure to open valve 12 can be set to be between about 8 to 14 inches of water column, including all values and sub-ranges therebetween. In some embodiments, the third threshold pressure is about: 8, 9, 10, 11, 12, 13 or 14 inches of water column. In a preferred embodiment, the first and second threshold pressures are between about 3 to 8 inches of water column, where the second is greater than the first and the third threshold pressure is between about 10 to 12 inches of water column. In this embodiment, as in most dual fuel embodiments, the ranges do not overlap.

Returning now to calibration, for certain springs; as the spring is compressed it can require a greater force to further compress the spring. Thus, moving the front portion 30, 40 away from the respective valve 12, 14 would decrease the force required to initially compress the spring, such as to move the valve 14 from a closed position (FIG. 7A) to an open position (FIG. 7B). The reverse would also be true, moving the front portion closer to the valve would increase the force required to initially compress the spring.

In some embodiments, a spring can be used in the fuel selection valve that has a linear spring force in the desired range of movement, compression or extension. The spring force for a particular use of a particular spring can be based on many different factors such as material, size, range of required movement, etc.

Turning now to FIG. 7C, the valves 12, 14 will now be discussed in more detail. Each valve 12, 14 can form one of more valve seats to prevent fluid flow from passing the valve or to redirect fluid flow in a particular manner. For example, valve 12 has a forward ledge portion 43 and valve 14 has a forward ledge portion 44 and a rearward ledge portion 46, all of which are used to seat the valve 12, 14 against another surface and close the valve. As shown, the forward ledge portions 43, 44 seat with the front portions 30, 40 and the rearward ledge portion 46 seats with a ledge 48 within the outer housing 24. Other configurations are also possible, such as a valve with a portion that seats in multiple locations within the outer housing, for example to have a first closed position, on open position and a second closed position. A front face and a back face of a ledge on a valve could be used to seat the valve, as one further example.

The front 30, 40 and rear 36, 38 portions can be used to position the valve 12, 14 within the housing 24. For example, the rear portions 36, 38 can surround a central region of the valve and the valve can move or slide within the rear portion. Further the spring 32, 34 can be between the valve and the rear portion. The front portions 30, 40 can have one or more holes 42 passing therethrough. Fluid pressure acting on the valve 12, 14, such as through the holes 42 can force the valve to open. In some embodiments, the front portions 30, 40 can have a channel 50. The channel 50 can be used to guide movement of the valve. In addition, the channel can direct fluid flow at the valve to open the valve. Because there are no exits in the channel, fluid flow does not pass around the valve but rather remains constantly acting against the valve as long as there is flow through the fuel selector valve 110.

In other embodiments, the front and/or rear portions can be permanently or integrally attached to the housing 24. Some embodiments do not have either or both of a front or rear portion.

It will be understood that any of the pressure sensitive valves described herein, whether as part of a fuel selector valve, nozzle, or other component of the heating assembly, can function in one of many different ways, where the valve is controlled by the pressure of the fluid flowing through the valve. For example, many of the embodiments shown herein comprise helical or coil springs. Other types of springs, or devices can also be used in the pressure sensitive valve. Further, the pressure sensitive valves can operate in a single stage or a dual stage manner. Many valves described herein both open and close the valve under the desired circumstances (dual stage), i.e. open at one pressure for a particular fuel and close at another pressure for a different fuel. Single stage valves may also be used in many of these applications. Single stage valves may only open or close the valve, or change the flow path through the valve in response to the flow of fluid. Thus for example, the fuel selector valve 110 shown in FIG. 7A has a single stage valve 12 and a dual stage valve 14. The dual stage valve 14 can be modified so that the valve is open in the initial condition and then closes at a set pressure, instead of being closed, opening at a set pressure and then closing at a set pressure. In some instances, it is easier and less expensive to utilize and calibrate a single stage valve as compared to a dual stage valve. In some embodiments, the valve can include an offset. The offset can offset the valve away from the front or rear portion, so that the valve cannot be closed at either the front or back end respectively. Offsets can also be used to ensure the valve does not move beyond a certain position. For example, an offset can be used that allows the valve to close, but that prevents the valve from advancing farther, such as to prevent damage to the valve housing or housing wall.

As discussed previously, the fuel selector valve 110 can be used to determine a particular fluid flow path for a fluid at a certain pressure or in a pressure range. Some embodiments of heating assembly can include first and second pressure regulators 20, 22. The fuel selector valve 110 can advantageously be used to direct fluid flow to the appropriate pressure regulator without separate adjustment or action by a user.

In some embodiments, the first and second pressure regulators 20, 22 are separate and in some embodiments, they are connected in a regulator unit 120, as shown in FIGS. 4A-B & 8A-B. A regulator unit 120 including first and second pressure regulators 20, 22 can advantageously have a two-in, one-out fluid flow configuration, though other fluid flow configurations are also possible including one-in or two-out. In addition, the combined fuel selector valve 110 and regulator unit 120 can have a one-in, one-out fluid flow configuration.

The pressure regulators 20, 22 can function in a similar manner to those discussed in U.S. application Ser. No. 11/443,484, filed May 30, 2006, now U.S. Pat. No. 7,607, 426, incorporated herein by reference and made a part of this specification; with particular reference to the discussion on pressure regulators at columns 3-9 and FIGS. 3-7 of the issued patent.

The first and second pressure regulators 20, 22 can comprise spring-loaded valves or valve assemblies. The pressure settings can be set by tensioning of a screw that allows for flow control of the fuel at a predetermined pressure or pressure range and selectively maintains an orifice open so that the fuel can flow through spring-loaded valve or valve assembly of the pressure regulator. If the pressure exceeds a threshold pressure, a plunger seat can be pushed towards a seal ring to seal off the orifice, thereby closing the pressure regulator.

The pressure selected depends at least in part on the particular fuel used, and may desirably provide for safe and efficient fuel combustion and reduce, mitigate, or minimize undesirable emissions and pollution. In some embodiments, the first pressure regulator 20 can be set to provide a pressure in the range from about 3 to 6 inches of water column, including all values and sub-ranges therebetween. In some embodiments, the threshold or flow-terminating pressure is about: 3, 4, 5, or 6 inches of water column. In some embodiments, the second pressure regulator 22 can be configured to provide a second pressure in the range from about 8 to 12 inches of water column, including all values and sub-ranges therebetween. In some embodiments, the second threshold or flow-terminating pressure is about: 8, 9, 10, 11 or 12 inches of water column.

The pressure regulators 20, 22 can be pre-set at the manufacturing site, factory, or retailer to operate with selected fuel sources. In many embodiments, the regulator 120 includes one or more caps to prevent consumers from altering the pressure settings selected by the manufacturer. Optionally, the heater 100 and/or the regulator unit 120 can be configured to allow an installation technician and/or user or customer to adjust the heater 100 and/or the regulator unit 120 to selectively regulate the heater unit for a particular fuel source.

Returning now to FIGS. 3A-4B, fuel selector valves 110 and regulators 120 have been discussed above. As can be seen in the Figures, a heating source may or may not include a fuel selector valve 110 and/or a regulator 120 (FIG. 3C). In some embodiments, a fuel source can be connected to a control valve 130, or the fuel selector valve and/or regulator can direct fuel to a control valve 130. The control valve or gas valve 130 can comprise at least one of a manual valve, a thermostat valve, an AC solenoid, a DC solenoid and a flame adjustment motor. The control valve 130 can direct fuel to the burner 190 through a nozzle 160. The control valve 130 may also direct fuel to an ODS 180.

The control valve 130 can control the amount of fuel flowing through the control valve to various parts of the heating assembly. The control valve 130 can manually and/or automatically control when and how much fuel is flowing. For example, in some embodiments, the control valve can divide the flow into two or more flows or branches. The different flows or branches can be for different purposes, such as for an oxygen depletion sensor (ODS) 180 and for a burner 190. In some embodiments, the control valve 130 can output and control an amount of fuel for the ODS 180 and an amount of fuel for the burner 190.

Figure 9A:
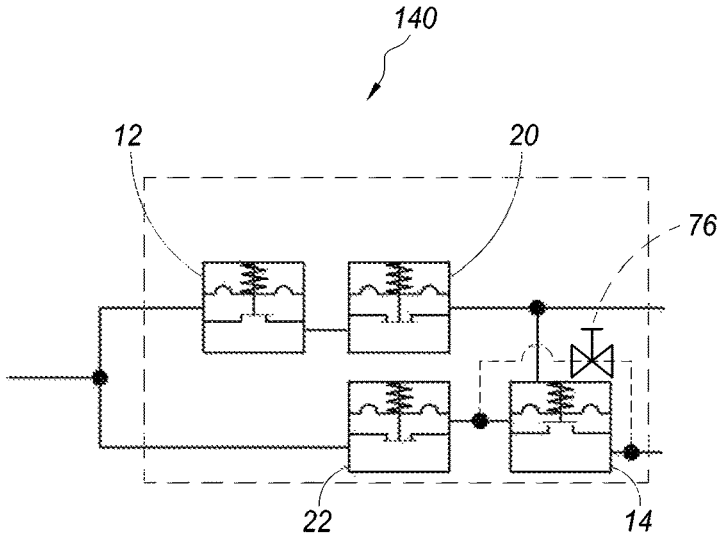
FIGS. 9A-C are schematic representations of a selector switch.
Figure 9B:
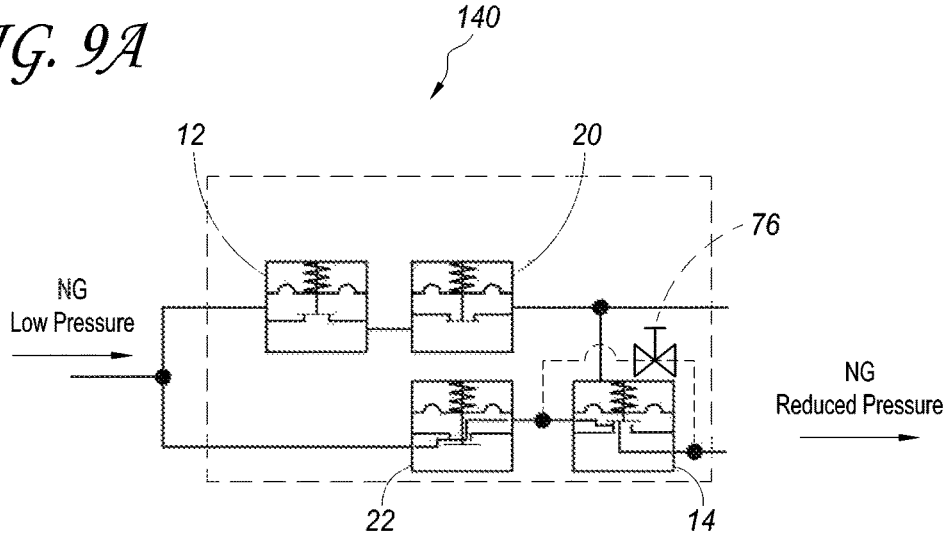
Figure 9C:
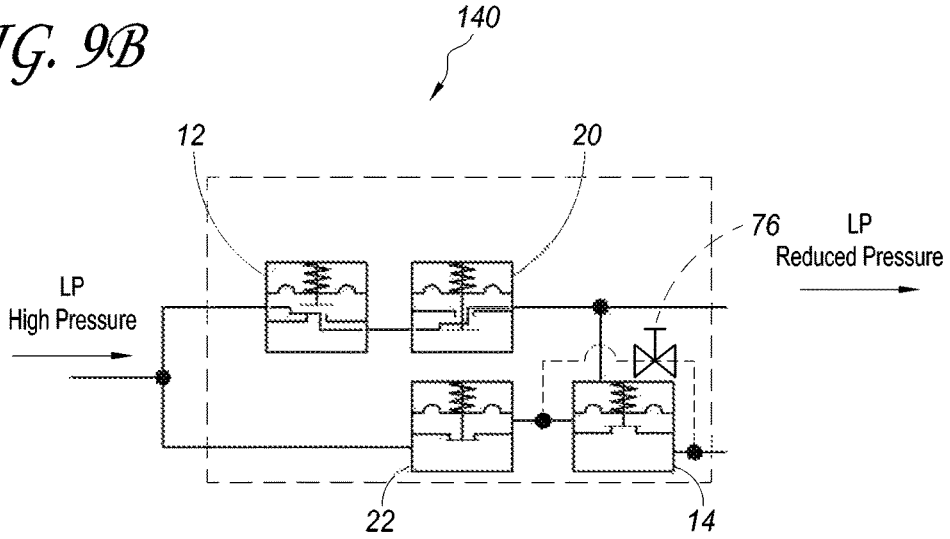

Looking now to FIGS. 9A-C, a selector switch 140 is shown that can combine aspects of the fuel selector valve 110 and the regulator 120. In some respects, the selector switch 140 is similar to the fuel selector valve 110 and regulator 120 shown in FIGS. 4A-B. In particular, they both have two pressure regulators 20, 22, a normally closed valve 12 and a normally open valve 14. As can be seen the position of the two valves in FIGS. 9A-C have a different relationship than those shown in FIGS. 4A-B. In addition, certain additional features are shown, which will be described below.

FIG. 9A illustrates the at rest position of the selector switch 140 without any fluid flowing to the selector switch 140. The selector switch 140 can have one, two, or more inlets that can lead to two primary paths through the selector switch 140 to one, two, or more outlets. In the first primary flow path between the inlet(s) and outlet(s), a normally closed valve 12 is positioned in front of or upstream from the first pressure regulator 20. In the illustrated embodiment, the first pressure regulator 20 is configured for LP. In the second primary flow path between the inlet(s) and outlet(s), a second pressure regulator 22 is positioned in front of or upstream from a normally open valve 14.

Advantageously, the selector switch 140 housing can have a single inlet and one or two outlets. The inlet can be a fuel hook-up designed to connect to a fuel source. In some embodiments, a threaded connection can be made between the fuel source and the fuel hook-up. Having a single fuel hook-up connection simplifies the connection process and allows the user or installer to rely on the pressure sensitive features of the selector switch 140 to select the correct flow path through the selector switch 140, including through the pressure regulators 20, 22. In some embodiments, there may be additional inlets/outlets and additional flow paths through the selector switch 140, but preferably there is only one fuel hook-up designed to connect to a fuel source (such as a propane tank, gas line, etc.) separate from the heating assembly.

As mentioned, the illustrated selector switch 140 has two primary paths through it. Flow through the first primary flow path, the normally closed valve 12 and the first pressure regulator 20 is shown in FIG. 9C. In the illustrated embodiment, the first pressure regulator 20 is configured for LP. Flow through the second primary flow path, a second pressure regulator 22, and the normally open valve 14 is shown in FIG. 9B. In both cases, the flow is indicated by arrows.

Each of the valves 12, 14 can include a diaphragm, a spring and a valve member. The valves can be similar to the pressure regulators, though they can be on/off valves rather than regulating valves. This can be achieved by directing the flow through the valve from the diaphragm side and out by the valve member away from the diaphragm, rather than in through the valve member and towards the diaphragm as in the pressure regulator.

Looking at FIG. 9C, it can also be seen that there is a fluid connection between the first primary flow path and a backside of a diaphragm of the normally open valve 14. This feedback path provides that fluid from the first primary flow path can flow into the normally open valve 14 on the backside of the diaphragm. If the pressure from this flow exceeds the spring pressure and the pressure on the front side of the diaphragm, the normally open valve 14 will close. Thus, any flow through first primary flow path may control whether the second primary flow path is open or closed. As shown the feedback path is connected to the first primary flow path after, downstream from the pressure regulator 20, though it can connect at other positions.

Flow through the selector switch 140 will now be described with reference to a first fuel in FIG. 9B and a second fuel in FIG. 9C. A first fuel, such as NG, can enter the inlet and begin to flow down the two primary flow paths. The first fuel can be delivered at a lower pressure which can be insufficient to open the normally closed valve 12. Thus, the first fuel would not proceed further along the first primary flow path. Along the second primary flow path, the first fuel can flow to the second pressure regulator 22 and then to the normally open valve 14. The first fuel can proceed through the normally open valve 14 and out the selector switch 140.

If a second fuel, such as LP, is delivered at a higher pressure the fuel may flow through the selector switch 140 as shown in FIG. 9C. The second fuel can enter the inlet and begin to flow down the two primary flow paths. The second fuel can be delivered at a pressure sufficient to open the normally closed valve 12. Thus, the second fuel can proceed along the first primary flow path to the first pressure regulator 20. The second fuel can be regulated and leave the selector switch 140 through an outlet.

Along the second primary flow path, the second fuel can flow to the second pressure regulator 22 and then to the normally open valve 14. As mentioned, fluid from the first pressure regulator 20 can flow into the normally open valve 14 on a backside of the diaphragm. This can close the normally open valve 14 to prevent fluid from leaving the second primary flow path.

As will be understood, the selector switch 140 can be set to allow a first fuel at a first pressure to flow through the second primary flow path and a second fuel at the second higher pressure to flow through the first primary flow path. The selector switch 140 can also prevent the wrong fuel from flowing through the selector switch 140 through the wrong path. For example, LP may flow through the NG pressure regulator, but this flow will not leave the selector switch 140, while the properly regulated flow of LP will flow through the LP pressure regulator and will be able to leave the selector switch 140.

In some embodiments the normally closed switch 12 can be set to open at a set pressure such as 11 inches of water column. In addition, the pressure regulators can be set to regulate the fuel within a range of 11-14 inches of water column and 4-9 inches of water column. In addition, the normally open switch 14 can be set to close at a set pressure such as 4-5 inches of water column. It will be understood that other ranges and set pressures can be used such as those previously described herein with respect to the selector valve 110.

It can also be seen that the selector switch 140 can include a by-pass valve 76. In some embodiments, the by-pass valve 76 can be a screw positioned to prevent or allow flow through a bypass channel. As illustrated, the bypass is a channel in the housing that can be used to allow gas or other fluid to flow between certain areas of the housing. For example, the housing of the selector switch 140 can have a bypass channel machined in the housing and a screw hole can be machined to pass through the bypass channel. The position or presence of the screw can determine whether or not flow can pass through the bypass channel. In other embodiments, a valve can be positioned with bypass channel. The valve can be a manual valve, such as a rotary valve, or an electronic valve.

In some, generally limited instances, it may be desirable to bypass the functioning of the normally open switch 14. For example, a certified installer may realize that the fluid pressure at the particular location is greater than (or less than) the typical range which may be causing the normally open switch 14 to close when this is not desirable or correct. Thus, for example, NG can be provided to a heater and connected to the selector switch 140, but because the fluid pressure is outside of an expected range, it may be flowing through the LP regulator and closing flow from the NG regulator. Opening the illustrated bypass with the by-pass valve 76 can allow the heater to function normally, even though the fluid pressure is outside of the normal range.

Thus, the installer can open the valve 76, such as by backing off the screw 76 positioned within the bypass channel. Once the valve is open, fluid can flow between the inlet and the outlet of the selector switch 140 along the second primary flow path. Where the selector switch 140 has two outlets, one leading to components configured for LP and the other to NG components, running NG through both outlets will not generally create any issues or problems. At the same time, running LP through the NG components may provide a flame that is undesirably large and a fire hazard. Thus, the by-pass valve is preferably on the NG side, but there is not a corresponding by-pass valve on the LP side.

Figure 10:
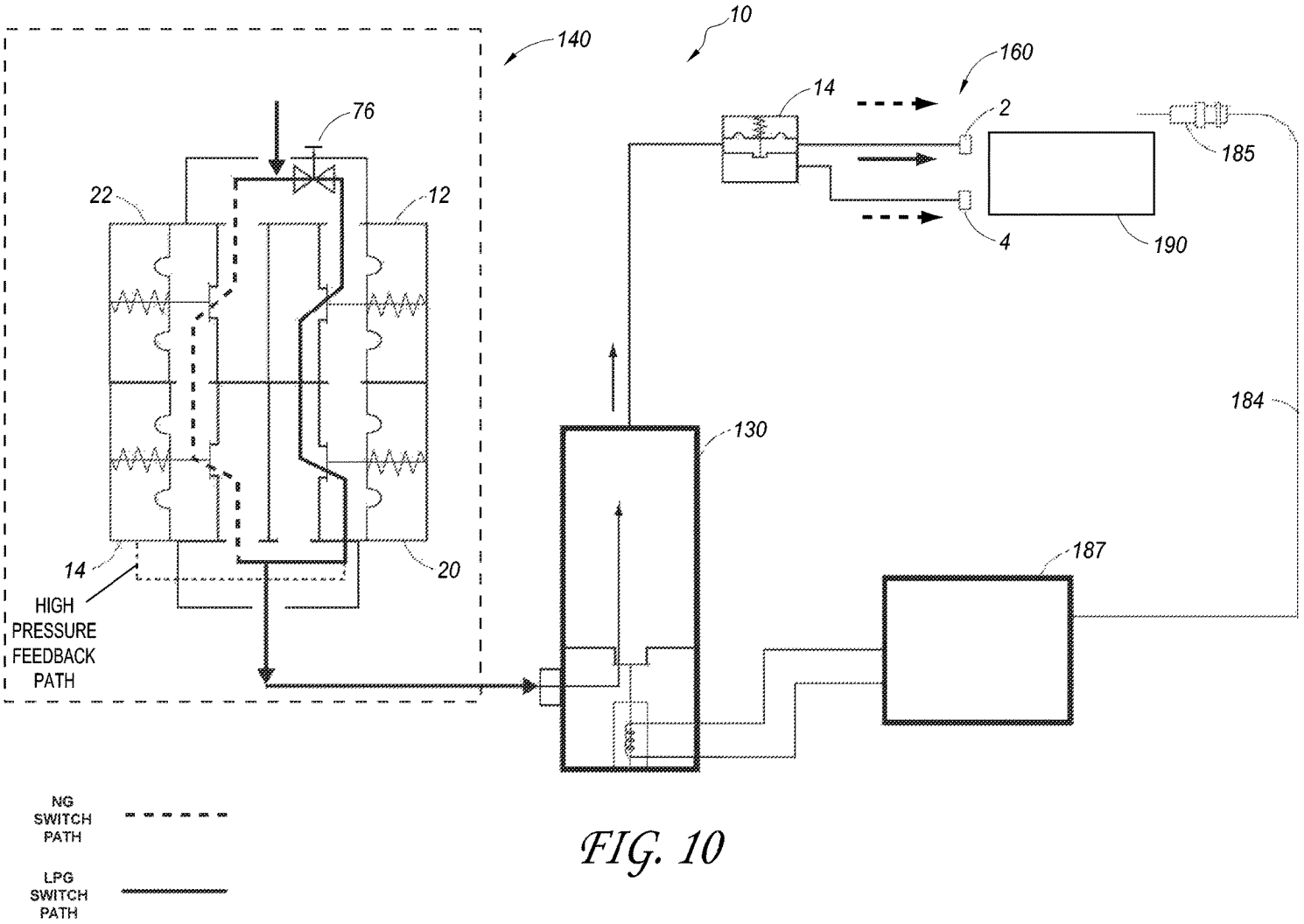
FIG. 10 shows a selector switch as part of a direct ignition heater system.
Figure 11:
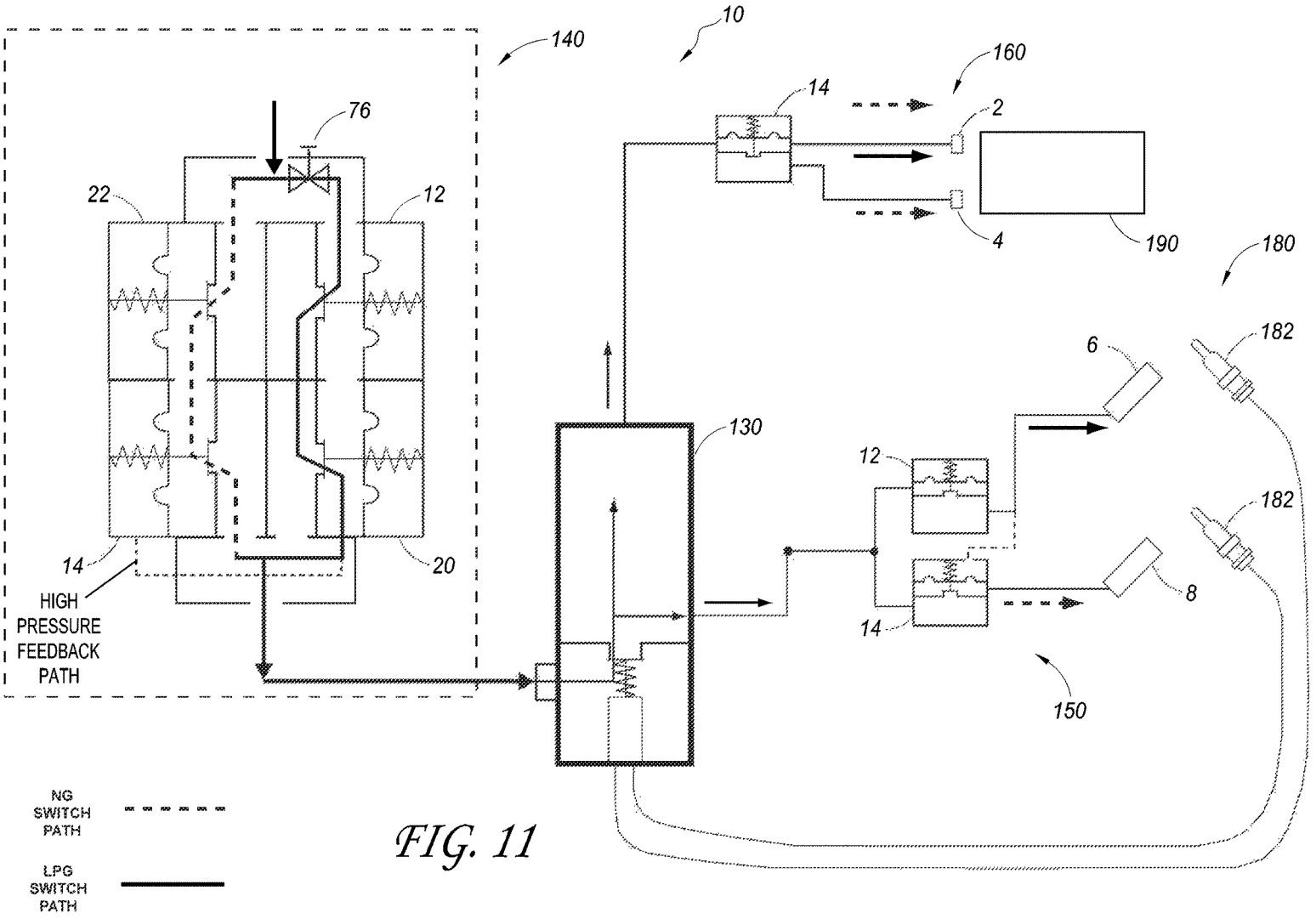
FIG. 11 shows a selector switch as part of a piloted heater system.

As shown in FIGS. 10 and 11, the by-pass valve 76 can also be a cutoff valve to cutoff flow to the second primary flow path. In this way, instead of bypassing the normally open valve 14, the cutoff valve 76 prevents flow along the second primary flow path. This can prevent high pressure fluid acting on the backside of the diaphragm from closing the valve 14. Though the cutoff valve 76 is shown positioned at the start of the second primary flow path, it will be understood that it can be positioned anywhere along the second primary flow path as long as it can prevent flow from the second primary flow path from interacting with the normally open valve 14. In some embodiments, the cutoff valve 76 can also be positioned to prevent flow from the second primary flow path from exiting the selector switch 140.

With continued reference to FIGS. 10 and 11, the selector switch 140 is shown as part of two different heating assemblies 10. The selector switch 140 in both figures has a single inlet and a single outlet, though other configurations can also be used. The first heating assembly 10 of FIG. 10 is a direct ignition system. Direct ignition systems are commonly used as the heating assemblies of appliances, furnaces and boilers. Direct ignition systems use a spark from an electrode 185 to directly ignite the fuel/air mixture and/or flammable gas at the burner 190 in the heating assembly 10. The electrode 185 can also sense the presence of the flame. This sensing is accomplished by generating a small amount of current in the electrode from the heat of the flame which passes to ground. The ignition control 187 detects changes in current caused by the presence or absence of a flame. The same electrode 185 that lights the flame and acts as the flame sensor is known as a local sense system. Remote sense, which can also be used in the heating assembly 10, has a separate sensing rod positioned at an optimal location in the combustion chamber relative to the burner 190.

As illustrated, current from the electrode and the ignition control 187 is also passed to the control valve 130. When a flame is present to generate current the control valve 130 can be maintained in an open position to allow fuel to flow to the burner nozzle 160 and to the burner 190.

The burner nozzle 160 can be a pressure sensitive nozzle with at least two nozzle orifices 2, 4. In a LP/NG system, one nozzle orifice can be an LP orifice 2 and the other can be an NG orifice 4. One nozzle orifice 2, such as the LP orifice, can always be open to flow while the second nozzle orifice 4 can be opened and closed dependent on the pressure of the fuel flow. For example, a normally open valve 14 can be utilized to provide the flow path control to the various orifices 2, 4. Thus, when a low pressure fluid flows through the valve, the fluid can flow to both orifices 2, 4. But, a higher pressure fluid can close the valve, so that the flow only goes to one orifice 2. It will be noted the all of the valves shown in this embodiment are schematic and may not represent the actual position of the valve member with respect to the valve seat of the actual valve. In other embodiments, the valve can open one flow path, while closing the other. Thus, the fluid pressure can determine whether the fluid flows to one of a first orifice 2 or a second orifice 4, while flow is prevented to the other.

Figure 42B:
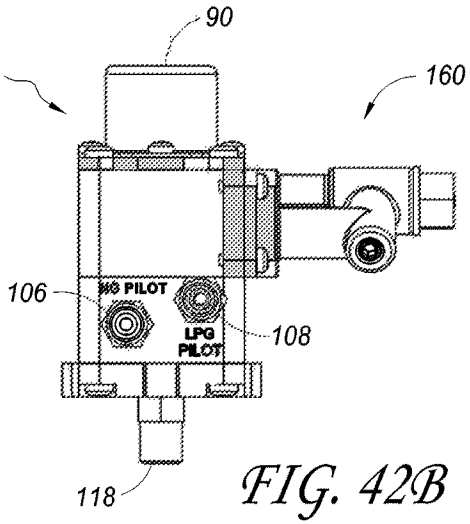
FIGS. 42 A-C show front and side views of the locking selector valve of FIGS. 41A-B.
Figure 42A:
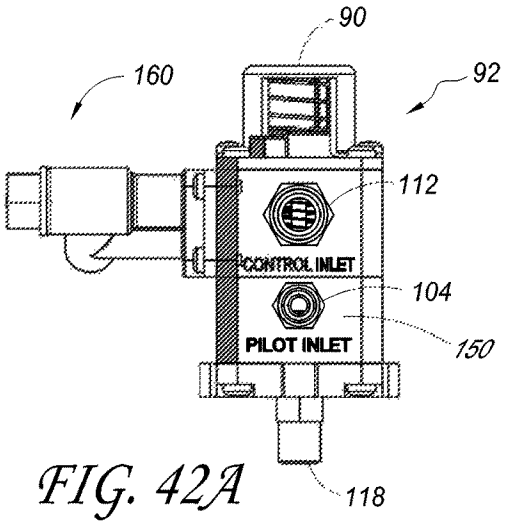

The pressure sensitive nozzle 160 can function in a similar manner to those discussed in U.S. application Ser. No. 13/310,664, filed Dec. 2, 2011, published as U.S. 2012/0255536 on Oct. 11, 2012, incorporated herein by reference and made a part of this specification; with particular reference to the discussion on pressure sensitive nozzles at paragraphs [0188]-[0193] and FIGS. 42A-B, as well as [0130]-[0135], [0144]-[0156], [0178]-[0187] and FIGS. 23-24B, 28A-34B, 39A-40C of the published application.

FIG. 11 illustrates a heater assembly 10 with a pilot light or oxygen depletion sensor (ODS) 180. The heater assembly 10 of FIG. 11 can utilize the selector switch 140 of FIGS. 9A-C and can also have the pressure sensitive nozzle 160 and burner assembly 190 as described with respect to FIG. 10. The control valve 130 can selectively provide fuel to both the burner and to the pilot 180. As can be seen, the pilot 180 can include different pilot nozzles for the different fuels, such as an LP pilot nozzle 6 and an NG pilot nozzle 8. Each pilot nozzle 6, 8 can have a dedicated thermocouple 182, or they can be directed to a single thermocouple. In addition, in some embodiments, the nozzles can direct heat to different parts of the same thermocouple.

The pilot 180 can also utilize a pilot selector switch 150 which can function similar to the selector switch 140 previously described without the pressure regulators. The pilot selector switch 150 can have one, two, or more inlets that can lead to two primary paths through the pilot selector switch 150 to one, two, or more outlets. As illustrated, in the first primary flow path between the inlet(s) and outlet(s), a normally closed valve 12 is positioned in front of or upstream from the first pilot nozzle 6. In the second primary flow path between the inlet(s) and outlet(s), a normally open valve 14 is positioned in front of or upstream from the second pilot nozzle 8.

It can also be seen that fluid from the normally closed valve 12 can flow into the normally open valve 14 on a backside of the diaphragm. If the pressure created from this flow exceeds the spring pressure and the pressure on the front side of the diaphragm, the normally open valve 14 will close. Each of the valves 12, 14 can include a diaphragm, a spring and a valve member.

A first fuel, such as NG, can enter the inlet of the pilot selector switch 150 and begin to flow down the two primary flow paths. The first fuel can be delivered at a lower pressure which can be insufficient to open the normally closed valve 12. Thus, the first fuel would not proceed further along the first primary flow path. Along the second primary flow path, the first fuel can flow to the normally open valve 14 and then proceed through to the second pilot nozzle.

If a second fuel, such as LP, is delivered at a higher pressure the fuel may flow through the inlet and begin to flow down the two primary flow paths. The second fuel can be delivered at a pressure sufficient to open the normally closed valve 12. Thus, the second fuel could proceed along the first primary flow path to the first pilot nozzle. The second fuel can also flow to the backside of the diaphragm of the normally open valve 14. This can close the normally open valve 14 to prevent fluid from leaving the second primary flow path.

As will be understood, the pilot selector switch 150 can be set to allow a first fuel at a first pressure to flow through the second primary flow path and a second fuel at the second higher pressure to flow through the first primary flow path. The pilot selector switch 150 can also prevent the wrong fuel from flowing through the pilot selector switch 150 along the wrong path to the wrong pilot nozzle.

Figure 13:
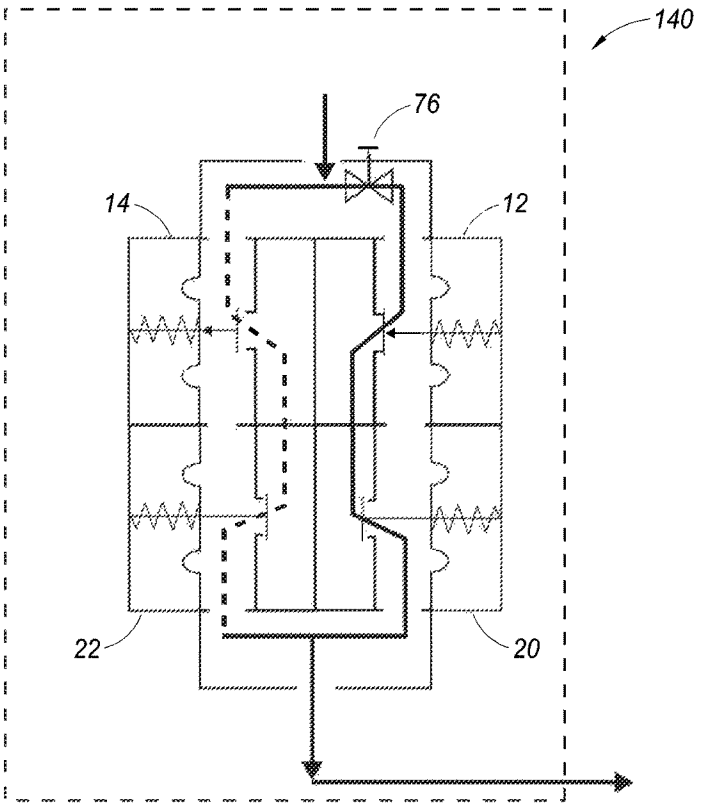
FIGS. 12 and 13 are additional embodiments of selector switches.
Figure 12:
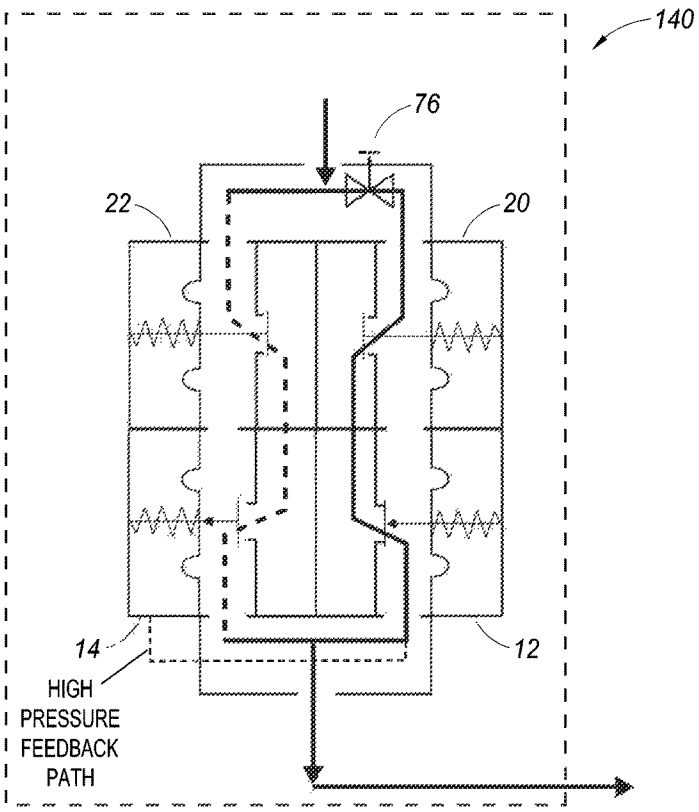

Moving now to FIGS. 12 and 13, two additional embodiments of selector switch 140 are shown. In these selector switches, the position of the normally open and/or closed valve is switched with one or more of the pressure regulators. Numerical reference to components is the same as previously described. Where such references occur, it is to be understood that the components are the same or substantially similar to previously-described components. It should be understood that the illustrated selector switches include each of the features designated by the numbers used herein. However, as emphasized repeatedly herein, these features need not be present in all embodiments. In addition, it will be understood that either of these selector switches can be used with the direct ignition heater system of FIG. 10, or the piloted heater system of FIG. 11, among other types of heater systems.

In FIG. 12, both of the pressure regulators 20, 22 are upstream from the valves 12, 14. This embodiment is similar to the pilot selector switch of FIG. 11 in that the fuel flow is regulated first, before passing through the normally closed and/or normally open valves. It will also be understood that though the selector switch 140 is illustrated as being within a single housing with the pressure regulators and valves directly connected, this is not necessarily required. For example, the pressure regulators could be joined with a single inlet and outlet, or could be completely separate. The normally closed and normally open valves could also be joined with a single inlet and outlet, or could be completely separate. It can also be seen that a high pressure feedback path connects one of the flow paths with the backside of a diaphragm of the normally open valve 14 as has been discussed with respect to previous embodiments. A cutoff valve 76 can also be present.

Looking to FIG. 13, an embodiment of selector switch 140 is shown that is similar to the combined selector valve and pressure regulator shown in FIGS. 4A-B with both valves 12, 14 upstream from the pressure regulators 20, 22. It can also be seen that the selector switch 140 of FIG. 13 does not include a feedback path to bleed fluid on the backside of the diaphragm of the normally open valve 14. Rather, the normally open valve 14 can close with high pressure fluid flow. In other embodiments, the selector switch 140 does include the high pressure feedback path discussed previously connecting the first primary flow path with the backside of a diaphragm of the normally open valve 14. A cutoff valve 76 can also be present.

A heating assembly can include a fuel selector switch which can include certain pressure sensitive features. These features can be configured to change from a first position to a second position based on a pressure of a fuel flowing into the feature. The fuel selector switch can be for use with either a first fuel or a second fuel different from the first. The fuel selector switch can comprise a first primary flow path and a second primary flow path. A first valve and a first pressure regulator can be positioned in the first primary flow path. A second valve and a second pressure regulator can be positioned in the second primary flow path.

In some embodiments, a fuel selector switch can be used with either a first fuel or a second fuel different from the first. The fuel selector switch can include a housing having an inlet, an outlet, a first primary flow path between the inlet and the outlet and a second primary flow path between the inlet and the outlet. The fuel selector switch may further include a first valve and a first pressure regulator positioned in the first primary flow path, and a second valve and a second pressure regulator positioned in the second primary flow path. The first valve can comprise a first valve body and a first valve seat, the first valve configured to have a closed position wherein the first valve body is engaged with the first valve seat and an open position wherein the first valve body is disengaged from the first valve seat. The first pressure regulator can be configured to regulate the flow of fluid within a first predetermined pressure range. The second valve can comprise a diaphragm, a second valve body, and a second valve seat; the second valve can be configured to have a closed position wherein the second valve body is engaged with the second valve seat and an open position wherein the second valve body is disengaged from the second valve seat. The second pressure regulator can be configured to regulate the flow of fluid within a second predetermined pressure range, different from the first. The fuel selector switch can be configured such that a fluid pressure of the fuel following through the fuel selector switch determines whether the first primary flow path and the second primary path is open or closed as predetermined threshold fluid pressures determine the position of the respective first and second valves.

In certain further embodiments, the housing further comprises a feedback flow path between the second primary flow path and a backside of the diaphragm of the second valve to influence a position of the diaphragm and second valve body of the second valve. The second valve may be downstream of the second pressure regulator in the second primary flow path. The first valve may be downstream of the first pressure regulator in the first flow path. Additionally, the first valve may be a normally closed valve and the second valve may be a normally open valve. The fuel selector switch can further include a by-pass valve and a by-pass channel connected to the second primary flow path such that when the by-pass valve is in an open position it allows fluid flow to bypass the second valve.

According to some embodiments, a fuel selector switch for use with either a first fuel or a second fuel different from the first can comprise a housing, a first valve, a second valve, a first pressure regulator and a second pressure regulator. The housing can have an inlet, an outlet, a first primary flow path between the inlet and the outlet and a second primary flow path between the inlet and the outlet. The first valve can be positioned in the first primary flow path. The first valve can comprise a first valve body and a first valve seat, the first valve configured to have a normally closed position wherein the first valve body is engaged with the first valve seat and an open position wherein the first valve body is disengaged from the first valve seat. The first pressure regulator can be positioned in the first primary flow path downstream from the first valve, the first pressure regulator configured to regulate the flow of fluid within a first predetermined pressure range. The second valve can be positioned in the second primary flow path, the second valve comprising a diaphragm, a second valve body, a second valve seat, the second valve configured to have a closed position wherein the second valve body is engaged with the second valve seat and a normally open position wherein the second valve body is disengaged from the second valve seat. The second pressure regulator can be positioned in the second primary flow path upstream from the second valve, the second pressure regulator configured to regulate the flow of fluid within a second predetermined pressure range, different from the first. The housing can further comprise a feedback flow path between the second primary flow path and a backside of the diaphragm of the second valve to influence a position of the diaphragm and second valve body of the second valve. The fuel selector switch can be configured such that a fluid pressure of the fuel following through the fuel selector switch determines whether the first primary flow path and the second primary path is open or closed as predetermined threshold fluid pressures determine the position of the respective first and second valves.

Now turning to FIGS. 14-18, another embodiment of a piloted heater system 10 with a selector switch 140 is shown. The selector switch 140 is the same as shown and described with respect to FIGS. 9A-C. The piloted heater system is also similar to that shown in FIG. 11. One of the primary differences is that the fuel connects directly to the control valve 130 and is later regulated, rather than directing the fuel to a pressure regulator first, before directing it to the control valve 130 as was described in various prior embodiments. An additional difference is that the selector switch 140 is used as a pilot selector switch 150 as will be described in more detail below.

Numerical reference to components is the same as previously described. Where such references occur, it is to be understood that the components are the same or substantially similar to previously-described components. It should be understood that the illustrated piloted heater system 10 includes each of the features designated by the numbers used herein. However, as emphasized repeatedly herein, these features need not be present in all embodiments.

Figure 14:
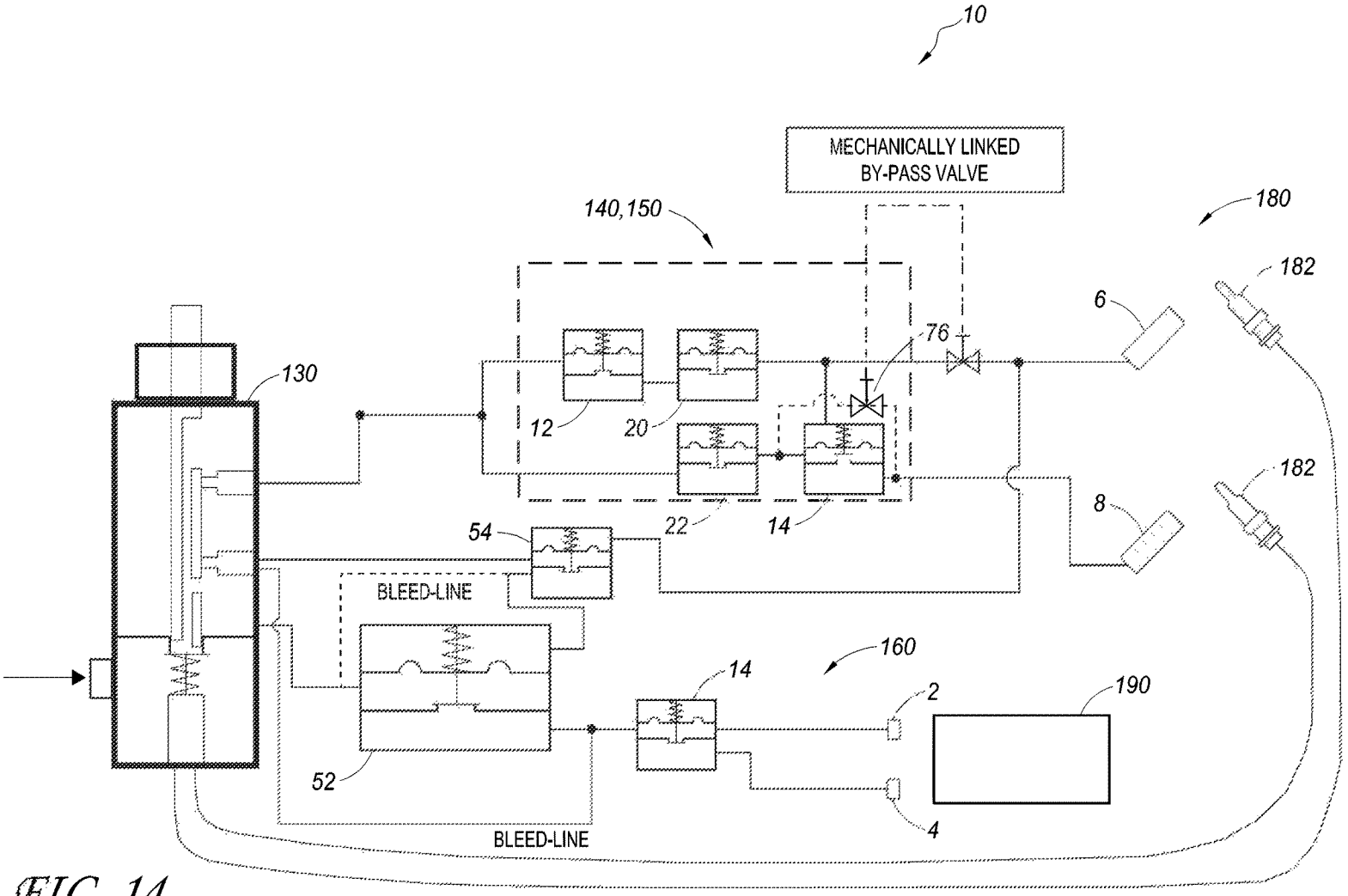
FIG. 14 shows another embodiment of a piloted heater system with the selector switch of FIG. 9A.

Comparing FIGS. 11 and 14 more closely, it will be seen that the same pressure sensitive nozzle 160 is shown leading to the burner. In addition, a pilot or oxygen depletion sensor 180 with two thermocouples is also shown similar to FIG. 11. But it will also be seen that pressure regulators 52, 54, 20, 22 are positioned between both the control valve 130 and the burner, and the control valve 130 and the pilot 180 which is different from FIG. 11. As a result, a different control valve 130 is also utilized. The functioning of the piloted heater system 10 of FIGS. 14-18 will now be described.

Figure 15:
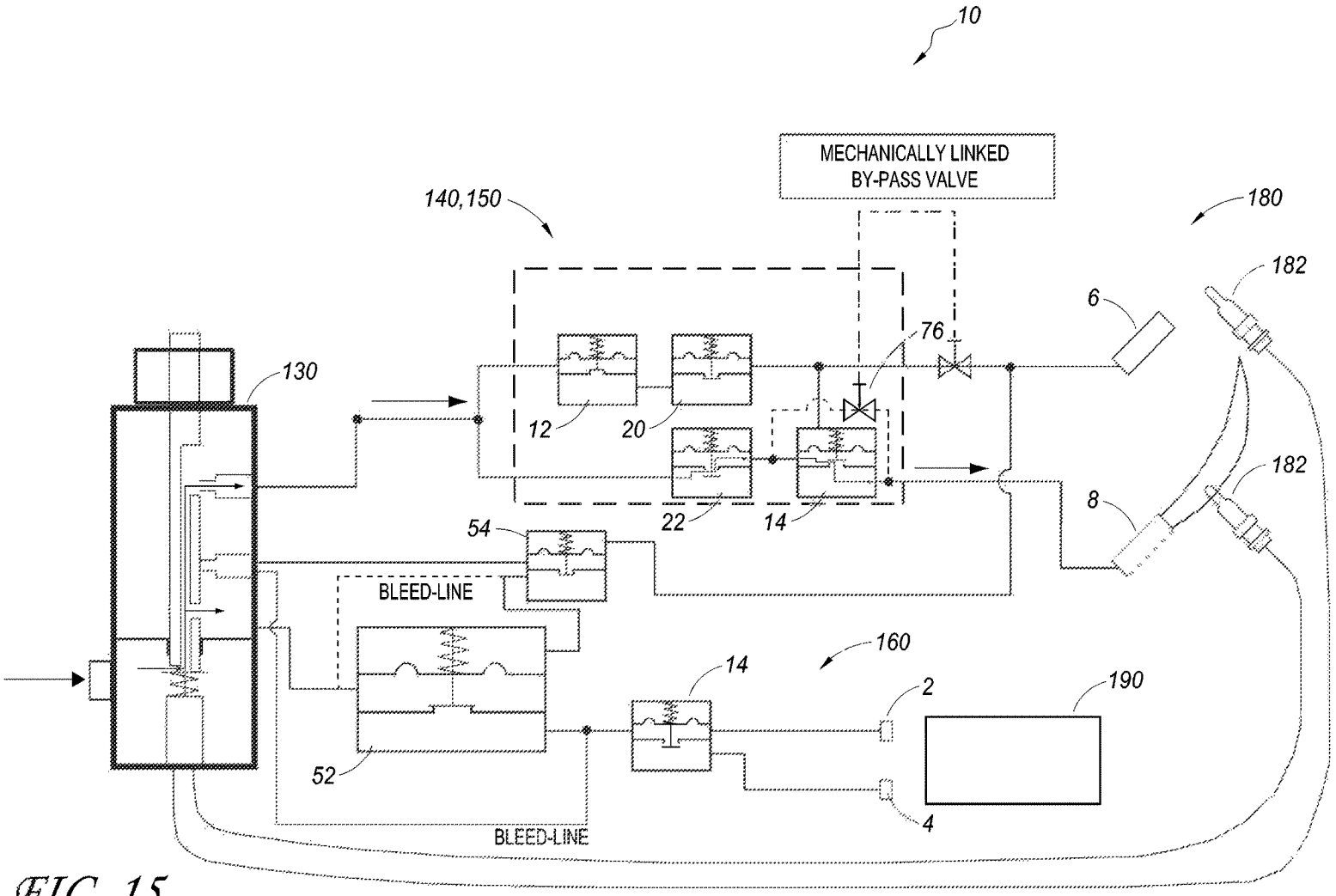
FIGS. 15 and 16 illustrate the piloted heater system of FIG. 14 at an ignition and operational stage respectively, for a first fuel.

For most piloted heater systems the pilot 180 of the heater assembly 10 needs to be proven before fuel can flow to the burner 190. In this initial stage, as shown in FIG. 15, the control valve 130 can allow fuel flow out a first valve $V_1$ to the pilot 180. The heater assembly 10 is configured to respond automatically and correctly according to the type of fuel connected to the gas inlet. As previously discussed with regards to other embodiments, the heater assembly 10 can respond to certain fluid pressures, based on the idea that certain fuels are provided within certain pressure ranges.

FIG. 15 illustrates a low pressure fuel, such as NG, being provided to the heater assembly 10 during pilot ignition. The low pressure fuel can flow from a pilot flow control, such as through valve $V_1$ of the control valve 130 to the selector switch 140. Just as previously described, the fuel can then flow to the first and second primary flow paths in the selector switch 140. As the fuel is at a low pressure, the normally closed valve 12 can remain closed so that the fuel is prevented from flowing to the first pressure regulator 20 in the first primary flow path.

Along the second primary flow path, the fuel can flow to the pressure regulator 22 and then to the normally open valve 14. From the normally open valve 14 the fuel can leave the selector switch out of one of the two outlets. As can be seen, each outlet is connected to a separate pilot nozzle 6, 8 of the pilot 180. With the correct fuel at the correct pilot nozzle, the pilot can be proven, allowing the control valve 130 to provide fuel to the burner 190.

Figure 16:
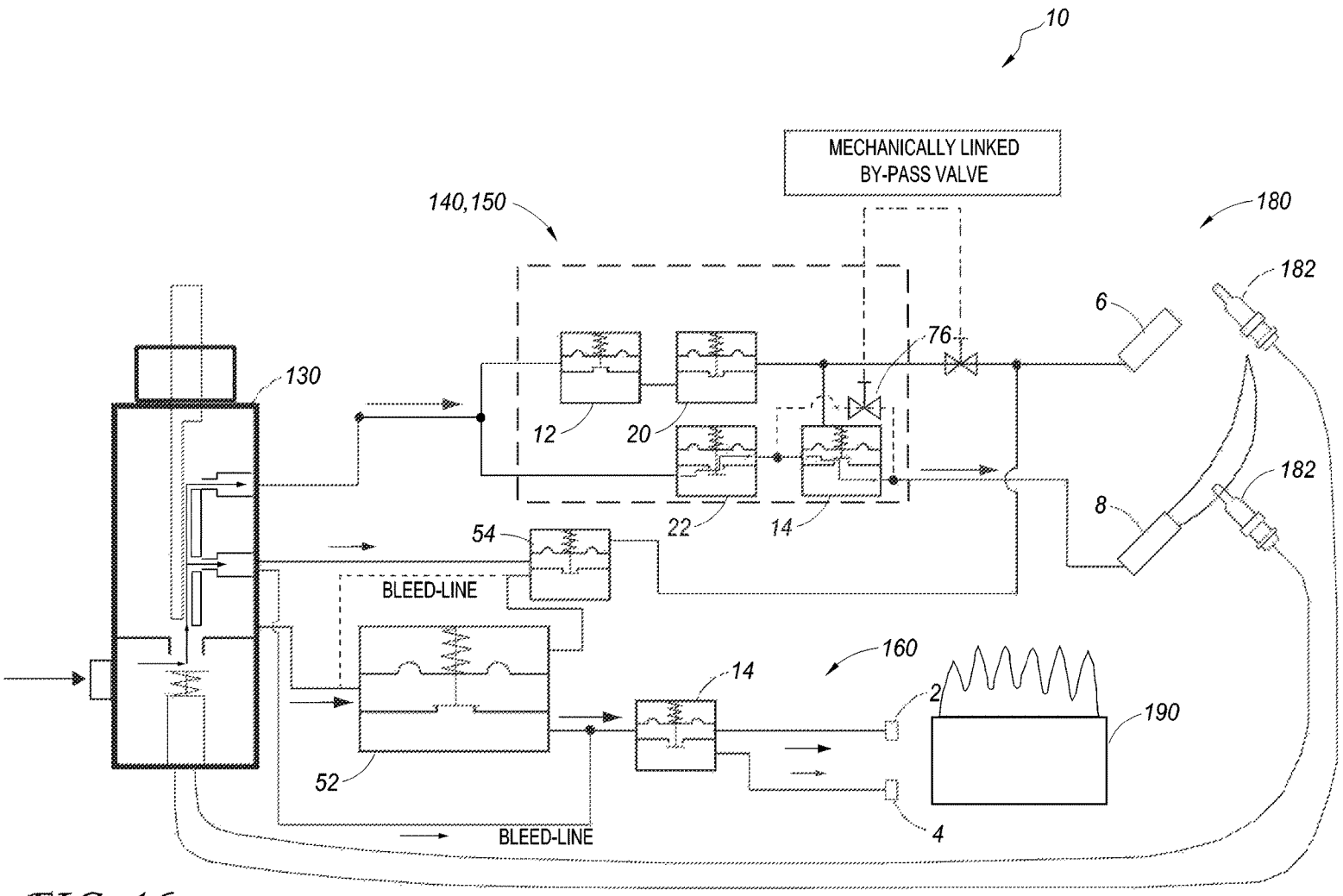

FIG. 16 illustrates the fluid flow to the burner 190 after the pilot 180 has been proven. Fuel will continue to flow to the pilot as previously described. In addition, a second valve $V_2$ on the control valve 130 can be opened by a burner flow control, either manually or automatically. This can allow fuel to flow to the primary regulator 52 and then on to the burner nozzle 160 and the burner 190. The primary regulator 52 is a pressure regulator that can regulate the flow of fuel to the burner and can function in ways previously described.

The illustrated primary regulator 52 can work together with an auxiliary regulator 54. The auxiliary regulator 54 can bleed fuel onto the backside of a diaphragm of the primary regulator 52. In this way, the auxiliary regulator 54 can change the pressure setting of the primary regulator 52 dependent on the type of fuel flowing to the regulators as will be discussed in more detail below.

Two labeled bleed-lines are also shown. These bleed-lines can be finely metered capillaries that do not release a significant amount of gas to reduce the main flow. The bleed line bypassing the primary regulator 52 can provide a slight pressure differential on the downstream side so that when there is an equal pressure on both sides of the diaphragm, the valve will bias towards an open position. The bleed line to the auxiliary regulator 54 can have a similar affect.

The primary regulator 52 and auxiliary regulator 54 can function similar to the regulator system with auxiliary regulators described in U.S. application Ser. No. 13/791,772, filed Mar. 8, 2013, published as U.S. 2013/0299022 on Nov. 14, 2013, incorporated herein by reference and made a part of this specification.

Figure 17:
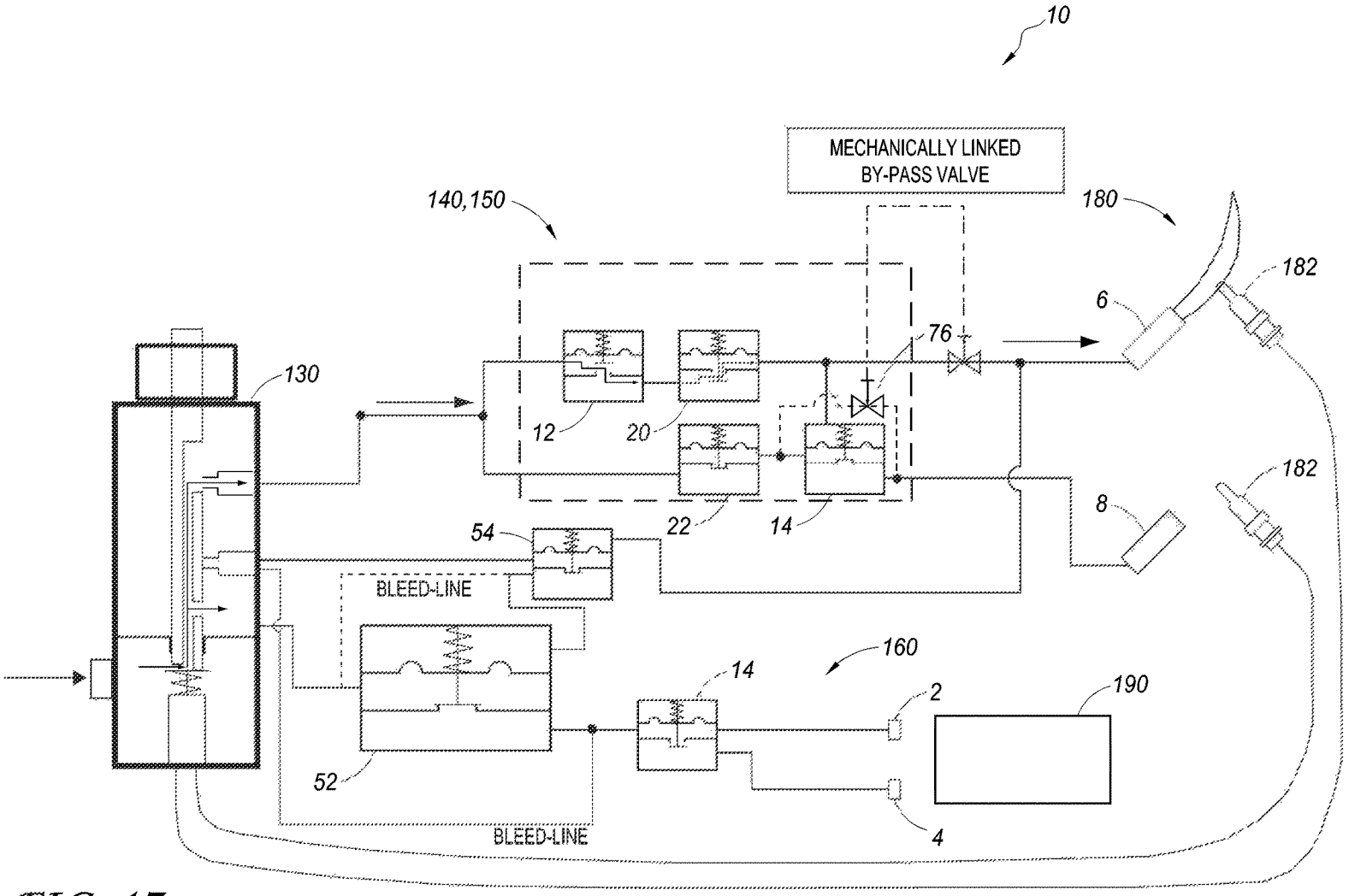
FIGS. 17 and 18 illustrate the piloted heater system of FIG. 14 at an ignition and operational stage respectively, for a second fuel.
Figure 18:
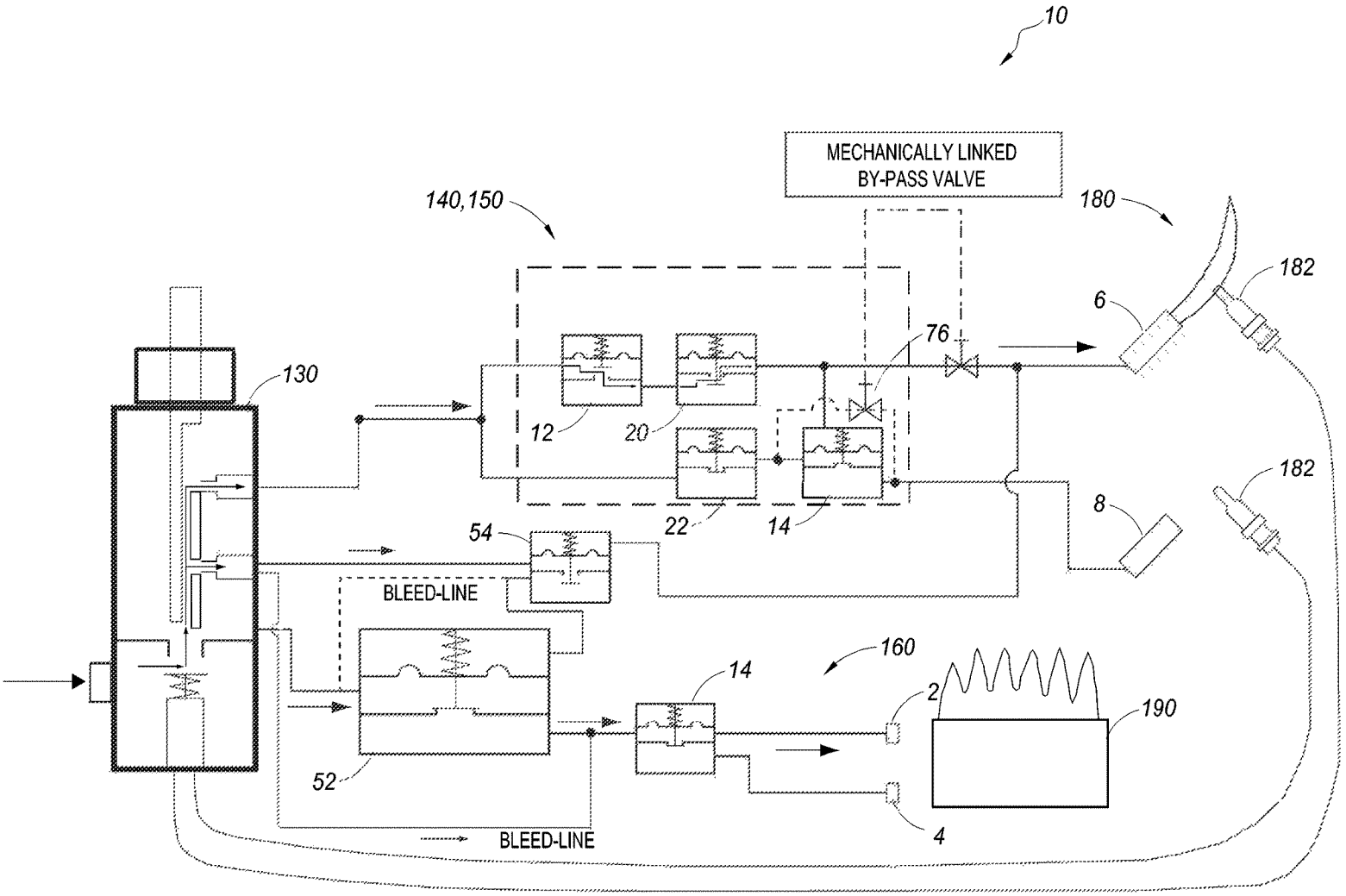

Turning now to FIGS. 17 and 18, the fuel flow for a second fuel at a higher pressure will be discussed. The second fuel can be LP according to some embodiments. The high pressure fuel can flow from a pilot flow control, such as through valve $V_1$ of the control valve 130 to the selector switch 140. Just as previously described, the fuel can then flow to the first and second primary flow paths in the selector switch 140. As the fuel is at a high pressure, the normally closed valve 12 can be opened, allowing the fuel to flow to the first pressure regulator 20 in the first primary flow path. The regulated fuel can then flow to the first pilot nozzle 6.

In the second primary flow path, the fuel can flow to the pressure regulator 22 and then to the normally open valve 14. As previously discussed, fuel from the first flow path can also flow into the normally open valve. The increased pressure on the backside of a diaphragm can close this valve, preventing fuel from flowing to the second pilot nozzle 8. It can also be seen that fuel flow from the first flow path can also flow to the backside of a diaphragm of the auxiliary regulator 54.

Moving now to FIG. 18, once the pilot is proven, the second valve $V_2$ on the control valve can be opened by a burner flow control, either manually or automatically to allow fuel to flow to the primary regulator 52 and then on to the burner nozzle 160 and the burner 190. As previously mentioned, the primary regulator 52 is a pressure regulator configured to regulate the flow of fuel to the burner. The primary regulator 52 can work together with an auxiliary regulator 54. The auxiliary regulator 54 can bleed fuel onto the backside of a diaphragm of the primary regulator 52. In this way, the auxiliary regulator 54 can change the pressure setting of the primary regulator 52 dependent on the type of fuel flowing to the regulators.

As mentioned, fuel flow from the first flow path of the selector switch 140 adjacent the pilot light 180 can flow to the backside of the diaphragm of the auxiliary regulator 54. This increased pressure can allow fuel to flow through the auxiliary regulator 54 to the backside of the primary regulator 52 changing the relationship between the valve member and the valve seat within the primary regulator 52.

As has been previously discussed, a by-pass valve 76 can be included to bypass the functioning of the normally open switch 14. For example, a certified installer may realize that the fluid pressure at the particular location is less than or greater than the typical range which may be causing the normally open switch 14 to close when this is not desirable or correct. Thus, for example, NG can be provided to a heater and to the selector switch 140, but because the fluid pressure is outside of an expected range, it may be flowing through the LP regulator and closing flow from the NG regulator. Opening the illustrated bypass channel with the by-pass valve 76 can allow the heater to function normally, even though the fluid pressure is outside of the normal range. In addition, the by-pass 76 can include two by-pass valves. The second by-pass valve can be on the LP fuel line before the pilot nozzle and can close the flow path so that NG does not flow to the LP pilot nozzle. The two valves 76 can be electrically or mechanically linked. In addition, as previously discussed, the by-pass valve(s) 76 can also be a cutoff valve 76 positioned along the first primary flow path before the bleed line to the valve 14. The cutoff valve 76 can stop flow through the first primary flow path and prevent flow from reaching both the backside of the diaphragm of the valve 14 and the pilot nozzle 6.

According to some embodiments, a heating assembly can be used with either a first fuel or a second fuel different from the first. The heating assembly can comprise a control valve, a pilot light, a burner, a burner nozzle and a fuel selector switch. The control valve can have an inlet, a pilot flow control, and a burner flow control. The pilot light can have a first pilot nozzle and a second pilot nozzle, the pilot light configured to receive fuel flow from the pilot flow control of the control valve. The burner nozzle can be configured to receive fuel flow from the burner flow control of the control valve and to direct the fuel flow to the burner. A fuel selector switch can be positioned in a first flow path between the pilot flow control and the pilot light and configured to allow fuel flow to one of a first pilot nozzle and a second pilot nozzle while preventing fuel flow to the other of the first pilot nozzle and the second pilot nozzle. The fuel selector switch can be pressure sensitive and can include first and second valves. The first valve can have a first valve body, a first valve seat, and a first outlet fluidly connected to the first pilot nozzle. The second valve can have a diaphragm, a second valve body, a second valve seat and a second outlet fluidly connected to the second pilot nozzle. Further, a backside of the diaphragm of the second valve can be fluidly connected to the first outlet of the first valve to influence a position of the diaphragm and second valve body of the second valve.

In some embodiments, the fuel selector switch further comprises a first pressure regulator and a second pressure regulator, each pressure regulator configured to regulate the flow of fluid within a different predetermined pressure range. The second valve can be downstream of the second pressure regulator. The first valve can be upstream or downstream of the first pressure regulator. When it is upstream, fuel flow from the first outlet is configured to pass through the first valve before flowing to the backside of the diaphragm. The first valve can be a normally closed valve and the second valve can be a normally open valve.

In some embodiments, the heating assembly can further comprise one or more of the following. A by-pass valve and a by-pass channel and when the by-pass valve is in an open position being configured to allow fuel flow to bypass the second valve. A primary regulator valve can be positioned in a second flow path between the burner flow control and the burner nozzle. An auxiliary regulator fluidly coupled to a backside of a diaphragm of the primary regulator valve. The nozzle can be a pressure sensitive nozzle configured to always allow fuel flow to a first burner orifice and to selectively allow fuel flow to a second burner orifice.

In certain embodiments, a heating assembly can be used with either a first fuel or a second fuel different from the first. The heating assembly can comprise a control valve, a pilot light, a burner, a burner nozzle and a fuel selector switch. The control valve can have an inlet, a pilot flow control, and a burner flow control. The pilot light can have a first pilot nozzle and a second pilot nozzle, the pilot light configured to receive fuel flow from the pilot flow control of the control valve. The burner nozzle can be configured to receive fuel flow from the burner flow control of the control valve and to direct the fuel flow to the burner. A fuel selector switch can be positioned in a first flow path between the pilot flow control and the pilot light and configured to allow fuel flow to one of a first pilot nozzle and a second pilot nozzle while preventing fuel flow to the other of the first pilot nozzle and the second pilot nozzle. The fuel selector switch can be pressure sensitive and can include first and second valves, and first and second pressure regulators. The first valve can have a first valve body, a first valve seat, and a first outlet fluidly connected to the first pilot nozzle. The first pressure regulator can be configured to regulate fuel flow within a first predetermined pressure range, the first pressure regulator fluidly positioned in series with the first valve. The second valve can have a diaphragm, a second valve body, a second valve seat and a second outlet fluidly connected to the second pilot nozzle. The second pressure regulator can be configured to regulate fuel flow within a second different predetermined pressure range, the second first pressure regulator fluidly positioned in series with the second valve. A backside of the diaphragm of the second valve can be fluidly connected to the first outlet of the first valve to influence a position of the diaphragm and second valve body of the second valve.

Figure 19:
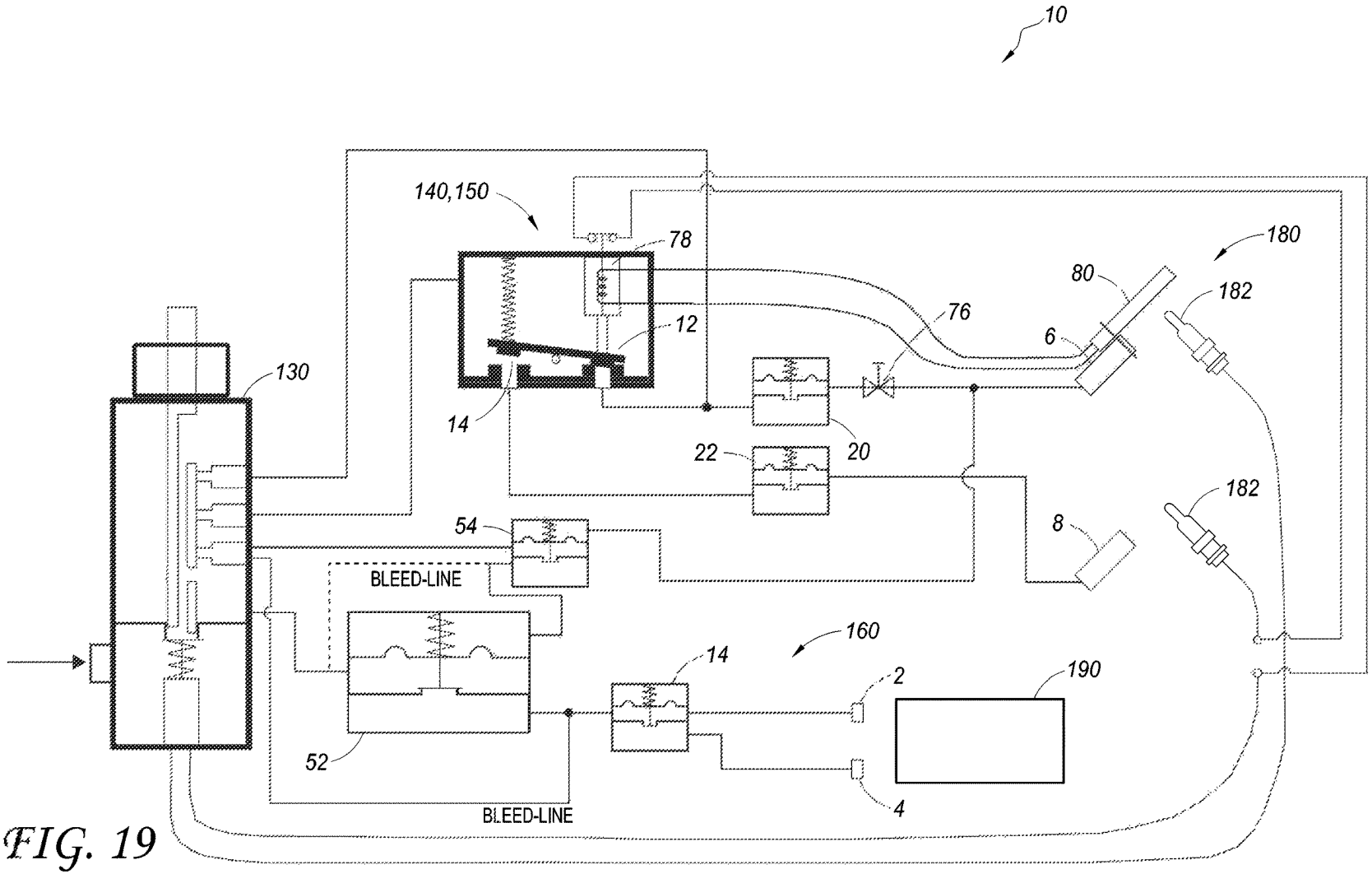
FIG. 19 shows another embodiment of a piloted heater system with another embodiment of selector switch.

Turning now to FIG. 19, another embodiment of a piloted heater system 10 is shown with another type of selector switch 140. The selector switch 140 can work to provide functionality similar to the previously described selector switches 140 while working in a different manner. The selector switch 140 is shown being used as a pilot selector switch 150 as will be described in more detail below.

Numerical reference to components is the same as previously described. Where such references occur, it is to be understood that the components are the same or substantially similar to previously-described components. It should be understood that the illustrated piloted heater system 10 includes each of the features designated by the numbers used herein. However, as emphasized repeatedly herein, these features need not be present in all embodiments. In addition, it will be understood that the selector switch shown can be used in other types of heater systems.

The illustrated selector switch 140 includes an electrically powered switch 78 that can control the position of the first and/or second valve 12, 14 within the selector switch 140. In addition, or alternatively, the electrically powered switch 78 can provide or interrupt a signal to the control valve 130 to control or influence a valve in the control valve. For example, the control valve can include a solenoid valve that can control fuel flow to the burner.

The electrically powered switch 78 can be a relay switch in some embodiments. A thermopile or other thermo-generator 80 can be used to generate a current to power the electrically powered switch 78.

Figure 20:
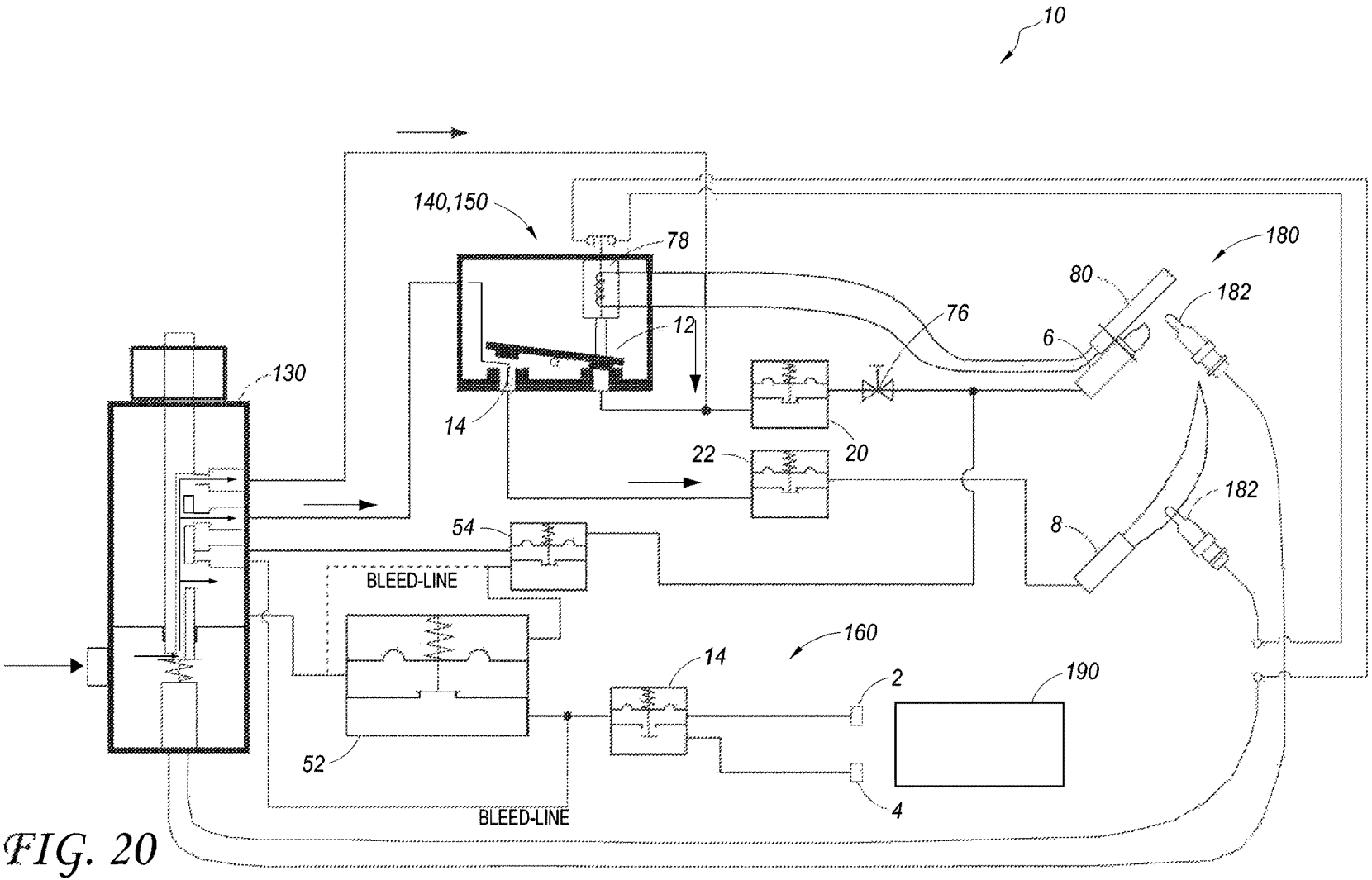
FIGS. 20 and 21 illustrate the piloted heater system of FIG. 19 at an ignition and operational stage respectively, for a first fuel.

As previously discussed, the pilot 180 of the heater assembly 10 generally needs to be proven before fuel can flow to the burner 190. In this initial stage, as shown in FIG. 20, the control valve 130 can allow fuel to flow out of a first valve $V_1$ and a second valve $V_2$ to the pilot 180. The heater assembly 10 is configured to respond automatically and correctly according to the type of fuel connected to the gas inlet. As previously discussed with regards to other embodiments, the heater assembly 10 can respond to certain fluid pressures, based on the idea that certain fuels are provided within certain pressure ranges.

FIG. 20 illustrates a low pressure fuel, such as NG, being provided to the heater assembly 10. The low pressure fuel can flow from the pilot flow control of the control valve 130, such as through valves $V_1$ and $V_2$ to the selector switch 140 and/or the first pressure regulator 20. As can be seen, the selector switch 140 has a first valve 12 and a second valve 14. The valves are connected so that when the second valve 14 is fully open, the first valve is closed. The valves can also be completely separate. With the second valve 14 in the open position, flow is allowed between the control valve at $V_2$ and second pressure regulator 22. As there are no valves between $V_1$ and the first regulator 20, fuel will flow thereto as long as $V_1$ is open. The fuel flows through both pressure regulators to the pilot nozzles 6, 8 where flames are formed.

A small flame is formed at the first pilot nozzle 6 that is insufficient to heat the thermopile 80 or the first thermocouple 182. At the same time, a large flame at the second pilot nozzle 8 is able to prove the second thermocouple 182. In the illustrated example, NG is used which is the correct fuel for the second pilot nozzle 8.

Figure 21:
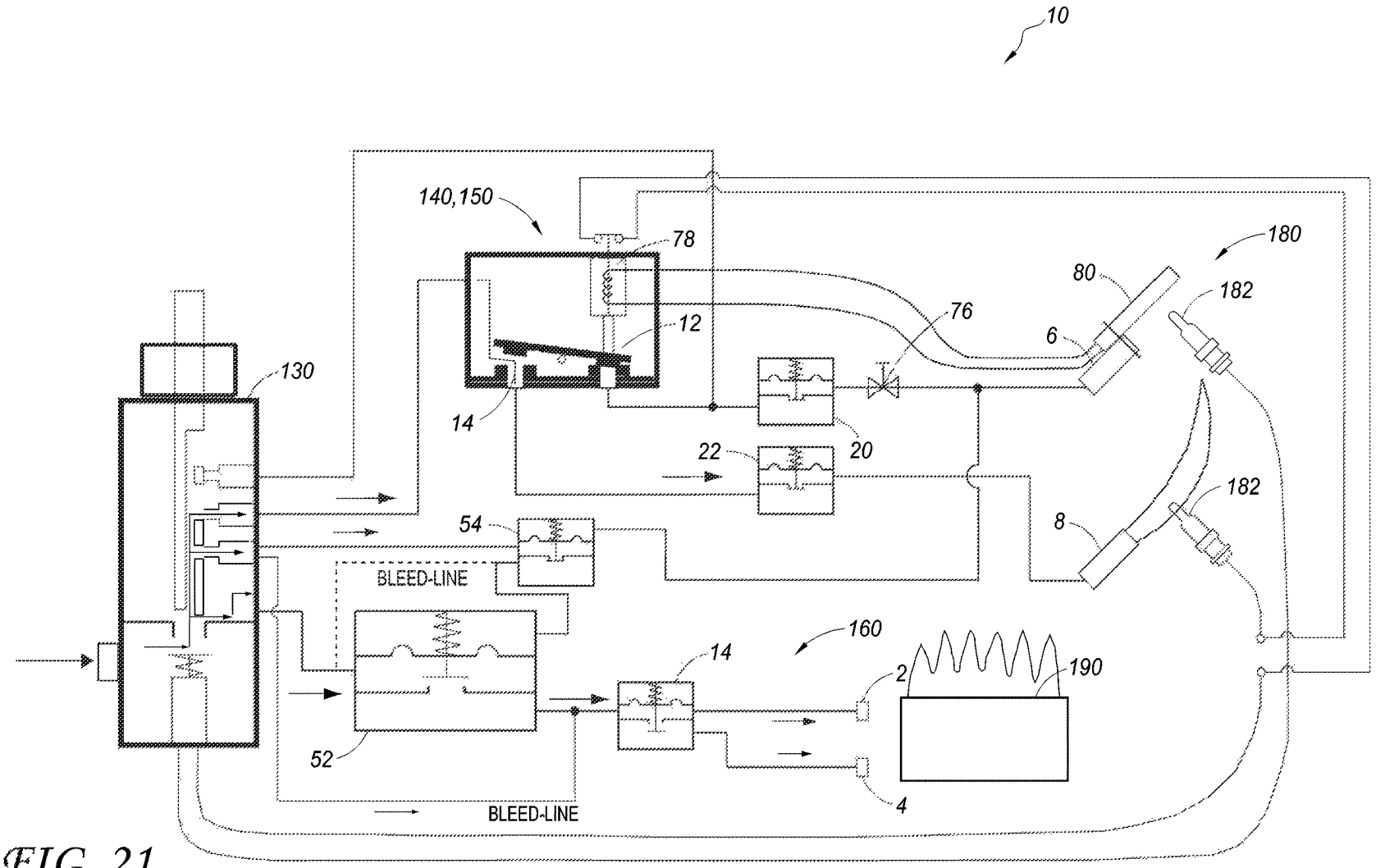

Once the pilot is proven, the control valve 130 can allow fuel to flow to the burner nozzle 160 as shown in FIG. 21 and in a similar manner as was previously discussed with regards to FIGS. 14-18. As shown in FIG. 21, the control valve 130 can open valve V3 to start the flow to the burner 190. The illustrated primary regulator 52 can work together with an auxiliary regulator 54. The auxiliary regulator 54 can bleed fuel onto the backside of a diaphragm of the primary regulator 52. In this way, the auxiliary regulator 54 can change the pressure setting of the primary regulator 52 dependent on the type of fuel flowing to the regulators as has been discussed.

In addition, the control valve can close valve $V_1$ so that the only flow to the pilot 180 is from the selector switch 140. This effectively turns off the flame at the first pilot nozzle 6. Though it is generally not required to turn off this flame due to its small size, it may confuse consumers and so is preferably turned off.

Figure 22:
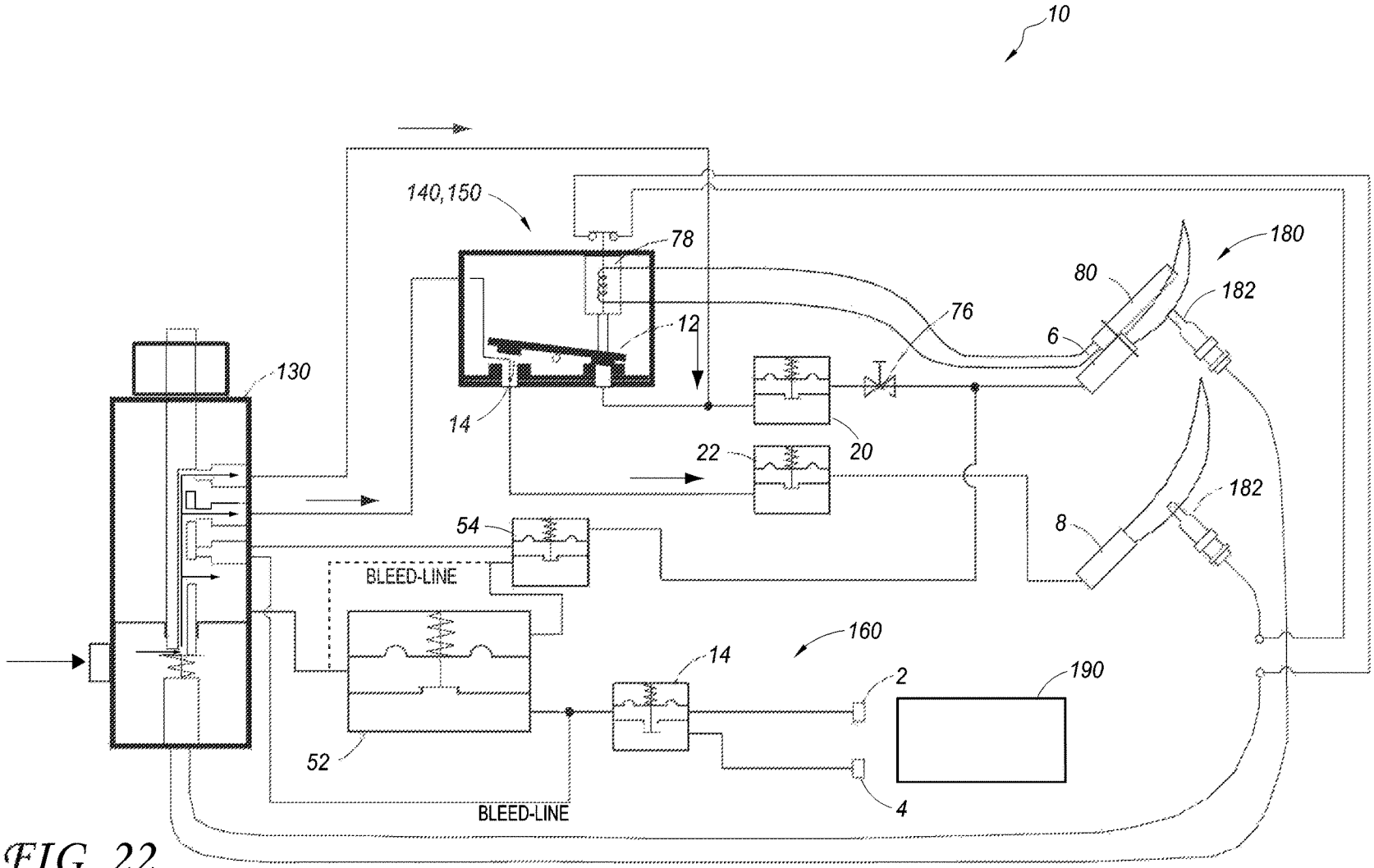
FIGS. 22, 23, and 24 illustrate the piloted heater system of FIG. 19 at two ignition stages and an operational stage respectively, for a second fuel.

Looking now to FIG. 22, the flow of a higher pressure fuel, such as LP, will now be described. The high pressure fuel can flow from the pilot flow control of the control valve 130, such as through valves $V_1$ and $V_2$ to the selector switch 140 and/or the first pressure regulator 20. With the second valve 14 in the open position, flow is allowed between the control valve at $V_2$ and second pressure regulator 22. As there are no valves between $V_1$ and the first regulator 20, fuel will flow thereto as long as $V_1$ is open. The fuel flows through both pressure regulators to the pilot nozzles 6, 8 where flames are formed.

A large flame is formed at both the first and second pilot nozzles 6, 8. The large flame at the first pilot nozzle 6 can heat the thermopile 80 and the first thermocouple 182. At the same time, a large flame at the second pilot nozzle 8 may also heat the second thermocouple 182, though in some embodiments, the large flame may angle upwards away from the second thermocouple.

Figure 23:
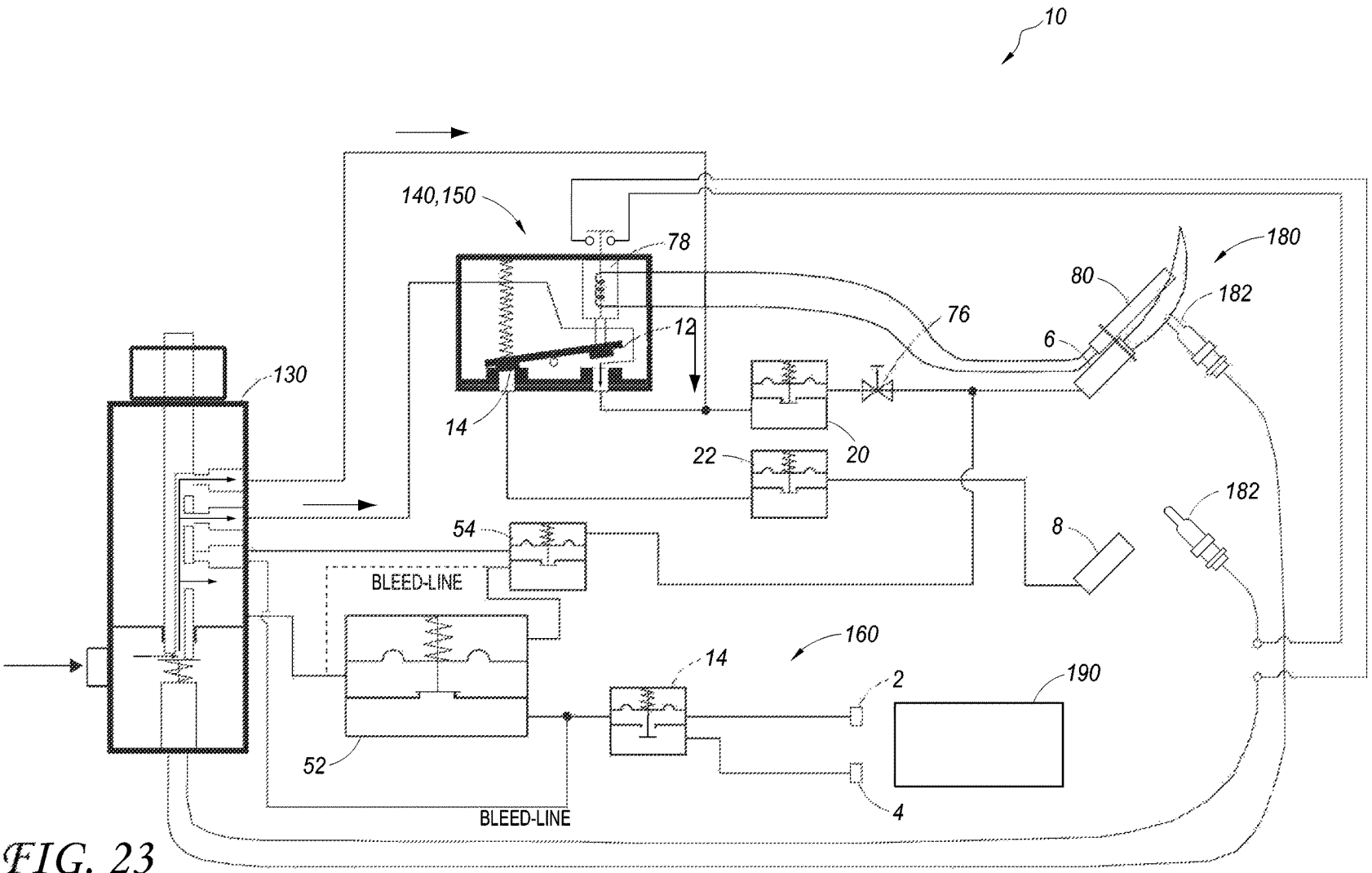

Turning now to FIG. 23, the action of the relay switch 78 and the thermopile 80 is shown. The relay switch 78 closes the second valve 14 and opens the first valve 12. This cuts off fuel flow to the second pressure regulator 22, extinguishing the flame at the second pilot nozzle 8. As illustrated, this also opens the circuit between the second thermocouple 182 and the control valve 130. This can help ensure that the second thermocouple 182 is not proven.

Figure 24:
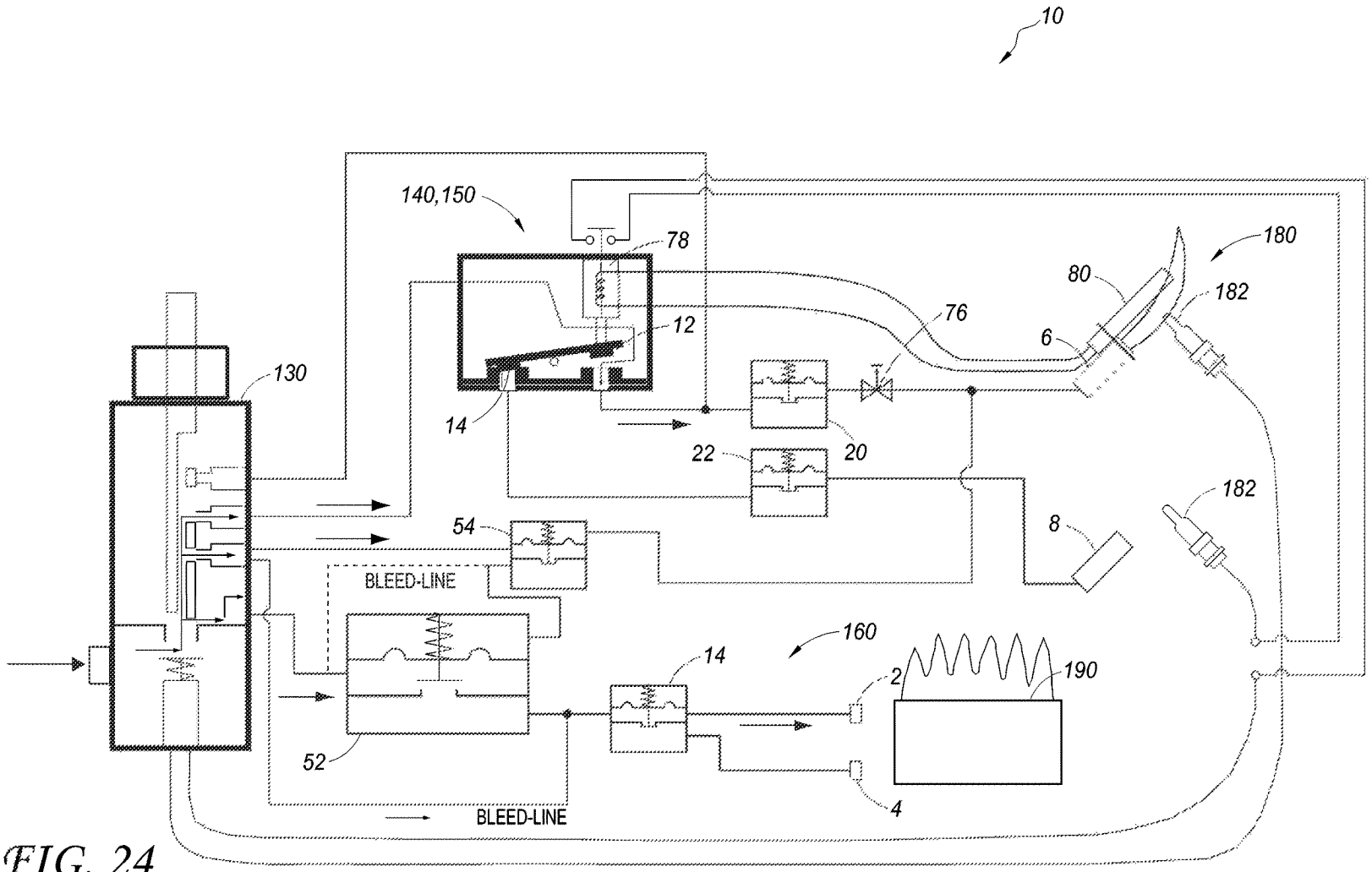

Once the pilot is proven, the control valve 130 can allow fuel to flow to the burner nozzle, as shown in FIG. 24. As has been previously discussed, the control valve 130 can open valve V3 to start the flow to the burner. The illustrated primary regulator 52 can work together with an auxiliary regulator 54. The auxiliary regulator 54 can bleed fuel onto the backside of a diaphragm of the primary regulator 52. In this way, the auxiliary regulator 54 can change the pressure setting of the primary regulator 52 dependent on the type of fuel flowing to the regulators has been discussed.

In addition, the control valve can close valve $V_1$ so that the only flow to the pilot 180 is from the selector switch 140. In this instance, as the first valve 12 is open, this does not affect the flame at the first pilot nozzle 6.

As has been previously discussed, a by-pass valve 76 can be included to correct a wrong gas running above typical pressures. For example, a certified installer may realize that the fluid pressure at the particular location is greater than the typical range. This may cause NG to flow through the LP lines. A bypass valve 76 can close the flow to the LP pilot nozzle 6. This in turn prevents heating of the thermopile 80 and the first thermocouple 182. The second thermocouple 182 will then be proven, and the NG will run through the correct lines.

A dual fuel heating assembly can include first and second nozzles, a fuel selector switch, a thermopile, and first and second pressure regulators. The fuel selector switch can include a first valve and an electrically powered switch to control the position of the first valve. The pressure regulators can regulate different fuels within different predetermined pressure ranges. The first pressure regulator can direct fuel flow to the first nozzle. The second pressure regulator can selectively receive fuel flow from the fuel selector switch and direct fuel flow to the second nozzle. The thermopile positioned adjacent the first nozzle is electrically coupled to the electrically powered switch. Heat from combustion at the first nozzle can generate a current at the thermopile so that at a predetermined set point the electrically powered switch closes the first valve to prevent fuel flow to the second pressure regulator and the second nozzle.

In some embodiments, a heating assembly can be used with either a first fuel or a second fuel different from the first. The heating assembly can comprise a housing having an inlet; a first nozzle; a second nozzle; a fuel selector switch configured to receive fuel flow from the inlet; first and second pressure regulators and a thermopile. The fuel selector switch can comprise a first valve having a first valve body and a first valve seat and an electrically powered switch configured to control the position of the first valve. The first pressure regulator can be configured to regulate fuel flow within a first predetermined pressure range, the first pressure regulator configured to receive fuel flow from the inlet and to direct fuel flow to the first nozzle. The second pressure regulator can be configured to regulate fuel flow within a second different predetermined pressure range, the second pressure regulator configured to selectively receive fuel flow from the fuel selector switch and to direct fuel flow to the second nozzle. The thermopile can be positioned adjacent the first nozzle and be electrically coupled to the electrically powered switch. Heat from combustion at the first nozzle can generate a current at the thermopile, the thermopile and electrically powered switch can be configured such that when the current reaches a predetermined set point the electrically powered switch closes the first valve to prevent fuel flow to the second pressure regulator and the second nozzle.

In some embodiments, the fuel selector switch further comprises a second valve having a second valve body and a second valve seat, the second valve configured to selectively allow fuel flow from the fuel selector switch to the first pressure regulator. The heating assembly may include first and second thermocouples. The first nozzle can be a first pilot nozzle configured to direct a flame towards the first thermocouple and the second nozzle can be a second pilot nozzle configured to direct a flame towards the second thermocouple. The electrically powered switch can comprise a normally closed relay switch electrically coupled to the second thermocouple. A control valve can be electrically coupled to the first and second thermocouples and configured to control fuel flow through the heating assembly.

In further embodiments, the heating assembly can further include a primary regulator valve positioned in a flow path between the inlet and the burner nozzle. An auxiliary regulator may also be used fluidly coupled to a backside of a diaphragm of the primary regulator valve. A pressure sensitive nozzle having first and second burner orifices may be used in certain embodiments. The pressure sensitive nozzle can be configured to always allow fuel flow to the first burner orifice and to selectively allow fuel flow to the second burner orifice.

According to some embodiments, a dual fuel heating assembly can include a control valve having an inlet, a pilot flow control, and a burner flow control; a pilot light having a first pilot nozzle and a second pilot nozzle, the pilot light configured to receive fuel flow from the pilot flow control of the control valve; a burner; a burner nozzle configured to receive fuel flow from the burner flow control of the control valve and to direct the fuel flow to the burner; a fuel selector switch configured to receive fuel flow from the pilot flow control of the control valve; a first pressure regulator configured to regulate fuel flow within a first predetermined pressure range, the first pressure regulator configured to receive fuel flow from the pilot flow control of the control valve and to direct fuel flow to the first pilot nozzle; a second pressure regulator configured to regulate fuel flow within a second different predetermined pressure range, the second pressure regulator configured to selectively receive fuel flow from the fuel selector switch and to direct fuel flow to the second pilot nozzle; and a thermopile adjacent the first pilot nozzle and electrically coupled to the electrically powered switch. The fuel selector switch can comprise a first valve having a first valve body and a first valve seat and an electrically powered (e.g. relay) switch configured to control the position of the first valve. Heat from combustion at the first pilot nozzle can generate a current at the thermopile, the thermopile and electrically powered switch can be configured such that when the current reaches a predetermined set point the electrically powered switch closes the first valve to prevent fuel flow to the second pressure regulator and the second pilot nozzle.

In some embodiments, a heating assembly can be used with either a first fuel or a second fuel different from the first. The heating assembly can comprise a housing having an inlet, a first nozzle, a second nozzle, a fuel selector switch configured to receive fuel flow from the inlet, and a thermopile. The fuel selector switch can include a first valve having a first valve body and a first valve seat, a second valve having a second valve body and a second valve seat, and an electrically powered switch configured to control the position of the first and second valves such that when one valve is open, the other is closed. The thermopile can be adjacent the first nozzle and electrically coupled to the electrically powered switch. Heat from combustion at the first nozzle can generate a current at the thermopile, the thermopile and electrically powered switch configured such that when the current reaches a predetermined set point the electrically powered switch closes the first valve to prevent fuel flow to the second pressure regulator and the second nozzle and opens the second valve.

Further embodiments can include a first pressure regulator and a second pressure regulator. The pressure regulators can be configured to regulate fuel flow within a predetermined pressure range. The first pressure regulator can be configured to receive fuel flow from the inlet and selectively from the fuel selector switch and to direct fuel flow to the first nozzle. The second pressure regulator can be configured to selectively receive fuel flow from the fuel selector switch and to direct fuel flow to the second nozzle. Still further embodiments can include a control valve to control fuel flow to the first and second nozzles.

Figure 25:
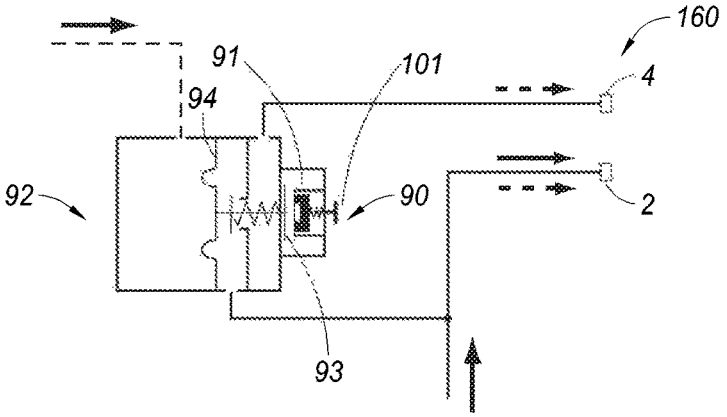
FIGS. 25-27 illustrate various embodiments of locking valves with reset switches.
Figure 26:
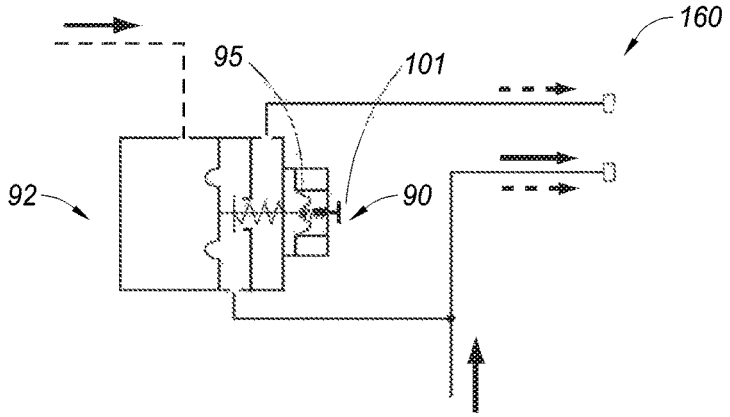
Figure 27:
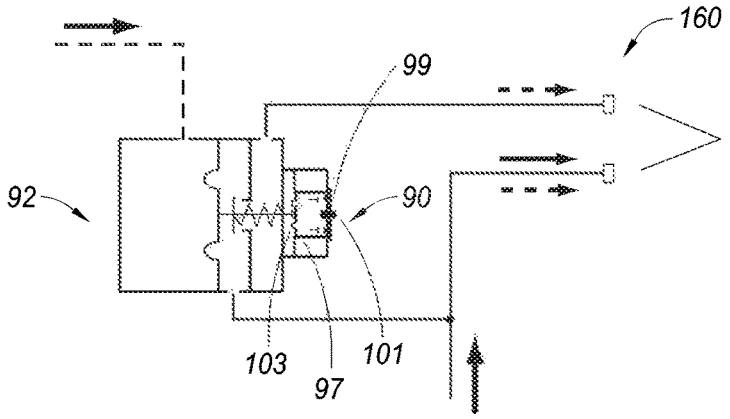

Turning now to FIGS. 25-27 three locking selector valves 92 each with a different type of reset switch 90 are shown. These locking selector valves 92 can be similar in some regards to the previously discussed selector switch 140. The locking selector valves 92 can make a selection (i.e. determine the position of the valve member) based on fluid pressure. The valve member can then be locked in place. A reset switch 90 can be used to reset a valve that is locked or held in a set position. For example, a fluid pressure in communication with the valve 92 can cause the valve 92 to move to a certain position, such as an open or closed position. When the valve reaches this position, it may then be held or locked in that position. Actuation of the reset switch can release the valve from this position, or from being held in the position.

A heating assembly can include a locking valve with a reset switch which can include certain pressure sensitive features. These features can be configured to change from a first position to a second position based on a pressure of a fuel flowing into the valve. The valve can be used with either a first fuel or a second fuel different from the first. The valve can become locked or be held in either the first or the second position. For example, a predetermined fuel pressure can cause the valve to move to a closed position and the valve can become locked or held in that position. If the pressure decreases, the valve can remain in the locked position. Actuation of the reset switch can allow the valve to move to a new position, such as an open position.

Such a locking valve with a reset switch can be used to set a valve member position with respect to a valve seat independent of a later fluid pressure condition. For example, when the heating assembly 10 is connected to a tank fuel source, the supply pressure may decrease as the tank empties. This may result in the tank supplying the heating assembly with fuel at a pressure lower than the initial pressure when the tank was full or fuller.

In order to prevent a fuel from passing through the heating assembly in the wrong manner, the locking valve 92 with reset switch 90 can be used. In some examples, the locking valve 92 with reset switch 90 can be set for selection between LP and NG. When LP is used, the locking valve 92 can be configured such that the valve member will move to a closed position. As per the illustrated embodiment, this can prevent fuel from flowing to one of the burner orifices 4 of the nozzle 160. The valve can then be held or locked in this position. If the fluid pressure falls, such as because of a reduction in pressure within a fuel source tank, the reduction in pressure will not adversely affect the system. Rather, the valve 92 will be maintained in the proper closed position.

If a different source of fuel is later connected to the heating assembly the reset switch can be actuated to release the valve 92 from the locked position. It will be understood, that the locking valve 92 with reset switch 90 can be used at various locations within a heater assembly. The locking valve 92 with reset switch 90 is illustrated as a orifice selector valve 92 for a burner nozzle 160, though it can also be used with a pilot 180, with a pressure regulator 20, 22, selector switch 140, etc. For example, any of the locking valves 92 with reset switch 90 of FIGS. 25-27 can be used in place of the orifice selector valves 14 of FIGS. 10, 11 and 14-24, or the pilot selector switch of FIG. 11.

Looking at FIG. 25, the locking valve 92 with reset switch 90 will be further described. The locking valve 92 can include a valve member, a valve seat, and a biasing member. The biasing member can comprise one or more of a spring and a diaphragm 94. The biasing member can bias the valve member to an open or closed position with respect to the valve seat. As shown in FIG. 25, the valve member is spaced from the valve seat such that the valve is in an open position, allowing flow through the valve 92.

Fluid pressure can be used to change the position of the valve member. The fluid pressure can be from the fluid flowing through the valve, such as between the valve member and the valve seat, or from fluid acting on a backside of a diaphragm 94, or from pressure acting on some other feature. For example, pre-regulated fuel, fuel directly from the fuel supply, or fuel post regulation can be in communication with a backside or frontside of a diaphragm 94. FIG. 25 shows signal pressure coming from a gas inlet supply (i.e. pre-regulated fuel) communicating with the backside of the diaphragm 94. It will be understood that the pressure of pre-regulated fuel will be greater than the regulated pressure flowing through the valve and acting on the front side of the diaphragm. The pressure of the pre-regulated fuel may act on the valve 92 prior to the regulated fuel entering the valve, or the difference in pressure between the pre-regulated fuel and the regulated fuel may be sufficient to allow the pre-regulated fuel to control the valve 92, while also overcoming any spring bias necessary to move the valve member.

The valve member can be connected to or in close proximity to the reset switch and associated locking feature. The locking feature of the reset switch of the illustrated embodiments includes (1) a magnet 91 and magnetic plate 93, (FIG. 25) (2) an invertible membrane 95 (FIG. 26), and (3) an air chamber 97 with a one-way flap valve 99 (FIG. 27). Other types of locking features can also be used. The reset switch 90 can also comprise a button or knob 101 that can be actuated to unlock the valve. The reset switch 90 may alternatively comprise an electronic control system.

In FIG. 25, a magnetic plate 93 is shown connected to the valve member. When the valve member moves, it can approach a magnet 91 which can engage the magnetic plate 93, locking the valve in place, such as in a closed position as in the illustrated embodiment, or in an open position. The magnet and magnetic plate can also be in a reversed configuration. The magnetic plate can be a plate, disk, rod, or any other magnetic material or shape.

The reset switch 90 can include a knob (proximity detent release) 101 and a spring. A user can pull the knob 101 to force the magnet 91 away from the magnetic plate 93, which will allow the magnetic plate to move away from the magnet if there are no counter acting forces on the backside of the diaphragm 94. In other embodiments, the reset switch 90 can include a preferably non-magnetic rod and the user can push on the knob to advance the rod to separate the magnetic plate and the magnet 91 if, again, there are not counter acting forces on the backside of the diaphragm 94. In other embodiments, the reset switch 90 can include a preferably non-magnetic rod and the user can pull up (or on) the knob to advance the magnet 91 away from the rod or plate to separate them if, again, there are not counter acting forces on the backside of the diaphragm 94.

In FIG. 26, a similar locking valve 92 with reset switch 90 is shown. Here, instead of a magnet and magnetic plate, an invertible membrane 95 is used to lock the valve member in position. When the valve member moves, it can force the invertible membrane 95 to invert and change position. The invertible membrane 95 can be a bi-stable mechanism that can be at rest in two different stable positions. The two positions can be spaced away such that in one position, the valve member is engaged with the valve seat and in the other position the valve member is spaced away from the valve seat. The invertible membrane 95 can be made from any number of different materials including rubber, silicone, and plastic.

The reset switch 90 can include a knob 101 to contact the invertible membrane 95. A user can pull or push the knob 101 to force the invertible membrane 95 to change positions, thereby also forcing the valve member to change positions. The knob 101 can be connected to the invertible membrane 95, or may simply contact the invertible membrane when the invertible membrane is in its closest position to the knob and the knob is advanced towards the invertible membrane. The invertible membrane 95 can be positioned within the locking valve in a chamber separated from fluid flow. In this way the fluid flow can be prevented from moving or biasing the invertible membrane 95 to a particular position. The other embodiments of locking mechanism can be similarly situated.

In FIG. 27, another locking valve 92 with reset switch 90 is shown. In this embodiment, an air chamber 97 with a one-way flap valve 99 is used to lock the position of the valve member. Moving the valve member towards the air chamber presses on a diaphragm 103 decreasing the size of the air chamber 97. As it does this, air is released from the air chamber 97 through a one-way flap valve 99. The one-way flap valve 99 seals the air chamber 97 and prevents air from entering back into the air chamber 97. This prevents the air chamber 97 from enlarging and decreases the pressure to hold the valve member in place because of the negative pressure in the air chamber 97.

Pressing or pulling the reset switch 99 can allow air to enter the air chamber 97, equalizing the pressure with the environment and allowing the valve member to move back to the initial position.

Though three embodiments of locking valve 92 with reset switch 90 are shown, it will be understood that the many other systems can be used to serve the same or similar purposes, especially as regards to the locking and resetting features.

Figure 28A:
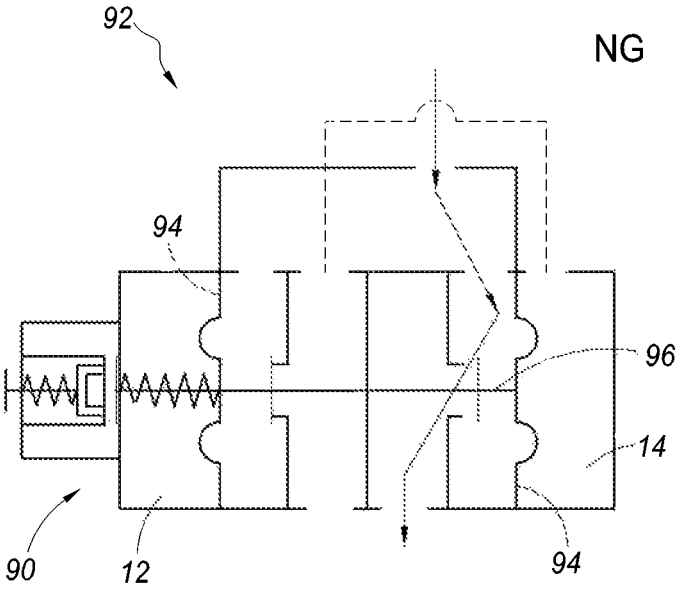
FIGS. 28A-B show another embodiment of locking valve with reset switch for a first fuel and a second fuel, respectively.
Figure 28B:
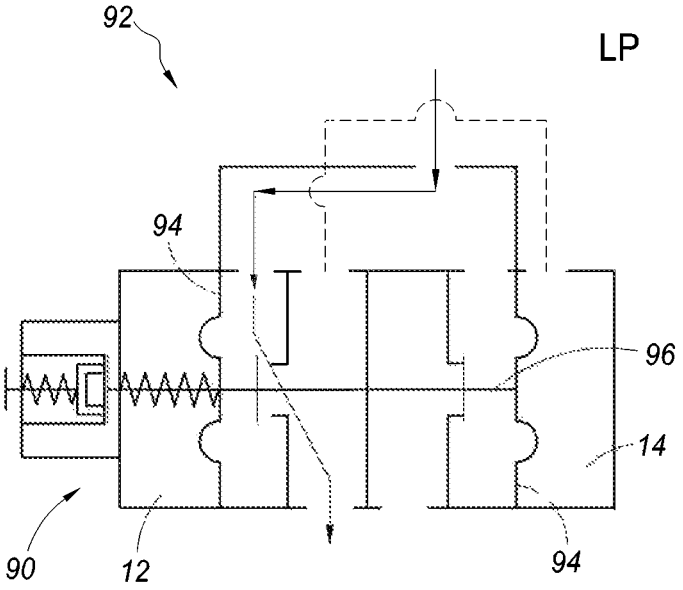

FIGS. 28A-B show another embodiment of locking valve 92 with reset switch 90 for a first fuel and a second fuel, respectively. As illustrated, there are two internal valves 12, 14 and two separate flow paths. In addition, the valve members 12, 14 are linked together by member 96. Thus, when valve 12 is closed, valve 14 is open (FIG. 28A) and vice versa (FIG. 28B). In addition, the locking valve 92 is shown with the magnetic plate and magnet locking system of FIG. 25. As will be understood by those of skill in the art, the linking member 96 can be any number of different features that connect the valve members. The member 96 can be a bar, rod, chain, link, etc. In addition, one or more seals or gaskets can be used to seal the member 96 where it passes through one chamber into another.

It will be understood that any type of locking system can be used. The locking valve 92 can hold the valve 12 in the open position and the valve 14 in the closed position as shown in FIG. 28B. The locking features can be rearranged, for the opposite holding pattern. Though shown with multiple diaphragms 94, in some embodiments the locking valve with multiple internal valves has only one diaphragm 94. In some embodiments, two more of the internal valve members can be linked together and have only one spring and/or diaphragm. The illustrated locking valve 92 has a single inlet and two outlets.

The locking valve 92 of FIGS. 28A-B can be part of a selector switch 140, for example the selector switch 140 shown in FIG. 13, but also that of FIGS. 9A, 11 and 12. The locking valve 92 can also be part of a selector valve 110, such as those shown in FIGS. 3A-4B and 6-8B.

Figure 29A:
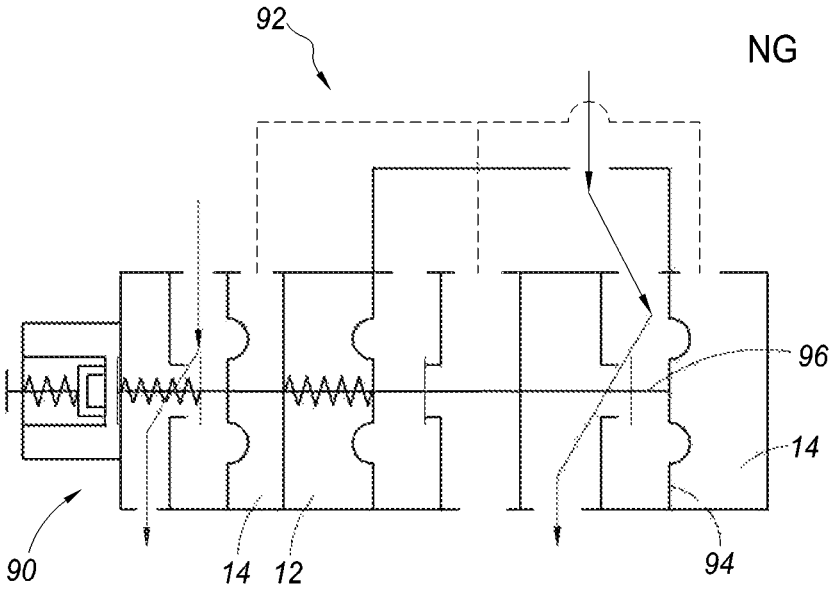
FIGS. 29A-B show another embodiment of locking valve with reset switch for a first fuel and a second fuel, respectively.
Figure 29B:
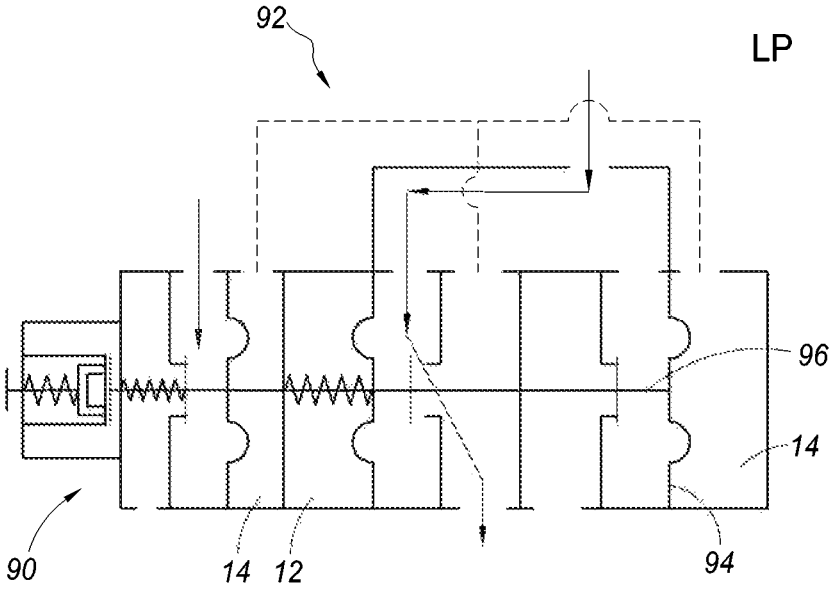

FIGS. 29A-B show another embodiment of locking valve 92 with reset switch 90 for a first fuel and a second fuel, respectively. The locking valve 92 with reset switch 90 is similar to that described above with respect to FIGS. 28A-B, except that in this embodiment, there are three internal valves and three separate flow paths. All three valves are linked together through member 96. Also in the illustrated embodiment, there are two inlets and three outlets.

Figure 30:
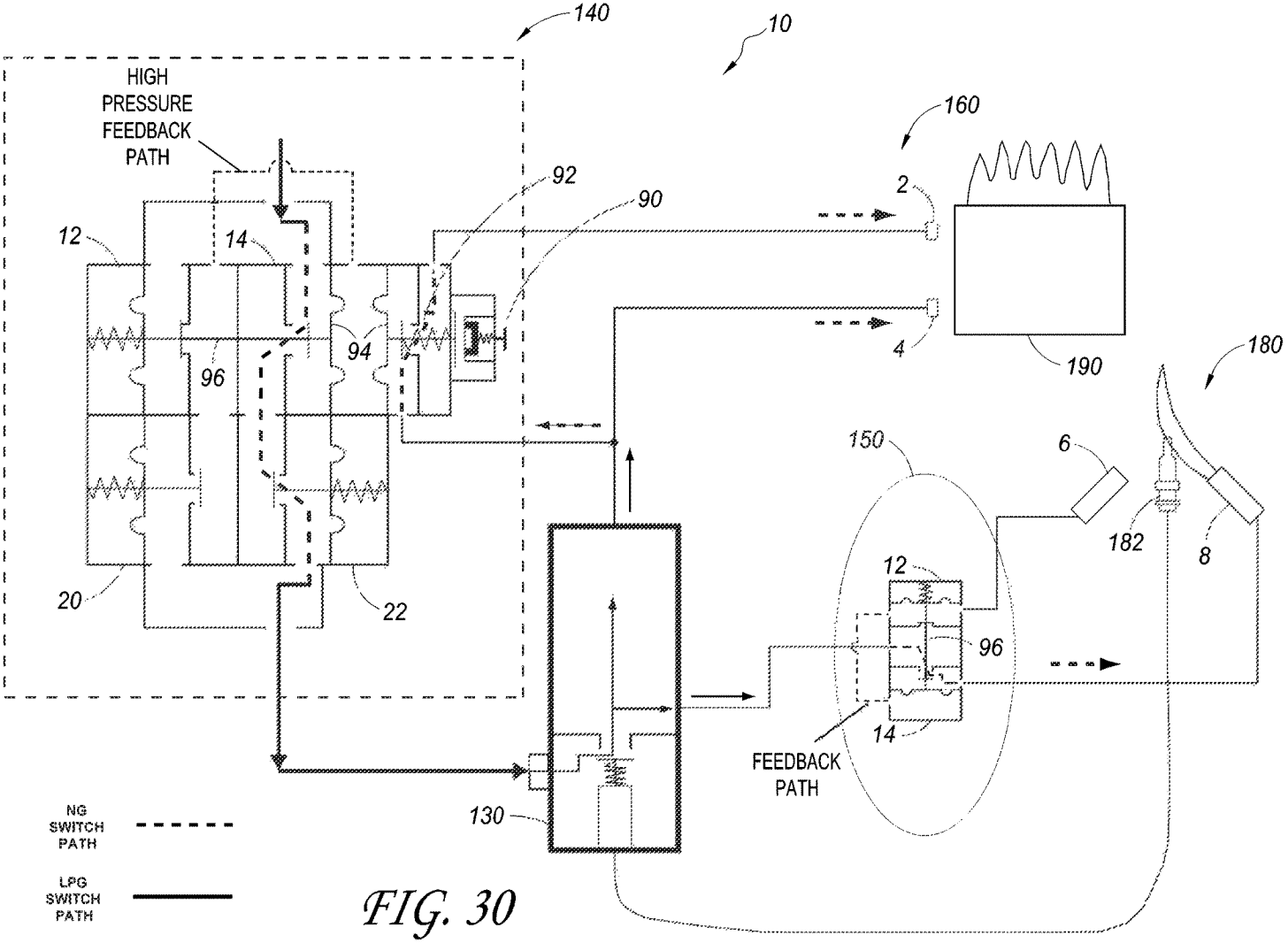
FIGS. 30 and 31 show a selector switch with locking valve and reset switch as part of a piloted heater system for a first fuel and a second fuel, respectively.
Figure 31:
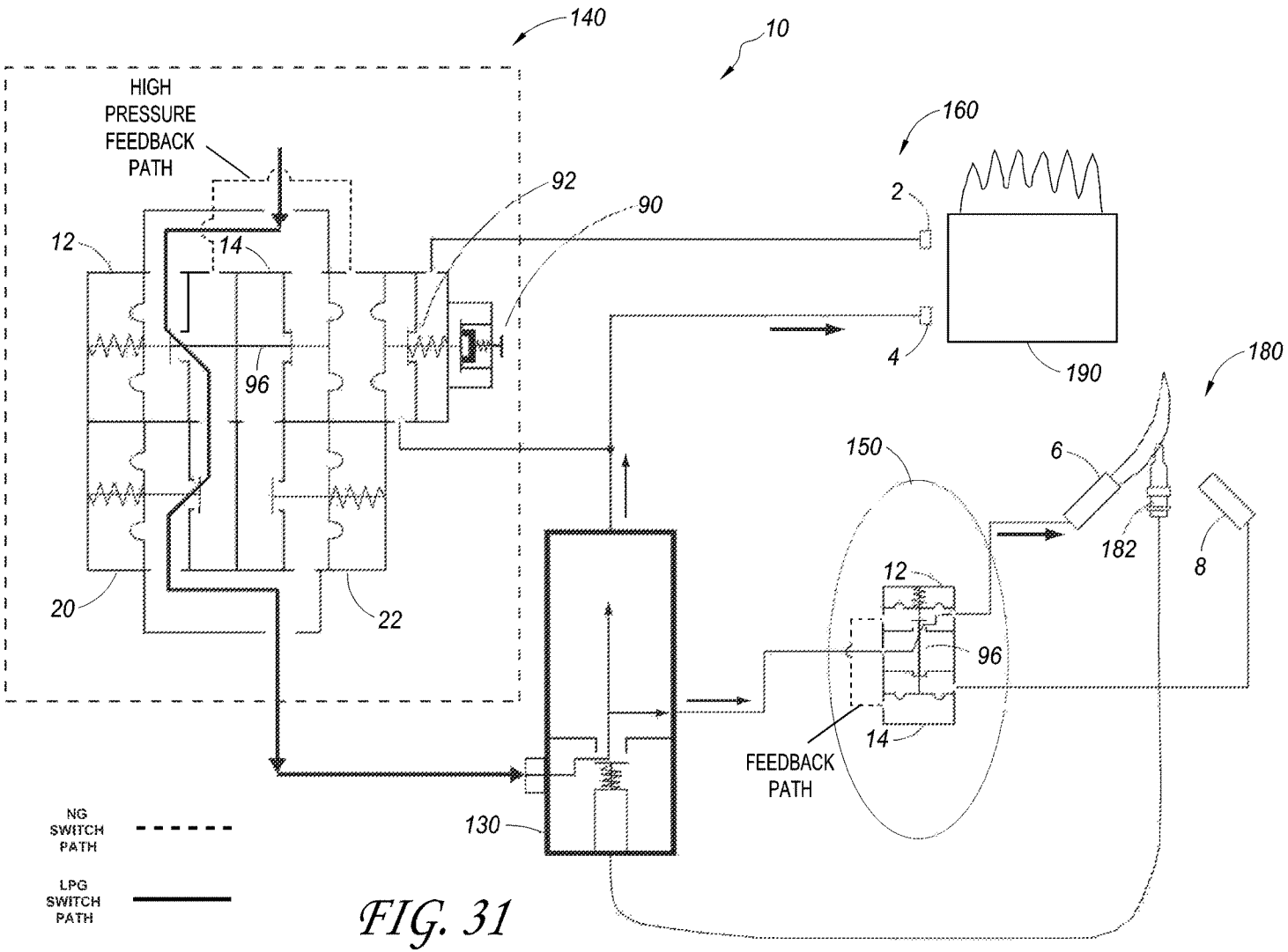

Moving now to FIGS. 30 and 31, a selector switch 140 with locking valve 92 and reset switch 90 are shown as part of a piloted heater system 10 for a first fuel and a second fuel, respectively. In some respects, the selector switch 140 is similar to that shown and described with respect to FIG. 13 and the piloted heater system 10 is similar to that shown and described with respect to FIG. 11. Certain additional features or differences are outlined below.

Looking first at the selector switch 140 of FIGS. 30 and 31, it can be seen that the position of the valves 12, 14 and the pressure regulators is the same as those shown in FIG. 13. One difference is that the valves 12, 14 are connected or linked through a member 96. Thus, when valve 12 is closed, valve 14 is open (FIG. 30) and vice versa (FIG. 31). This is similar to the locking valve 92 of FIGS. 29A-B, except that here the locking valve 92 is separate from the other two valves. In other words, the valve internal to the locking valve 92 is not linked to the other two valves 12, 14.

The locking valve 92 is shown with the magnetic plate and magnet locking system of FIG. 25. It will be understood that any type of locking system can be used.

The locking valve 92 can include a valve member, a valve seat, and a biasing member. The biasing member can comprise one or more of a spring and a diaphragm 94. The biasing member can bias the valve member to an open or closed position with respect to the valve seat. As shown in FIG. 30, the valve member is spaced from the valve seat such that the valve is in an open position, allowing flow through the valve 92.

Fluid pressure can be used to change the position of the valve member. The fluid pressure can be from the fluid flowing through the valve, such as between the valve member and the valve seat, or from fluid acting on a backside of a diaphragm 94, or from pressure acting on some other feature. This is shown by the high pressure feedback path illustrated as a dotted line running from the valve 12 to the area between to two diaphragms 94. As illustrated, pre-regulated fuel after passing through the valve 12 can provide a signal pressure in communication with a backside of the diaphragm 94. It will be understood that the pre-regulated fuel pressure will be greater than the post regulated pressure flowing through the valve and acting on the front side of the diaphragm 94.

In this way, the orifice selector valve 92 can control whether fuel flows to one or two burner nozzles 2, 4 of the nozzle 160 to the burner 190. In addition, as previously discussed, the locked valve can hold the valve member in the closed position if a higher pressure fuel, such as LP is provided to the system 10.

As can be seen, the pre-regulated fuel after passing through the valve 12 can provide a signal pressure in communication with a backside of a diaphragm 94 of the valve 14, in addition to the locking valve 92.

FIGS. 30 and 31 also illustrate a pilot selector switch similar to that shown in FIG. 11. One difference is that the valves 12, 14 are connected or linked through a member 96, so that one valve is closed while the other is open. In some embodiments, that pilot selector switch can include a locking valve 92 with reset switch 90, such as that shown in FIGS. 28A-B.

Flow through the piloted heater system 10 of FIGS. 30 and 31 will now be described with reference to a first fuel (FIG. 30) and a second fuel (FIG. 31). A first fuel, such as NG, can enter the inlet and begin to flow down two primary flow paths through the selector switch 140. The first fuel can be delivered at a lower pressure which can be insufficient to open the normally closed valve 12. Thus, the first fuel would proceed along the second primary flow path and through the normally open valve 14. From the normally open valve 14, fuel would flow to the second pressure regulator 22 where it is regulated, and then out of the selector switch 140.

From the selector switch 140, fuel can flow to the control valve 130. The control valve 130 can selectively provide fuel to both the burner 190 and to the pilot 180. As has been previously discussed with respect to other embodiments, the pilot 180 is first proven, prior to fuel flowing to the burner 190. As can be seen, the pilot 180 can include different pilot nozzles for the different fuels, such as an LP pilot nozzle 6 and an NG pilot nozzle 8. Each pilot nozzle 6, 8 can have a dedicated thermocouple, or they can be directed to a single thermocouple 182 as shown. In addition, in some embodiments, the nozzles can direct heat to different parts of the same thermocouple.

In order to prove the pilot 180, the control valve 130 directs fuel flow to the pilot selector switch 150. The pilot selector switch 150 can function similar to the selector switch 140 previously described without the pressure regulators. As shown, the pilot selector switch 150 has one inlet that leads to two primary paths through the pilot selector switch 150 to two outlets. A normally closed valve 12 is positioned in front of or upstream from the first pilot nozzle 6 and a normally open valve 14 is positioned in front of or upstream from the second pilot nozzle 8. These two valves are linked by member 96 so that one is closed while the other is open.

The first fuel, such as NG, can enter the inlet of the pilot selector switch 150 and begin to flow down the two primary flow paths. The first fuel can be delivered at a lower pressure which can be insufficient to open the normally closed valve 12. Thus, the first fuel can flow to the normally open valve 14 and then proceed through to the second pilot nozzle 8 to prove the pilot.

Once the pilot is proven, the control valve 130 can allow fuel to flow to the locking valve 92 with reset switch 90 that is part of the selector valve 140. Fuel can also flow directly to one of the orifices 2 of the burner nozzle 160 and then to the burner 190.

At the locking valve 92, as the fuel is at a lower pressure it can be insufficient to close the locking valve 92. In addition, it will be understood that as valve 12 of the selector valve remains closed, there is no unregulated fuel flowing to the backside of the diaphragm 94 of the locking valve 92. Thus, fuel is allowed to flow through the locking valve 92 to the second orifice 4 of the burner nozzle 160 and to the burner 190. Thus, when a low pressure fluid flows from the control valve 130, desirably the fluid can flow to both nozzle orifices 2, 4.

Looking now to FIG. 31, fuel flow at a higher pressure, such as LP, will be described. The second fuel can enter the inlet and begin to flow down the two primary flow paths. The second fuel can be delivered at a pressure sufficient to open the normally closed valve 12. Thus, the second fuel can proceed along the first primary flow path to the first pressure regulator 20. The second fuel can be regulated and leave the selector switch 140 through an outlet. Because the two valves are linked, opening valve 12 will cause valve 14 to close.

In addition, the pre-regulated fuel after passing through the valve 12 can provide a signal pressure in communication with a backside of the diaphragms 94 of the valve 14 and the valve of the locking valve 90. This is shown by the high pressure feedback path illustrated as a dotted line running from the valve 12 to the area between to the two diaphragms 94. The higher pressure fuel can cause the locking valve 90 to close. The locking feature can engage to secure the valve in a locked position until the reset mechanism is pressed 90.

Once the fuel leaves the first pressure regulator 20 and the outlet of the selector valve 140 it can flow to the control valve 130. The control valve 130 can selectively provide fuel to both the burner 190 and to the pilot 180. In order to prove the pilot 180, the control valve 130 directs fuel flow to the pilot selector switch 150.

The second fuel, such as LP, can enter the inlet of the pilot selector switch 150 and begin to flow down the two primary flow paths. The second fuel can be delivered at a higher pressure which can open the normally closed valve 12. As the valves 12 and 14 are linked, this also closes valve 14. Thus, the second fuel can flow to the normally closed valve 12 and then proceed through to the first pilot nozzle 6 to prove the pilot 180.

Once the pilot is proven, the control valve 130 can allow fuel to flow to the locking valve 92 with reset switch 90 that is part of the selector valve 140. Fuel can also flow directly to one of the orifices 2 of the burner nozzle 160 and then to the burner 190.

As has been mentioned, the pre-regulated fuel at the higher pressure after passing through the valve 12 can cause the locking valve 92 to close. Thus, fuel is prevented from passing through the locking valve 92 and as a result, fuel does not flow to the second orifice 4. As a result, when a high pressure fluid flows from the control valve 130, the fluid can flow to only one nozzle orifice 2.

As will be understood, the selector switch 140 can be set to allow a first fuel at a first pressure to flow through the second primary flow path and a second fuel at the second higher pressure to flow through the first primary flow path.

The selector switch 140 can also prevent the wrong fuel from flowing through the selector switch 140 through the wrong path. In addition, the locking valve 92 can help ensure that the system works properly and safely, even if there is a change in pressure but no change in fuel.

Though not shown, additional features, such as a bypass or cutoff valve 76 can also be used in the heating system 10.

Figure 32:
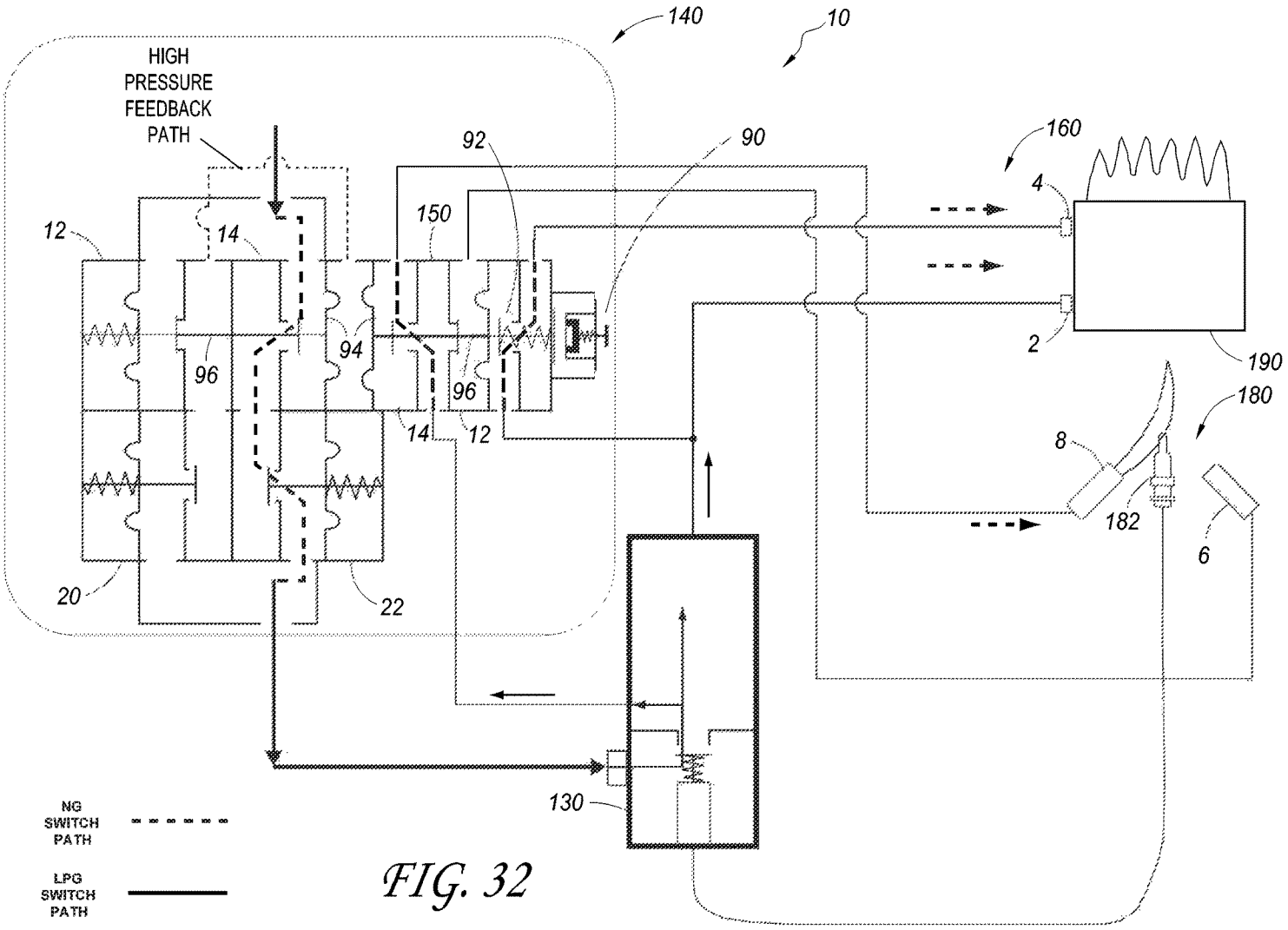
FIGS. 32 and 33 show another embodiment of selector switch with locking valve and reset switch as part of a piloted heater system for a first fuel and a second fuel, respectively.
Figure 33:
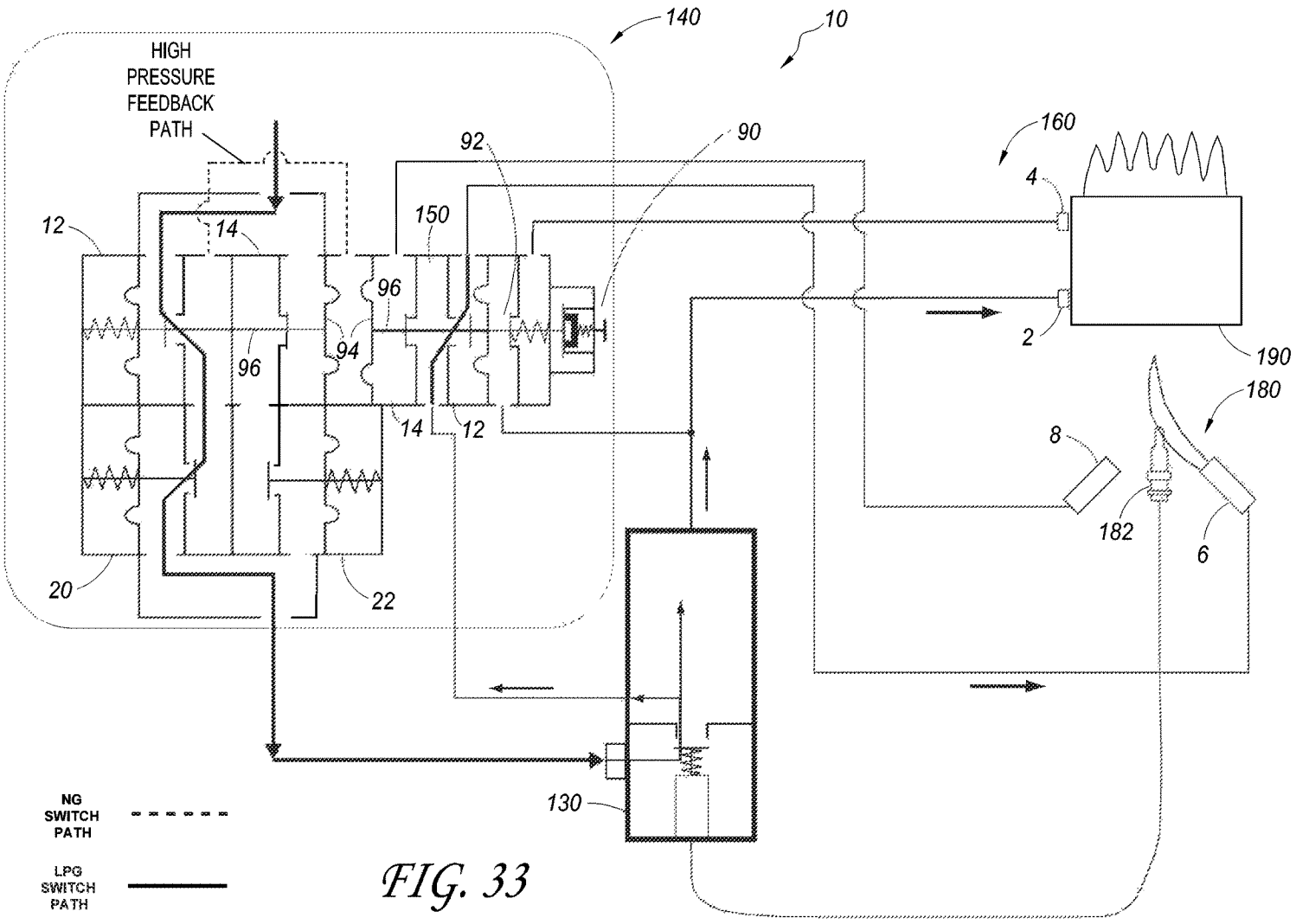

FIGS. 32 and 33 show another embodiment of selector switch 140 with locking valve 92 and reset switch 90 as part of a piloted heater system 10. The selector switch 140 is similar to that shown in FIGS. 30 and 31; one difference being that in FIGS. 32 and 33, the pilot selector switch 150 has been integrated into the selector switch 140. In addition, it can be seen that the locking valve 92 and the pilot selector switch 150 are connected or linked through a member 96. This results in one of the two valves of the pilot selector switch being open while the other is closed, while the locking valve alternates between open and closed positions. In addition, this also results in the locking valve 92 being able to lock its position, as well as the position of the pilot selector switch 150.

As illustrated, pre-regulated fuel after passing through the inlet and valve 12 can provide a signal pressure in communication with a backside of the diaphragms 94 of the two valves 14. This is shown by the high pressure feedback path illustrated as a dotted line running from the valve 12 to the area between to the two diaphragms 94. As the valve 14 that is part of the pilot selector valve 150 is linked to the locking valve 92, this can move the locking valve and lock it into position. As mentioned, this can also lock the valves of the pilot selector valve 150 into position. The locking feature can engage to secure the valves in a locked position until the reset mechanism is pressed 90.

Fluid pressure can be used to change the position of the valve members in other ways as well. The fluid pressure can be from the fluid flowing through the valve, such as between the valve member and the valve seat, or from fluid acting on a backside of a diaphragm 94 (the same and/or different diaphragms than those shown), or from pressure acting on some other feature.

The various embodiments of the selector switch 140 can be formed within a single housing. There can be no external pipes between the components of the selector switch; the flow channel of one component (valve, pressure regulator, etc.) can lead directly into a flow channel of another component. In the illustrated embodiment, the locking valve 92 locks the pilot selector valve 150 into position. In other embodiments, the locking valve 92, pilot selector valve 150 and the two valves 12, 14 leading to or from the pressure regulators 20, 22 can all be connected or linked through a member 96. In still other embodiments, additional locking valves can be used in the system.

The housing of the illustrated selector valve 140 has three inlets and four outlets. It can include two pressure regulators, four or five valve members and a locking/release mechanism. In addition, one of the inlets can be a gas hook-up for connecting a gas source to the selector switch 140. The other inlets and outlets can be fluidly coupled to one or more of a control valve 130, a burner nozzle 160, and a pilot 180, among other components.

FIGS. 34 through 38 show another embodiment of selector switch 140 with locking valve 92 and reset switch 90 as part of a piloted heater system 10. The piloted heater system 10 is similar to that shown and described with respect to FIGS. 32-33. Thus, as shown, the piloted heater system 10 can have a single fuel source connection 26 that directs fuel to the pressure regulators 20, 22, that direct fuel to an outlet 25. The control valve 130 takes the regulated fuel from the selector valve 140 and selectively directs it to the burner 190 and to the pilot 180. The orifices 2, 4, 6, 8 that are used at the burner nozzle 160 and pilot 180 are determined by the fuel pressure which controls the selector valve 92. As has been previously discussed, the selector valve 92 also locks once an initial high fluid pressure flows therethrough.

It will be understood that the locking valve 92 and reset switch 90 are very similar to that shown and described with respect to FIGS. 29A-B. Thus, in this embodiment, there are three internal valves and at least three separate flow paths. All three valves are linked together through member 96. Also in the illustrated embodiment, there are two inlets and four outlets. One notable difference between this embodiment and that of FIGS. 29A-B is that the fuel flow to the "always on" burner orifice 2 also flows through the selector valve 92. It will be understood that this flow does not need to go through the selector valve.

The locking valve 92 is shown with the magnetic plate and magnet locking system of FIG. 25. It will be understood that any type of locking system can be used.

Figure 34:
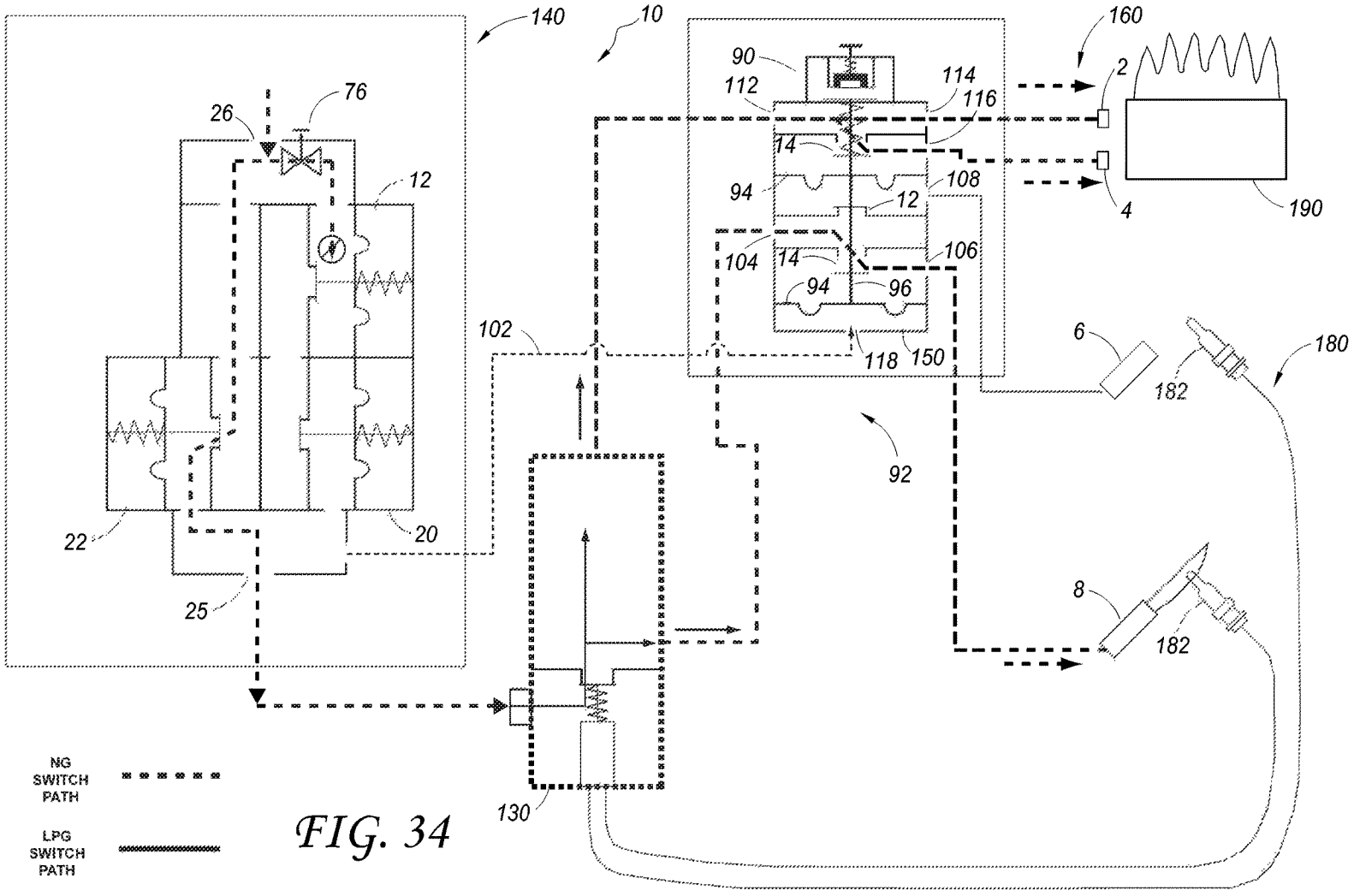
FIGS. 34-38 illustrate an embodiment of selector switch and locking valve with reset switch as part of a piloted heater system for a first fuel and a second fuel, respectively.

The locking valve 92 can include a biasing member and one or more valve member each with a corresponding valve seat. The biasing member can comprise one or more of a spring and a diaphragm 94. The biasing member can bias the valve member(s) to an open or closed position with respect to the valve seat(s). As shown in FIG. 34, two valve members are open, being spaced from their respective valve seats and one valve member is closed.

The selector switch 140 is similar to many of those discussed previously. It will be noted that the illustrated selector switch 140 has a single pressure switch, here a high pressure switch 12 that is normally closed. This is in contrast to many of the previously illustrated systems that had both a high pressure switch 12 and a low pressure switch 14; though single pressure switch systems were also previously discussed.

It will also be noted that though the selector valve 92, which is both a pilot selector switch and a nozzle selector switch, is shown schematically to be physically separate from the selector switch 140; both units can be integrated into a single housing.

The functioning of the piloted heater system 10 of FIGS. 34-38 under various pressure and fuel conditions will now be described. Looking first to FIG. 34, a first fuel flow at a low pressure is shown. For example, natural gas (NG) at a fluid supply pressure of 7-9 inches of water column can be provided to the inlet 26.

The first fuel, such as NG, can enter the inlet and begin to flow down two primary flow paths through the selector switch 140. The first fuel can be delivered at a lower pressure which can be insufficient to open the normally closed valve 12. Thus, the first fuel would proceed along the second primary flow path to the second pressure regulator 22 where it is regulated. The fuel can be regulated to 4, 5, or 6 inches of water column, for example. The regulated fuel can then exit the selector switch 140 through outlet 25.

From the selector switch 140, fuel can flow to the control valve 130. The control valve 130 can selectively provide fuel to both the burner 190 and to the pilot 180. As has been previously discussed with respect to other embodiments, the pilot 180 is first proven, prior to fuel flowing to the burner 190. As can be seen, the pilot 180 can include different pilot nozzles for the different fuels, such as an LP pilot nozzle 6 and an NG pilot nozzle 8. Each pilot nozzle 6, 8 can have a dedicated thermocouple 182 as shown, or they can be directed to a single thermocouple 182. In addition, in some embodiments, the nozzles can direct heat to different parts of the same thermocouple.

In order to prove the pilot 180, the control valve 130 directs fuel flow to the pilot selector switch 150 portion of the locking valve 92. As shown, the pilot selector switch 150 has one inlet that leads to two primary paths through the pilot selector switch 150 to two outlets. A normally closed valve 12 is positioned in front of or upstream from the first pilot nozzle 6 and a normally open valve 14 is positioned in front of or upstream from the second pilot nozzle 8. These two valves are linked by member 96 so that one is closed while the other is open.

The first fuel, such as NG, can enter the inlet of the pilot selector switch 150 and begin to flow down the two primary flow paths. The first fuel can be delivered at a lower pressure which can be insufficient to open the normally closed valve 12. Thus, the first fuel can flow to the normally open valve 14 and then proceed through to the second pilot nozzle 8 to prove the pilot.

Once the pilot is proven, the control valve 130 can allow fuel to flow to the burner selector switch portion of the locking valve 92. At the locking valve 92, as the fuel is at a lower pressure it can be insufficient to close the locking valve 92. In addition, it will be understood that as valve 14 of the selector valve remains open, fuel is allowed to flow through the locking valve 92 to the second orifice 4 of the burner nozzle 160 and to the burner 190. Thus, when a low pressure fluid flows from the control valve 130, desirably the fluid can flow to both nozzle orifices 2, 4.

Figure 35:
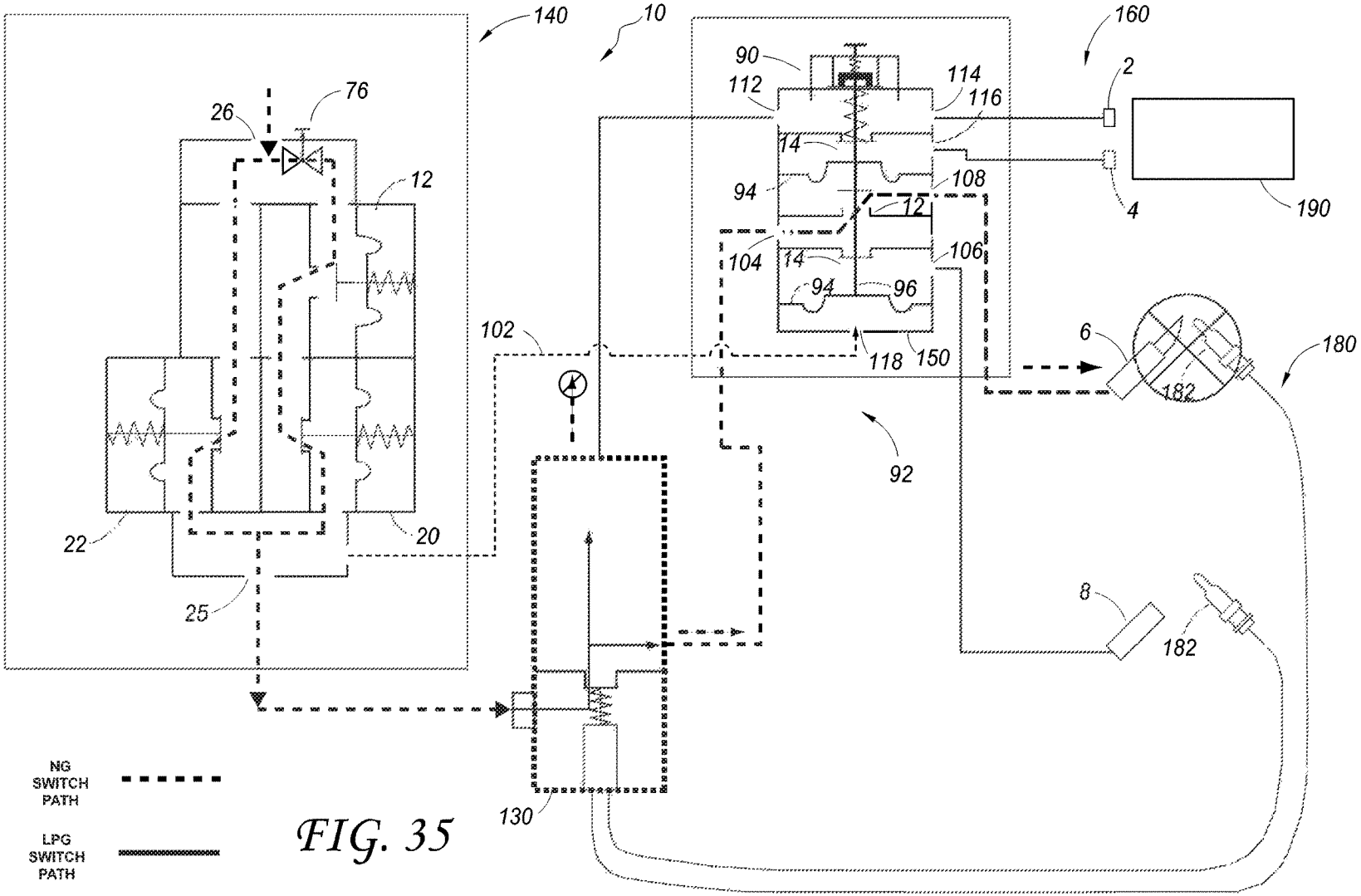
Figure 36:
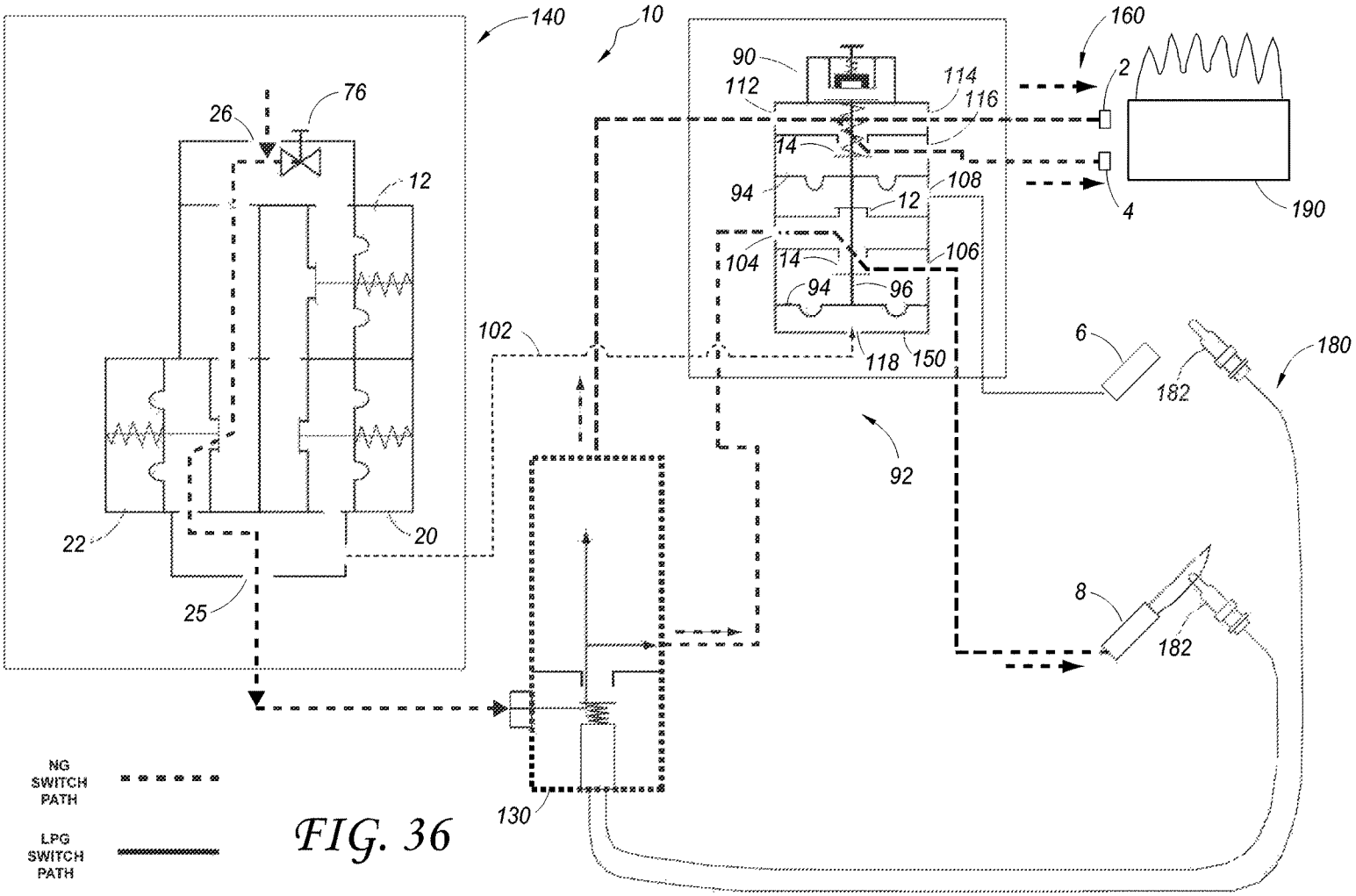

Turning now to FIG. 35, a second operating condition is shown. Here, a fuel with a low heating value (such as NG) is delivered at a high pressure. Because the system is designed for a fuel with a low heating value to be delivered at low pressure, the system does not allow normal operation.

The first fuel at high pressure can flow to and open the high pressure switch 12 in the selector switch 140. The high pressure switch 12 can be set to open at a threshold pressure, for example, the bottom of the expected or typical supply pressure range of the second fuel. This may be 10 or 11 inches water column in some embodiments, such as where liquid propane (LP) is typically delivered at between 11-13 inches water column. The first pressure regulator 20 can regulate the fuel pressure to be 7, 8, or 9 inches water column. This regulated fuel can then be delivered to the control valve 130. Depending on the range of supply pressure of the fuel, fuel may flow through both the first and second pressure regulators.

A fuel delivered to the pilot selector switch 150 at a pressure above a set threshold can move the valve to change which of the two valve seats and valve members are engaged. For example, the threshold pressure can be 8 inches water column. If the fuel has a low heat valve (NG) and is provided to an orifice sized for a fuel with a high heat value, then the flame will not heat the thermocouple enough to open the solenoid valve within the control valve 130. This will prevent fuel from flowing to the burner nozzle 160 as shown in FIG. 35. This can be because the orifice 6 is smaller than the orifice 8.

Providing a high pressure fuel can also cause the locking valve 92 to engage to secure the valve in a locked position until the reset mechanism is pressed 90.

The fuel can be delivered to the pilot selector switch 150 in many ways. In addition to the fuel that is delivered by the control valve 130, it can be seen that bleed line can be established between the selector switch 140 and the pilot selector switch 150. The bleed line can be an outlet signal pressure path 102. The outlet signal pressure path 102 can provide a small flow of regulated fuel to one of the diaphragms or valve members within the pilot selector switch 150. As shown, the outlet signal pressure path 102 provides a small flow of regulated fuel to the backside of a diaphragm within the pilot selector switch 150. This flow of fuel can be provided prior to fuel flowing from the control valve 130 to the pilot selector switch 150 and can advance the pilot selector switch 150 to the second and locked position.

Because the pilot light will not be proven and the heater will not function fully, the installer will normally check the system to discover what is wrong. If it is determined that the fuel is running above an expected or typical pressure, the heater may need to be set manually. Looking at FIG. 36 it can be seen how this can be done. The manual override switch 76 can be closed to force the fuel with a low heat value through the second pressure regulator which is set for that type of fuel. In addition, the reset button 90 can be pressed to reset the locking valve 92. With the fuel passing through the second pressure regulator 22 the regulated pressure will be less than the pressure resulting from the first pressure regulator 20.

With the selector switch 140 manually set, the low heat value gas, such as NG can flow through the system normally as described above with reference to FIG. 34.

Many locales run NG to a residential dwelling within a standard pressure range. This is typically between 7-9 inches water column. But, there are some places where the range might fluctuate more than normal, or the pressure might be higher than the standard pressure range. Thus, in some locales NG is provided with a supply pressure of up to 11 inches water column. In these situations, it may be necessary to manually set the selector switch 140 to the correct setting using the manual override switch 76.

Figure 37:
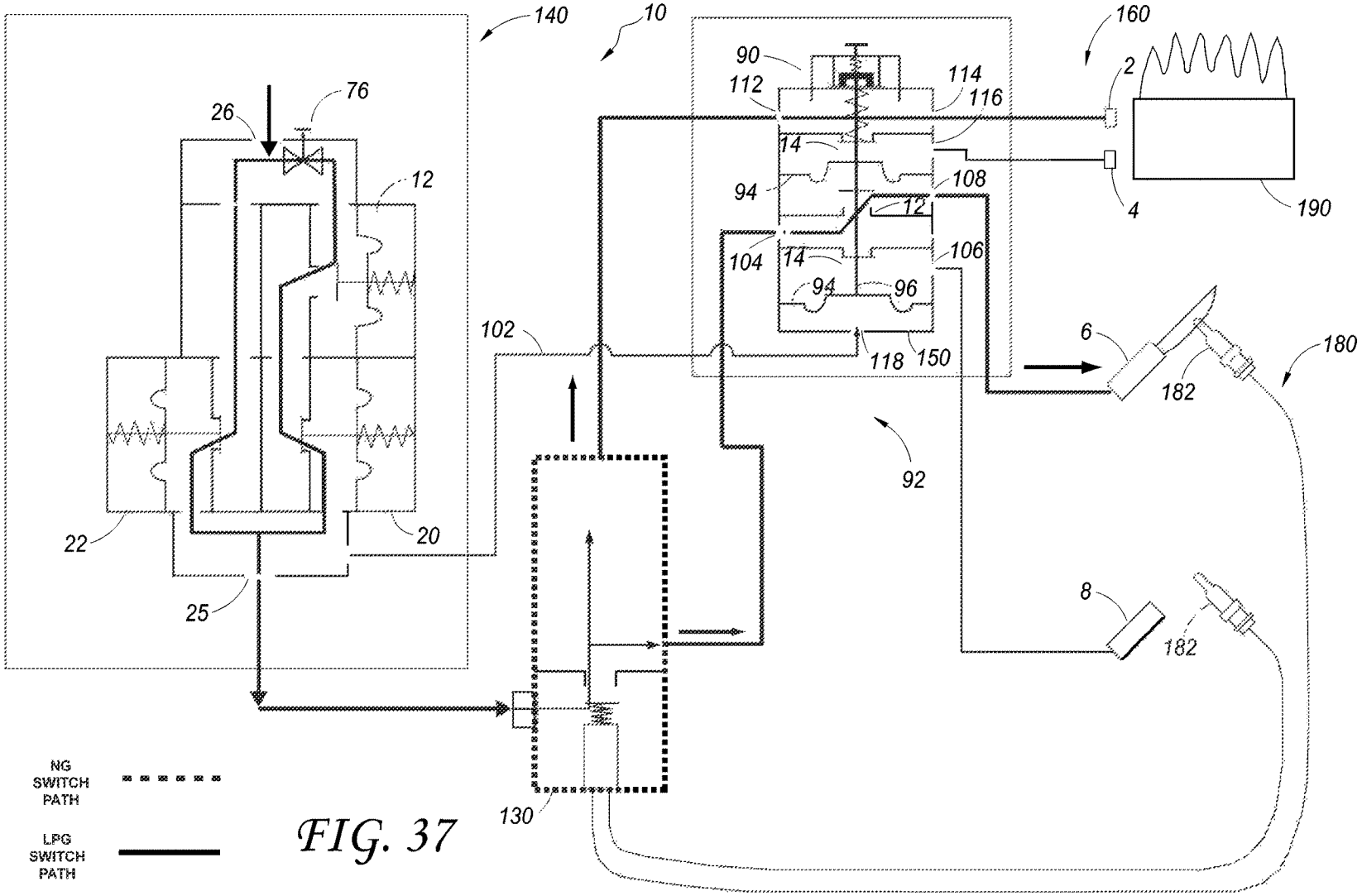

Looking now to FIG. 37, fuel flowing at a higher pressure with a higher heating value, such as LP, will be described. The second fuel can enter the inlet 26 and begin to flow down the two primary flow paths. The second fuel can be delivered at a pressure sufficient to open the normally closed valve 12. Thus, the second fuel can proceed along the first primary flow path to the first pressure regulator 20. The second fuel can be regulated and leave the selector switch 140 through an outlet 25.

In addition, the regulated fuel can provide a signal pressure through outlet signal pressure path 102 to a backside of the diaphragm 94 of the valve 14 and the valve of the locking valve 90. The higher pressure fuel can cause the locking valve 90 to close. The locking feature can engage to secure the valve in a locked position until the reset mechanism is pressed 90.

Once the fuel leaves the first pressure regulator 20 and the outlet of the selector valve 140 it can flow to the control valve 130. The control valve 130 can selectively provide fuel to both the burner 190 and to the pilot 180. In order to prove the pilot 180, the control valve 130 directs fuel flow to the pilot selector switch 150.

The second fuel, such as LP, can enter the inlet of the pilot selector switch 150 and begin to flow down the two primary flow paths. The second fuel can be delivered at a higher pressure which can open the normally closed valve 12. As the valves 12 and 14 are linked, this also closes valve 14. Thus, the second fuel can flow to the normally closed valve 12 and then proceed through to the first pilot nozzle 6 to prove the pilot 180.

Once the pilot is proven, the control valve 130 can allow fuel to flow to the burner selector switch portion of the locking valve 92. It will be understood that as valve 14 of the selector valve is closed, fuel is allowed to flow through the locking valve 92 to the first orifice 2 of the burner nozzle 160 and to the burner 190. Thus, when a high pressure fluid flows from the control valve 130, desirably the fluid can flow to only one nozzle orifice 2.

Figure 38:
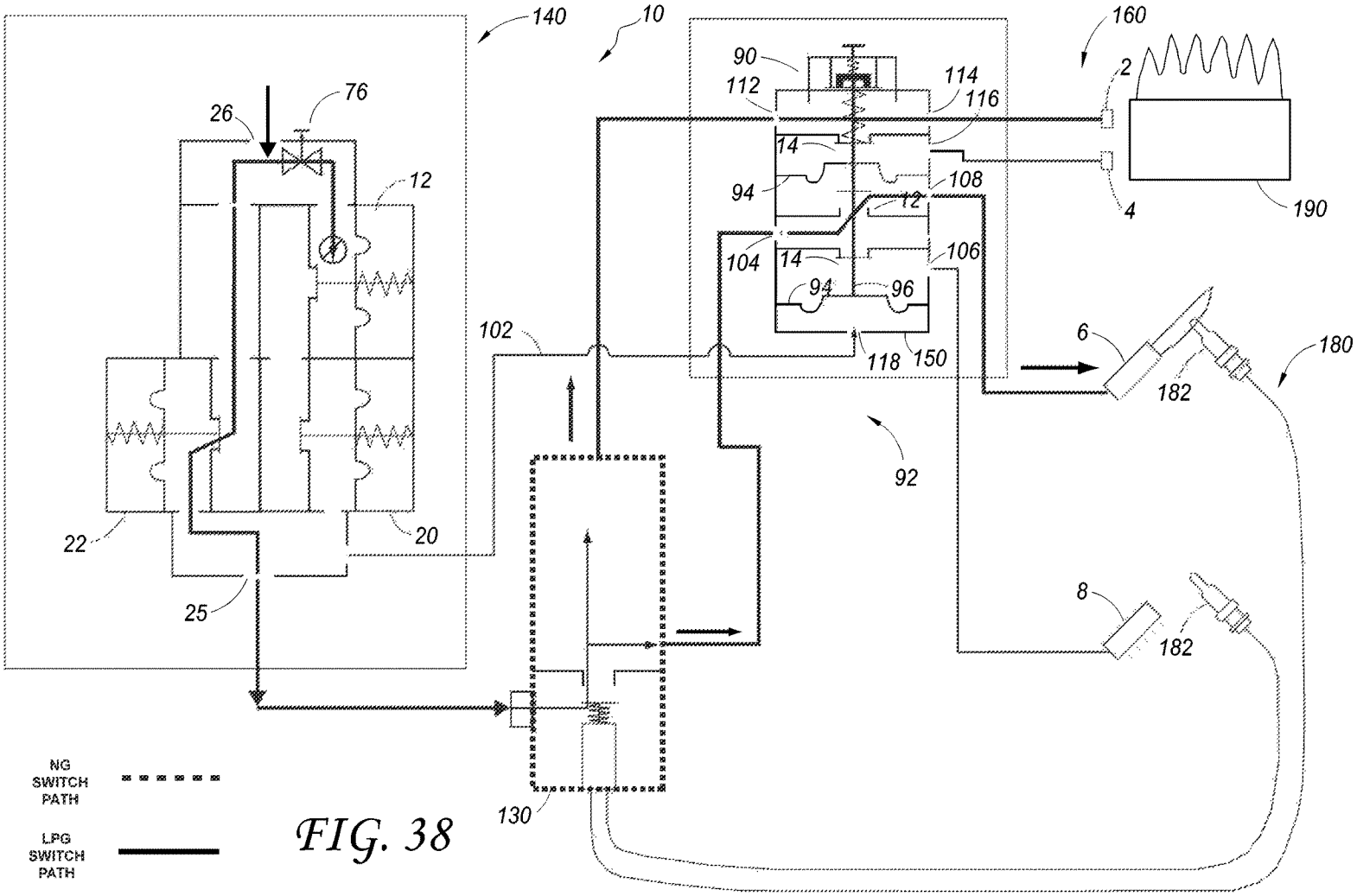

Liquid propane (LP) is often provided to heating devices in a tank. The tank typically provides the fuel within a consistent pressure range. At the same time, as the tank empties the pressure may slowly decrease or it may drop off after the tank empties to a large extent. In these situations, the LP can be provided at a lower than typical or desired pressure. FIG. 38 shows how the system 10 can respond to such a situation.

Because the fuel is at a lower than normal pressure it may no longer be able to open the high pressure switch 12 in the selector valve 140. This will cause the fuel to flow to the second pressure regulator 22 to be regulated to a lower pressure. But, because the locking valve 92 was previously set and is locked in position, fuel will still flow to the correct pilot and burner orifices.

It is anticipated that the reset switch 90 would only be accessed by a professional installer. This individual would desirably set-up the system based on the fuel type and typical pressures that are expected to be experienced at that location. Thus, if LP is used the high pressure will set the locked valve 92 to the locked, higher pressure/higher heat value position during initial set-up. It should normally not need to be reset unless a different fuel is to be used. This could be the case for example, if natural gas lines were accessed after the heater was initially set-up for a propane tank.

Figure 39A:
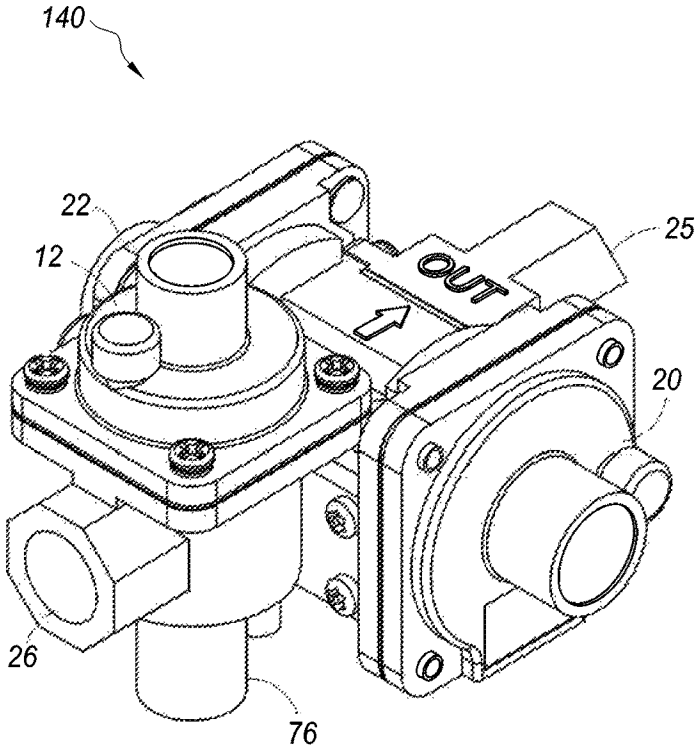
FIGS. 39A-B are front and back views of a selector switch.
Figure 39B:
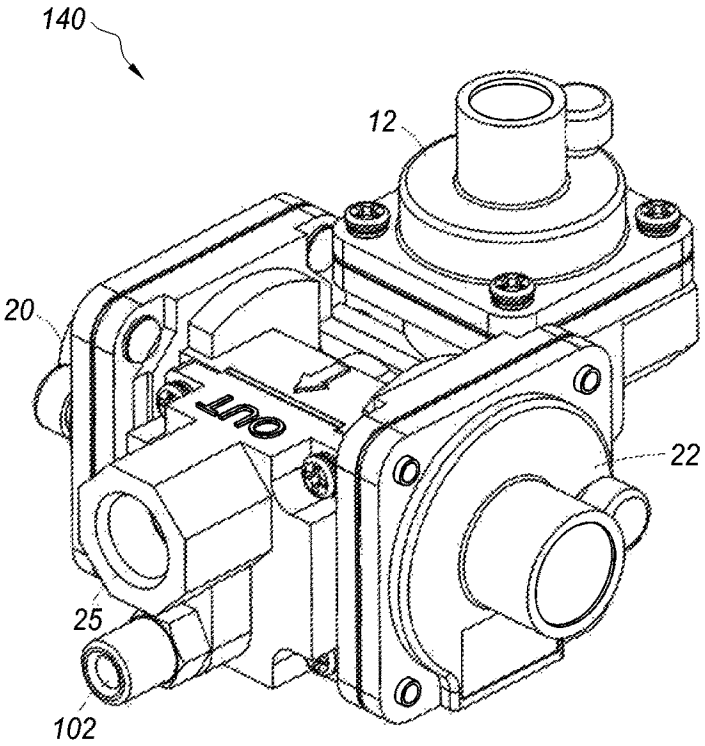
Figure 40:
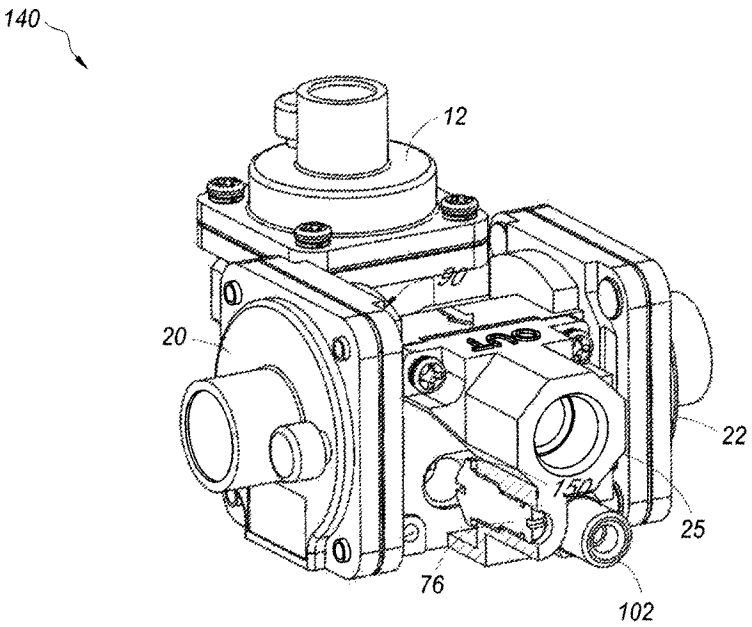
FIG. 40 is a front view of another embodiment of selector switch.

FIGS. 39A-B are front and back views of a selector switch 140 and FIG. 40 is a front view of another embodiment of selector switch 140. As shown, the selector switches 140 include an inlet 26, an outlet 25, first and second pressure regulators 20, 22, a high pressure switch 12, a manual override 76 and an outlet for the outlet signal pressure path 102. As can be seen, the main difference between the two versions of the selector switch 140 is the location of the manual override 76. In FIGS. 39A-B the manual override is near the inlet 26 and in FIG. 40 the manual override 76 is near the outlet 25.

Fuel can flow through the selector switches 140 of FIGS. 39A-40 as illustrated in the schematic views of FIGS. 34-38. FIGS. 39C-D show cross-sectional views of the selector switch of FIGS. 39A-B which can also be used to better understand the flow through the selector valves 140.

Figure 39C:
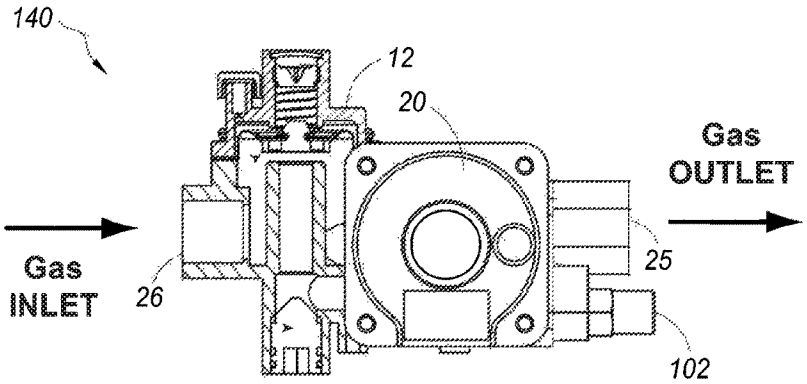
FIGS. 39C-D show cross-sectional views of the selector switch of FIGS. 39A-B.
Figure 39D:
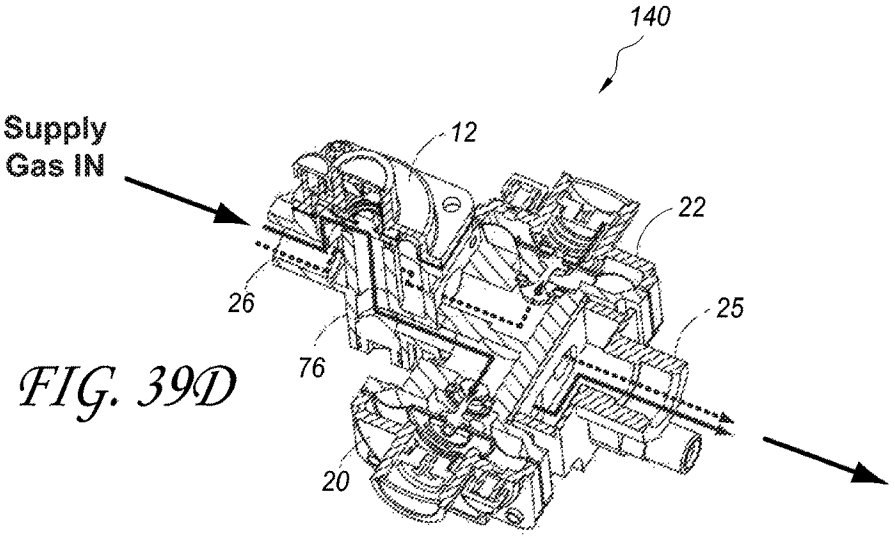

As shown in FIGS. 39C-40, the manual override 76 can be a screw that can advance within a hole to block flow through a particular passageway. As also illustrated, each of the pressure regulators 20, 22 and high pressure switch 12 can include a diaphragm, a spring, a calibrating screw to adjust the height of the screw and a vent to vent the backside of the diaphragm. They also include valve members that can engage with and a valve seat.

Figure 41A:
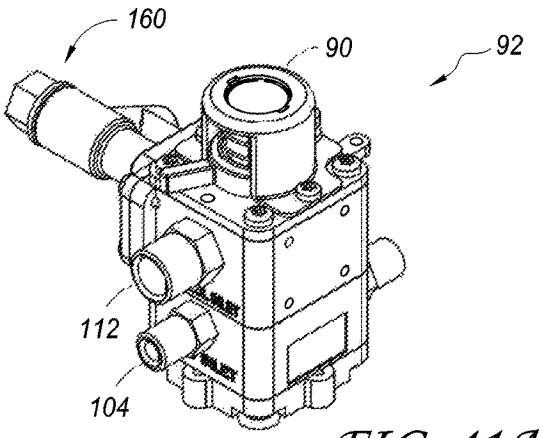
FIGS. 41A-B are perspective views of a locking selector valve.
Figure 41B:
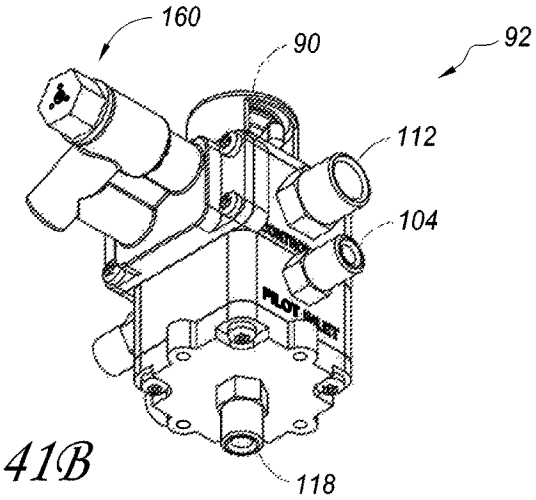
Figure 42C:
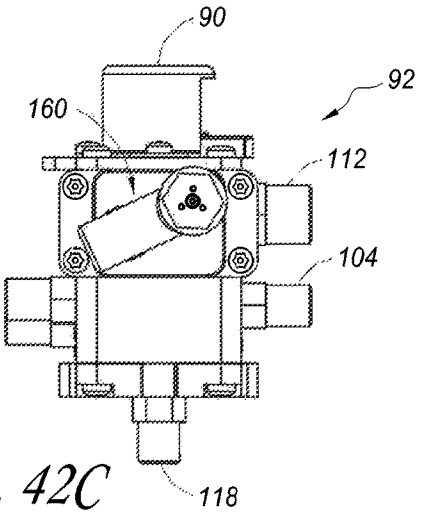

FIGS. 41A-B are perspective views of a locking selector valve 92. FIGS. 42 A-C show front and side views of the locking selector valve 92. The locking selector valve 92 is shown with a pilot inlet 104 and a burner inlet 112. As has been previously discussed, the locking selector valve 92 can direct the flow of fuel from the pilot inlet 104 to one of two outlets 106, 108. This can also be seen in the cross-sectional view of FIG. 43A. The first outlet 106 can direct fuel to an orifice 8 that is part of the pilot 180. In some embodiments, this can be used for NG. The second outlet 108 can direct fuel to an orifice 6 that is part of the pilot 180. In some embodiments, this can be used for LP.

Figure 43B:
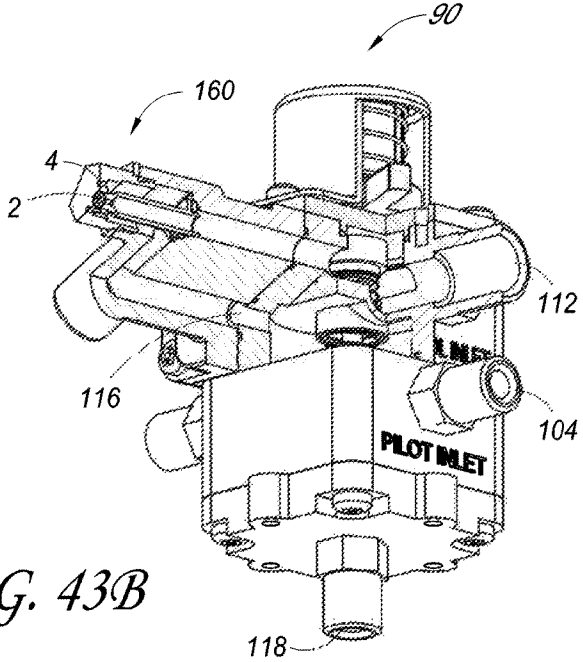
FIGS. 43A-B are cross-sectional views of the locking selector valve of FIGS. 41A-B.

As has also been previously discussed, the locking selector valve 92 can direct the flow of fuel from the burner inlet 112 to one or both of two outlets 114, 116. The first outlet 114 can be an "always on" outlet and the second outlet 116 can be selectable. These outlets can direct fuel to the burner nozzle 160. The flow paths to and through the burner nozzle 160 are best seen in the cross-sectional view of FIG. 43B.

The locking selector valve 92 can also be seen in FIGS. 41A-43B. The locking selector valve 92 can make a selection (i.e. determine the position of the valve member) based on fluid pressure. For example a flow of fuel can be directed through the outlet signal pressure path 102 to the signal pressure inlet 118. This flow of fuel can act on the diaphragm 94. If the set pressure is met or exceeded, the valve linkage 96 can be advanced and the positions of the valve members moved to a new position. The valve members and linkage 96 can be locked in this new position. A reset switch 90 can be used to reset a valve that is locked or held in a set position.

Figure 43A:
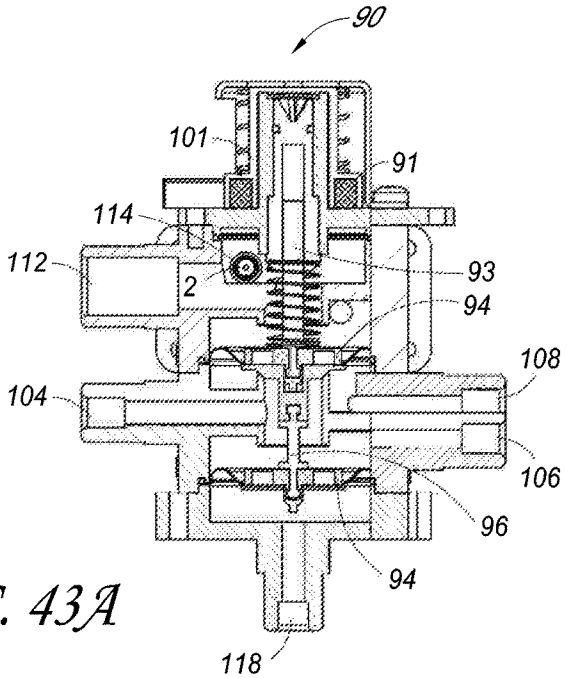

In FIG. 43A, a valve capture stem 93 can be a magnetic material and can be captured by the magnet 91. The stem 93 is shown mechanically coupled to the valve members and valve linkage 96. The magnet and stem can also be in a reversed configuration. The valve capture stem can be a plate, disk, rod, or any other magnetic material or shape.

The reset switch 90 can include a knob or lever 101 and a spring. A user can rotate the lever 101 to force the magnet 91 away from magnetic material on the stem 93. This will allow the stem 93 to move away from the magnet 91 if there are no counter acting forces on the backside of the diaphragm 94 and valve members. In other embodiments, the reset switch 90 can include a preferably non-magnetic rod and the user can push on the knob to advance the rod to separate the features.

According to some embodiments, a fuel selector switch can be used with either a first fuel or a second fuel different from the first. The fuel selector switch can comprise a valve and a reset switch. The valve can comprise a valve body, a valve seat, a spring and a diaphragm, the valve can be configured to have a closed position wherein the valve body is engaged with the valve seat and an open position wherein first valve body is disengaged from the valve seat, the valve configured such that fuel flowing through the valve seat in is communication with a front side of the diaphragm, the spring and diaphragm configured to bias the valve member to either the open or closed position. The reset switch can comprise a locking mechanism to lock the valve member in one of either the open or closed position; the reset switch can be further configured to release the valve member from being locked. The fuel selector switch can be configured such that an initial fluid pressure in communication with a backside of the diaphragm determines whether the valve is in the open position or the closed position.

According to some embodiments, a fuel selector switch can be used with either a first fuel or a second fuel different from the first. The fuel selector switch can comprise a housing, first and second valves, first and second pressure regulators and a reset switch. The housing can have a first inlet, a first outlet, and a first flow path between the first inlet and the first outlet. The first valve can be positioned in the first flow path and can comprise a first valve body and a first valve seat. The first valve can be configured to have a closed position wherein the first valve body is engaged with the first valve seat and an open position wherein the first valve body is disengaged from the first valve seat. The first pressure regulator can be positioned in the first flow path and configured to regulate a flow of fuel within a first predetermined pressure range. The second valve can comprise a second valve body and a second valve seat; the second valve can be configured to have a closed position wherein the second valve body is engaged with the second valve seat and an open position wherein the second valve body is disengaged from the second valve seat. The second pressure regulator can be configured to regulate a flow of fluid within a second predetermined pressure range different from the first predetermined pressure range. The fuel selector switch can be configured such that a fluid pressure of the fuel flowing through the fuel selector switch determines whether the first valve is in the open position or the closed position. The second valve can be configured such that a fluid pressure of fuel determines whether the second valve member is in the open or closed position, wherein when the second valve member is in the closed position the second valve member is fixed in position with respect to the second valve seat requiring actuation of the reset switch to move the second valve member from the closed position.

According to some embodiments, a fuel selector switch can be used with either a first fuel or a second fuel different from the first. The fuel selector switch can comprise a housing, first, second and third valves, first and second pressure regulators, and a reset switch. The housing can have a first inlet, a first outlet, a first flow path between the first inlet and the first outlet, a second flow path between the first inlet and the first outlet, a second inlet, a second outlet and a third flow path between the second inlet and the second outlet. The first valve can be positioned in the first flow path, the first valve comprising a first valve body and a first valve seat, the first valve configured to have a closed position wherein the first valve body is engaged with the first valve seat and an open position wherein the first valve body is disengaged from the first valve seat. The first pressure regulator can be positioned in the first flow path and configured to regulate a flow of fuel within a first predetermined pressure range. The second valve can be positioned in the second flow path, the second valve comprising a second valve body and a second valve seat, the second valve configured to have a closed position wherein the second valve body is engaged with the second valve seat and an open position wherein the second valve body is disengaged from the second valve seat. The second pressure regulator can be positioned in the second flow path and configured to regulate a flow of fluid within a second predetermined pressure range different from the first predetermined pressure range. The fuel selector switch can be configured such that a fluid pressure of the fuel flowing through the fuel selector switch determines whether the first flow path and the second path is open or closed as predetermined threshold fluid pressures determine the position of the respective first and second valves. The third valve can be positioned in the third flow path, the third valve comprising a third valve body and a third valve seat, the third valve configured to have a closed position wherein the third valve body is engaged with the third valve seat and an open position wherein the third valve body is disengaged from the third valve seat. The third valve can be configured such that a fluid pressure of fuel determines whether the third valve member moves from the open to the closed position, wherein when the third valve member is in the closed position the third valve member being fixed in position with respect to the third valve seat requiring actuation of the reset switch to move the third valve member from the closed position.

In some embodiments, a dual fuel heating assembly can be used with either a first fuel or a second fuel different from the first. The heating assembly can comprise a first orifice configured to direct fuel flow for combustion, a second orifice configured to direct fuel flow for combustion; and a nozzle selector valve configured to control fuel flow to the first orifice. The nozzle selector valve can comprise a valve seat, a valve member having first and second positions with respect to the valve seat, and a reset switch. The nozzle selector valve can be configured such that a fluid pressure of fuel within the heating assembly determines whether the valve member is in the first or second position, wherein when the valve member is in the second position the valve member is fixed in position with respect to the valve seat requiring actuation of the reset switch to move the valve member from the second position.

In some embodiments, a dual fuel heating assembly can be used with either a first fuel or a second fuel different from the first. The heating assembly can comprise a first pressure regulator configured to regulate a flow of fuel within a first predetermined pressure range, a second pressure regulator configured to regulate a flow of fluid within a second predetermined pressure range different from the first predetermined pressure range, a burner configured for combustion of fuel, a first burner orifice configured to direct fuel flow to the burner for combustion, a second burner orifice configured to direct fuel flow to the burner for combustion, a gas valve configured to receive fuel flow from either the first or the second pressure regulator and to direct fuel flow to the first and second burner orifices, and a nozzle selector valve configured to allow or prevent fuel flow from the gas valve to the first burner orifice. The nozzle selector valve can comprise a valve seat, a valve member configured for a first position spaced from the valve seat to allow fuel flow from the gas valve to the first burner orifice and a second position engaged with the valve seat to prevent fuel flow from the gas valve to the first burner orifice, and a reset switch. The nozzle selector valve can be configured such that a fluid pressure of fuel within the heating assembly determines whether the valve member is in the first or second position, wherein when the valve member is in the second position the valve member is fixed in position with respect to the valve seat requiring actuation of the reset switch to move the valve member from the second position to open the nozzle selector valve and allow flow therethrough.

In some embodiments, a dual fuel heating assembly can be used with either a first fuel or a second fuel different from the first. The heating assembly can comprise a pressure regulator configured to regulate a flow of fuel within a predetermined pressure range, a burner configured for combustion of fuel, a first burner orifice configured to direct fuel flow to the burner for combustion, a second burner orifice configured to direct fuel flow to the burner for combustion, a gas valve configured to receive fuel flow from the pressure regulator and to direct fuel flow to the first and second burner orifices, and a nozzle selector valve configured to allow or prevent fuel flow from the gas valve to the first burner orifice. The nozzle selector valve can comprise a valve seat, a valve member having first and second positions with respect to the valve seat, and a reset switch. The nozzle selector valve can be configured such that a fluid pressure of fuel within the heating assembly determines whether the valve member is in the first or second position, wherein when the valve member is in the second position the valve member is fixed in position with respect to the valve seat requiring actuation of the reset switch to move the valve member from the second position.

Advantageously, certain embodiments of the heating assembly as described herein facilitate a single appliance unit being efficaciously used with different fuel sources. This desirably saves on inventory costs, offers a retailer or store to stock and provide a single unit that is usable with more than one fuel source, and permits customers the convenience of readily obtaining a unit which operates with the fuel source of their choice.

Advantageously, certain embodiments of the heating assembly can transition between the different operating configurations as desired with relative ease and without or with little adjustment by an installer and/or an end user. Preferably, a user does not need to make a fuel selection through any type of control or adjustment. The systems described herein can alleviate many of the different adjustments and changes required to change from one fuel to another in many prior art heating sources.

Reference throughout this specification to "one embodiment" or "an embodiment" means that a particular feature, structure or characteristic described in connection with the embodiment is included in at least one embodiment. Thus, appearances of the phrases "in one embodiment" or "in an embodiment" in various places throughout this specification are not necessarily all referring to the same embodiment. Furthermore, the particular features, structures or characteristics of any embodiment described above may be combined in any suitable manner, as would be apparent to one of ordinary skill in the art from this disclosure, in one or more embodiments.

Similarly, it should be appreciated that in the above description of embodiments, various features of the inventions are sometimes grouped together in a single embodiment, figure, or description thereof for the purpose of streamlining the disclosure and aiding in the understanding of one or more of the various inventive aspects. This method of disclosure, however, is not to be interpreted as reflecting an intention that any claim require more features than are expressly recited in that claim. Rather, as the following claims reflect, inventive aspects lie in a combination of fewer than all features of any single foregoing disclosed embodiment. Thus, the claims following the Detailed Description are hereby expressly incorporated into this Detailed Description, with each claim standing on its own as a separate embodiment.

What is claimed is:

1. A dual fuel heating assembly for use with either a first fuel or a second fuel different from the first, the heating assembly comprising:

an inlet housing comprising:

a first pressure regulator configured to regulate a flow of fuel within a first predetermined pressure range;

a second pressure regulator configured to regulate a flow of fluid within a second predetermined pressure range different from the first predetermined pressure range;

a first housing outlet downstream of the first and second pressure regulators; and a second housing outlet downstream of the first and second pressure regulators;

a first orifice;

a second orifice;

wherein each of the first and second orifices are configured for the combustion of regulated fuel received from the first housing outlet;

a burner and a pilot light comprising a first pilot orifice, a second pilot orifice, and a thermocouple; the burner and pilot light being in fluid communication with the first housing outlet;

a selector switch comprising:

a selector switch inlet configured to receive a flow of regulated fuel;

a first selector switch outlet fluidly coupled to the first orifice;

a second selector switch outlet fluidly coupled to the second orifice;

a selector switch valve member and a corresponding selector switch valve seat; and a diaphragm, wherein the second housing outlet is fluidly coupled to the diaphragm such that a portion of regulated fuel flow acts on a backside of the diaphragm and wherein a pressure of the regulated fuel acting on the backside of the diaphragm determines whether the selector switch valve member is engaged with or disengaged from the selector switch valve seat, thereby determining whether regulated fuel entering the selector switch inlet is directed to one or both of the first orifice and the second orifice.

2. The heating assembly of claim 1, wherein the selector switch is configured to direct a flow of regulated fuel to the burner and further comprising a pilot selector switch having first and second pilot selector valves mechanically coupled to the selector switch valve member, and configured such that the position of the first and second pilot selector valves determine whether regulated fuel flows to one or both of the first pilot orifice and the second pilot orifice.

3. The heating assembly of claim 1, further comprising a gas valve configured to receive regulated fuel flow from either the first or the second pressure regulator through the first housing outlet and to controllably direct regulated fuel flow downstream to the selector switch inlet.

4. The heating assembly of claim 1, wherein the first orifice and the second orifice are part of a burner nozzle or a pilot light.

5. The heating assembly of claim 1, wherein the heating assembly is part of a water heater, a fireplace, an oven, a stove, a BBQ, or a dryer.

6. A dual fuel heating assembly for use with either a first fuel or a second fuel different from the first, the heating assembly comprising:

an inlet housing comprising:

a first pressure regulator configured to regulate a flow of fuel within a first predetermined pressure range;

a second pressure regulator configured to regulate a flow of fluid within a second predetermined pressure range different from the first predetermined pressure range;

a first housing outlet downstream of the first and second pressure regulators; and a second housing outlet downstream of the first and second pressure regulators;

a first orifice;

a second orifice;

wherein each of the first and second orifices are configured for the combustion of regulated fuel received from the first housing outlet;

a reset switch and wherein the selector switch is a locking valve configured such that if the pressure of the regulated fuel acting on the backside of the diaphragm exceeds a set threshold pressure, the selector switch valve member will engage with the selector switch valve seat and a second selector switch valve member will disengage from a second selector switch valve seat, and the locking valve will secure the first and second selector switch valve members in this position until the reset switch is actuated;

a selector switch comprising:

a selector switch inlet configured to receive a flow of regulated fuel;

a first selector switch outlet fluidly coupled to the first orifice;

a second selector switch outlet fluidly coupled to the second orifice;

a selector switch valve member and a corresponding selector switch valve seat; and a diaphragm, wherein the second housing outlet is fluidly coupled to the diaphragm such that a portion of regulated fuel flow acts on a backside of the diaphragm and wherein a pressure of the regulated fuel acting on the backside of the diaphragm determines whether the selector switch valve member is engaged with or disengaged from the selector switch valve seat, thereby determining whether regulated fuel entering the selector switch inlet is directed to one or both of the first orifice and the second orifice.

7. The heating assembly of claim 6, wherein the reset switch comprises a button or knob, and one of (1) a magnet and magnetic plate, (2) an invertible membrane, and (3) an air chamber with a one-way flap valve.

8. A dual fuel heating assembly for use with either a first fuel or a second fuel different from the first, the heating assembly comprising:

an inlet housing comprising:

a first pressure regulator configured to regulate a flow of fuel within a first predetermined pressure range;

a second pressure regulator configured to regulate a flow of fluid within a second predetermined pressure range different from the first predetermined pressure range;

a first housing outlet downstream of the first and second pressure regulators; and a second housing outlet downstream of the first and second pressure regulators;

a first orifice;

a second orifice;

wherein each of the first and second orifices are configured for the combustion of regulated fuel received from the first housing outlet;

a fuel selector switch, the fuel selector switch positioned within the inlet housing and between an inlet of the inlet housing and the first pressure regulator, the fuel selector switch comprising a normally closed valve configured to open at a set pressure, the set pressure being above a pressure setting of the second pressure regulatory;

a selector switch comprising:

a selector switch inlet configured to receive a flow of regulated fuel;

a first selector switch outlet fluidly coupled to the first orifice;

a second selector switch outlet fluidly coupled to the second orifice;

a selector switch valve member and a corresponding selector switch valve seat; and a diaphragm, wherein the second housing outlet is fluidly coupled to the diaphragm such that a portion of regulated fuel flow acts on a backside of the diaphragm and wherein a pressure of the regulated fuel acting on the backside of the diaphragm determines whether the selector switch valve member is engaged with or disengaged from the selector switch valve seat, thereby determining whether regulated fuel entering the selector switch inlet is directed to one or both of the first orifice and the second orifice.

9. The heating assembly of claim 8, further comprising a manual override switch, wherein the manual override switch is positioned in a flow path between the inlet and the first housing outlet and configured to prevent fuel from flowing from the inlet to the first pressure regulator and then out of the first housing outlet.

10. A dual fuel heating assembly for use with either a first fuel or a second fuel different from the first, the heating assembly comprising:

an inlet housing comprising:

a first pressure regulator configured to regulate a flow of fuel within a first predetermined pressure range;

a second pressure regulator configured to regulate a flow of fluid within a second predetermined pressure range different from the first predetermined pressure range;

a first housing outlet downstream of the first and second pressure regulators; and a second housing outlet downstream of the first and second pressure regulators;

a gas valve configured to receive regulated fuel flow from either the first or the second pressure regulator through the first housing outlet and to controllably direct regulated fuel flow downstream;

a pilot light comprising:

a first pilot orifice;

a second pilot orifice; and at least one thermocouple, each of the first and second pilot orifices configured to direct a flame at the at least one thermocouple through combustion of regulated fuel;

a pilot selector switch comprising:

a pilot selector switch inlet configured to receive a flow of regulated fuel;

a first pilot selector switch outlet fluidly coupled to the first pilot orifice;

a second pilot selector switch outlet fluidly coupled to the second pilot orifice;

first and second pilot selector switch valve members and corresponding first and second pilot selector switch valve seats, one of the first and second pilot selector switch valve members or the first and second pilot selector switch valve seats being connected to thereby move together so that when the first pilot selector switch valve member is engaged with the first pilot selector switch valve seat, the second pilot selector switch valve member is disengaged from the second pilot selector switch valve seat, the first pilot selector switch valve member positioned within a first flow path between the pilot selector switch inlet and the first pilot selector switch outlet and the second pilot selector switch valve seat positioned between the pilot selector switch inlet and the second pilot selector switch outlet; and a diaphragm, wherein the second housing outlet is fluidly coupled to the diaphragm such that a portion of regulated fuel flow acts on a backside of the diaphragm and wherein a pressure of the regulated fuel acting on the backside of the diaphragm determines whether the first pilot selector switch valve member is engaged with or disengaged from the first pilot selector switch valve seat.

11. The heating assembly of claim 10, further comprising a reset switch and wherein the pilot selector switch is a locking valve configured such that if the pressure of the regulated fuel acting on the backside of the diaphragm exceeds a set threshold pressure, the first pilot selector switch valve member will engage with the first pilot selector switch valve seat and the second pilot selector switch valve member will disengage from the second pilot selector switch valve seat, and the locking valve will secure the first and second pilot selector switch valve members in this position until the reset switch is actuated.

12. The heating assembly of claim 11, wherein the reset switch comprises a button or knob, and one of (1) a magnet and magnetic plate, (2) an invertible membrane, and (3) an air chamber with a one-way flap valve.

13. The heating assembly of claim 10, wherein the at least one thermocouple comprises a first and a second thermocouple, the first pilot orifice configured to direct a flame at the first thermocouple and the second pilot orifice configured to direct a flame at the second thermocouple.

14. The heating assembly of claim 10, wherein the diaphragm comprises one of the first pilot selector switch valve member and the first pilot selector switch valve seat.

15. The heating assembly of claim 10, further comprising a burner, a first burner orifice, and a second burner orifice, the first and second burner orifices configured to direct flow of regulated fuel from the gas valve to the burner for combustion.

16. The heating assembly of claim 15, further comprising a nozzle selector valve configured to allow or prevent flow of regulated fuel flow from the gas valve to the second burner orifice, the nozzle selector valve comprising: a nozzle selector valve seat; and a nozzle selector valve member configured with a first position spaced from the nozzle selector valve seat to allow flow of regulated fuel from the gas valve to the second burner orifice and a second position engaged with the nozzle selector valve seat to prevent flow of regulated fuel from the gas valve to the second burner orifice.

17. The heating assembly of claim 16, wherein the nozzle selector valve is mechanically coupled to the pilot selector switch such that the position of the first and second pilot selector switch valve members determines the position of the nozzle selector valve member.

18. The heating assembly of claim 10, further comprising a fuel selector switch, the fuel selector switch positioned within the inlet housing and between an inlet of the inlet housing and the first pressure regulator, the fuel selector switch comprising a normally closed valve configured to open at a set pressure, the set pressure being above a pressure setting of the second pressure regulator.

19. The heating assembly of claim 18, further comprising a manual override switch, wherein the manual override switch is positioned in a flow path between the inlet and the first housing outlet and configured to prevent fuel from flowing from the inlet to the first pressure regulator and then out of the first housing outlet.

* * * * *